US010227943B2

(12) United States Patent
Fukuzumi et al.

(10) Patent No.: US 10,227,943 B2
(45) Date of Patent: Mar. 12, 2019

(54) VEHICLE ENGINE CONTROL SYSTEM

(71) Applicant: Mitsubishi Electric Corporation, Tokyo (JP)

(72) Inventors: Eitaro Fukuzumi, Tokyo (JP); Mitsunori Nishida, Tokyo (JP)

(73) Assignee: Mitsubishi Electric Corporation, Chiyoda-ku, Tokyo (JP)

( * ) Notice: Subject to any disclaimer, the term of this patent is extended or adjusted under 35 U.S.C. 154(b) by 84 days.

(21) Appl. No.: 15/443,091

(22) Filed: Feb. 27, 2017

(65) Prior Publication Data

US 2018/0066597 A1 Mar. 8, 2018

(30) Foreign Application Priority Data

Sep. 2, 2016 (JP) ..... 2016-171491

(51) Int. Cl.
*F02D 41/26* (2006.01)
*F02D 41/20* (2006.01)
*F02M 51/06* (2006.01)

(52) U.S. Cl.
CPC ..... *F02D 41/20* (2013.01); *F02D 41/26* (2013.01); *F02D 2041/201* (2013.01);
(Continued)

(58) Field of Classification Search
CPC ..... F02D 2041/2003; F02D 2041/2006; F02D 2041/201; F02D 2041/2013;
(Continued)

(56) References Cited

U.S. PATENT DOCUMENTS 6,832,601 B2 * 12/2004 Watanabe ..... F02D 41/20 123/480
7,546,830 B2 * 6/2009 Nagase ..... B60K 6/48 123/490

(Continued)

FOREIGN PATENT DOCUMENTS

JP 2011-241688 A 12/2011
JP 2014-211103 A 11/2014

*Primary Examiner* — Sizo Vilakazi
*Assistant Examiner* — Kevin R Steckbauer
(74) *Attorney, Agent, or Firm* — Sughrue Mion, PLLC; Richard C. Turner

(57) ABSTRACT

In voltage boosting circuit for performing rapid power supply to a plurality of electromagnetic coils that drive fuel-injection electromagnetic valves, an overcurrent from vehicle battery is suppressed, and continuous noise is prevented from being produced. Each of rapid-power-supply voltage boosting capacitors that are connected in parallel with each other is charged from corresponding one of a pair of induction devices, which are asynchronously on/off-magnetized by first and second voltage boosting control circuits, by way of corresponding one of charging diodes in a pair; when addition value of exciting currents for induction devices in a pair continuously exceeds predetermined value, driving modes of one of and the other one of voltage boosting control circuits are set to large-current low-frequency mode and to small-current high-frequency mode, respectively, so that on/off timing of exciting current becomes irregular even when respective inductances values of induction devices in a pair are close to each other.

15 Claims, 22 Drawing Sheets

EMBODIMENT 1

(52) U.S. Cl.
CPC ..... *F02D 2041/2003* (2013.01); *F02D 2041/2006* (2013.01); *F02D 2041/2013* (2013.01); *F02D 2041/2024* (2013.01); *F02D 2041/2051* (2013.01); *F02D 2041/2058* (2013.01); *F02D 2041/2065* (2013.01); *F02D 2041/2068* (2013.01); *F02D 2041/2075* (2013.01); *F02M 51/061* (2013.01)

(58) Field of Classification Search
CPC ..... F02D 2041/202; F02D 2041/2024; F02D 2041/2065; F02D 2041/2068; F02D 2041/2075; F02D 2041/2082
See application file for complete search history.

(56) References Cited

U.S. PATENT DOCUMENTS

| | | | | |
|---|---|---|---|---|
| 8,020,533 | B2 * | 9/2011 | Tsuchiya | F02M 51/0603 123/478 |
| 9,777,667 | B2 * | 10/2017 | Fukuda | F02D 41/20 |
| 2004/0155121 | A1 * | 8/2004 | Watanabe | F02D 41/20 239/533.2 |
| 2007/0284456 | A1 * | 12/2007 | Tsuchiya | F02M 51/0603 239/102.2 |
| 2007/0289579 | A1 * | 12/2007 | Nagase | B60K 6/48 123/472 |
| 2013/0104856 | A1 * | 5/2013 | Fukuda | F02D 41/20 123/490 |
| 2014/0316679 | A1 | 10/2014 | Nishida et al. | |

* cited by examiner

FIG. 4A SMALL-CURRENT SETTING
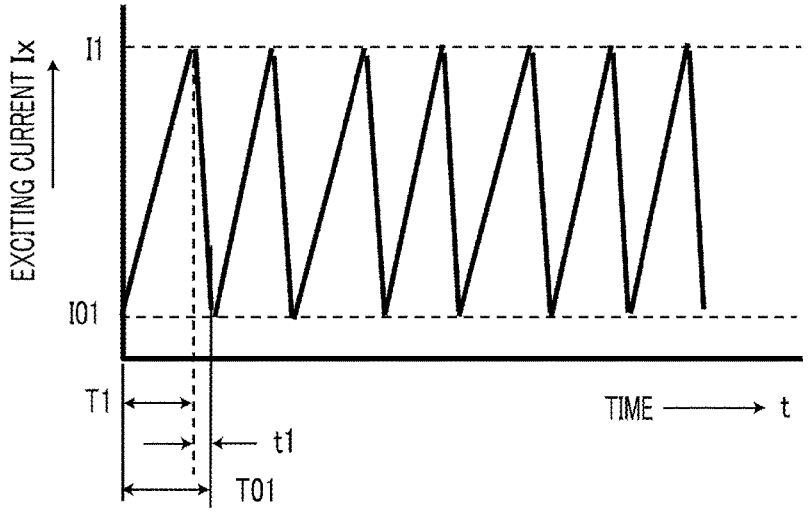
FIG. 4B LARGE-CURRENT SETTING
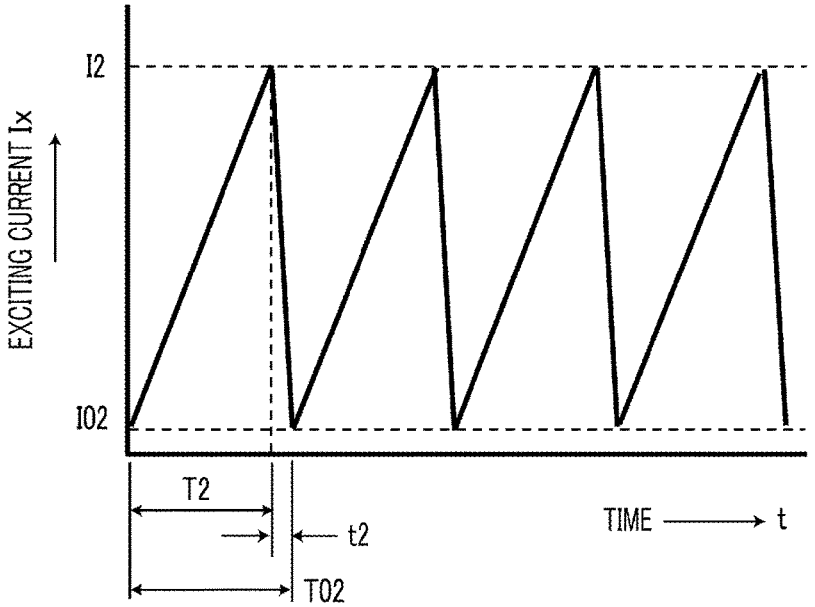

FIG.7 VARIANT EMBODIMENT

FIG. 14 ON/OFF CONTROL & DRIVING MODE

FIG. 15 SYNCHRONIZATION STATE DETERMINATION (SYNCHRONIZATION INSTANCE COUNTING METHOD/GENERATION OF SELx)

FIG. 16 SYNCHRONIZATION TIMING DETECTION (DRIVE COMMAND MONITORING TYPE/PLS0 GENERATED)

FIG. 17 SYNCHRONIZATION TIMING DETECTION (MAGNETIZING CURRENT MONITORING TYPE/PLS0 GENERATED)

VEHICLE ENGINE CONTROL SYSTEM

INCORPORATION BY REFERENCE

The disclosure of Japanese Patent Application No. 2016-171491 filed on Sep. 2, 2016 including its specification, claims and drawings, is incorporated herein by reference in its entirety.

BACKGROUND

The present invention relates to a vehicle engine control system in which, in order to rapidly drive the fuel-injection electromagnetic valve of an internal combustion engine, a boosted high voltage is instantaneously supplied from a vehicle battery to the electromagnetic coil for driving the electromagnet valve and then valve-opening holding control is performed for a predetermined period by means of the voltage of the vehicle battery, and more particularly to the configuration of an improved voltage boosting control circuit unit.

With regard to a fuel injection control apparatus in which, for a plurality of electromagnetic coils that are provided at the respective cylinders of a multi-cylinder engine and drive the respective fuel-injection electromagnetic valves, a microprocessor that operates in response to the output of a crank angle sensor sequentially and selectively sets the respective valve opening timings and valve opening periods, there exist various methods for a voltage boosting circuit that makes it possible to perform high-frequency fuel injection and rapid opening of an electromagnetic valve. For example, according to FIG. 1 of Japanese Patent Application Publication No. 2011-241688, a high-voltage capacitor 163 for performing rapid power supply is alternately charged from first and second induction devices 161*a* and 161*b* that are on/off-driven alternately by first and second voltage boosting control circuits 160*a* and 160*b*, by way of first and second charging diodes 162*a* and 162*b*; in a period in which one of the induction devices is excited by a vehicle battery 101, electromagnetic energy accumulated in the other induction device is discharged to a high-voltage capacitor 163 so that concurrent energization by excitation currents is prevented; thus, an overcurrent from a vehicle battery is suppressed, and the heat generated in the voltage boosting circuit is dispersed. This kind of cooperative voltage boosting circuit is suitable for a fuel injection control apparatus that performs fuel injection twice or more times in one fuel supply cycle so as to raise the fuel combustion performance.

According to FIG. 2 of Japanese Patent Application Publication No. 2014-211103, in an induction device 202 that is on/off-excited by a voltage boosting opening/closing device 206 so as to charge a high-voltage capacitor 204 up to a high voltage, an induction device current Ix, which is proportional to the voltage across a current detection resistor 201A, and a detection boosted voltage Vx, which is a divided voltage of the high-voltage capacitor 204, are inputted to a voltage boosting control circuit unit 210A by way of a high-speed A/D converter provided in a calculation control circuit unit 110A; while adjusting the induction device current Ix in such a way that the adjustment is completed within a period from the present rapid excitation to the next rapid excitation, the voltage boosting control circuit unit 210A performs opening/closing control of the voltage boosting opening/closing device 206 in order to obtain a target boosted high voltage Vh that is changeably set by a microprocessor in the calculation control circuit unit 110A; as a result, it is made possible that in a voltage boosting circuit unit that generates a rapid-excitation high voltage for a fuel-injection electromagnetic coil, setting of control constants is facilitated and the opening duration of the voltage boosting opening/closing device 206 is shortened so that high-frequency charging is performed. When a pair of such voltage boosting circuits is utilized, it is also made possible to charge a common high-voltage capacitor in an asynchronous manner.

SUMMARY (1) Explanation for Problems in the Prior Art

In the vehicle engine control system disclosed in JP-A-2011-241688, synchronous control is performed in such a way that when one of first and second voltage boosting opening/closing devices 164*a* and 164*b* provided in the first and second voltage boosting control circuits 160*a* and 160*b*, respectively, is opened, the other one thereof is closed; as a result, an overcurrent from a vehicle battery is suppressed, and the heat generated in the voltage boosting circuit is dispersed. Here, letting L1 and L2, R1 and R2, Vb, Vc, K (=(Vc−Vb)/Vb), Tu1 and Tu2, Td1 and Td2 denote the inductances of the first and second induction devices 161*a* and 161*b*, element resistors, a power-source voltage, the charging voltage across the voltage boosting capacitor 163, a voltage boosting rate, circuit-closing times, of the first and second voltage boosting opening/closing devices 164*a* and 164*b*, that are required to obtain a target peak current Ip, circuit-opening times of the first and second voltage boosting opening/closing devices 164*a* and 164*b*, that are required to attenuate an exciting current to zero, the equations (1) through (4) are established.

$$L1\times(Ip/Tu1)\approx Vb \tag{1}$$

$$L2\times(Ip/Tu2)\approx Vb \tag{2}$$

$$L1\times(Ip/Td1)\approx Vc-Vb=K\times Vb \tag{3}$$

$$L2\times(Ip/Td2)\approx Vc-Vb=K\times Vb \tag{4}$$

where the values of the time constants τ1 (=L1/R1) and τ2 (=L2/R2) of the first and second induction devices 161*a* and 161*b* are sufficiently large in comparison with the circuit-closing times Tu1 and Tu2 or the circuit-opening times Td1 and Td2 and the voltage boosting rate K is, for example, 3.57 (=64−14)/14).

Accordingly, in the case where asynchronous control is performed in such a way that when after the exciting current for the induction device reaches the target peak current Ip, the voltage boosting opening/closing device is opened and then the exciting current becomes zero, the voltage boosting opening/closing device is immediately closed again, the on/off period T01 and T02 are given by the equations (5) and (6), respectively.

$$T01=Tu1+Td1=L1\times(1+1/K)\times(Ip/Vb) \tag{5}$$

$$T02=Tu2+Td2=L2\times(1+1/K)\times(Ip/Vb) \tag{6}$$

In contrast, the values of electromagnetic energy E1 and E2 accumulated in the first induction device 161*a* and the second induction device 161*b* through a single on/off-excitation are given by the equations (7) and (8), respectively.

$$E1=L1\times Ip^2/2 \tag{7}$$

$$E2=L2\times Ip^2/2 \tag{8}$$

As a result, the value of charging power W1 or W2 in one on/off period T01 or T02 is given by the equation (9) or (10), as the case may be; thus, whether or not the inductances are the same, the charging powers are the same as each other. In the case of asynchronous control, the equation "W1+W2=Ip×Vb×K/(1+K)=0.78×Ip×Vb" is established.

$$W1=E1/T01=0.5\times Ip\times Vb\times K/(1+K) \quad (9)$$

$$W2=E2/T02=0.5\times Ip\times Vb\times K/(1+K) \quad (10)$$

However, in the case where such synchronous control as disclosed in JP-A-2011-241688 is performed, the value of an on/off period T0 is given by the equation (11).

$$T0=Tu1+Tu2=(L1+L2)\times(Ip/Vb) \quad (11)$$

Accordingly, the value of a charging power W1' or W2' in one on/off period T0 is given by the equation (12) or (13), as the case may be; in the case of synchronous control, the equation "W1++W2'=0.5×Ip×Vp" is established.

$$W1'=E1/T0=0.5\times[L1/(L1+L2)]\times Ip\times Vb \quad (12)$$

$$W2'=E2/T0=0.5\times[L2/(L1+L2)]\times Ip\times Vb \quad (13)$$

In other words, the synchronous control performed in such a manner as disclosed in JP-A-2011-241688 is characterized in that the exciting currents for a pair of induction devices do not flow at the same time; however, because the open-circuit period of the voltage boosting opening/closing device is unnecessarily long for the induction device that is being discharged, the overall charging power drastically decreases, although the temperature rise is suppressed. In fact, the synchronous control performed in such a manner as disclosed in JP-A-2011-241688 is characterized in that when the target peak current Ip is increased up to 1.56 (0.78/0.5), a charging power that is the same as that in the asynchronous control can be obtained and the target peak current Ip that is twice as large as that in the asynchronous control does not flow. However, in the case where the inductances of the induction devices in a pair are different from each other, the exciting current for the induction device having a smaller inductance reaches the target peak current Ip in a short magnetization period and the cutoff period thereof (the magnetization period for the other induction device) becomes long and hence the power loss in the induction device and the voltage boosting opening/closing device is reduced; however, because the exciting current for the induction device having a larger inductance reaches the target peak current Ip in a long magnetization period and the cutoff period thereof (the magnetization period for the other induction device) becomes short, there has been a problem that the power loss in the induction device and the voltage boosting opening/closing device increases and heat is generated non-uniformly.

In contrast, "the vehicle engine control system and the control method thereof" according to foregoing JP-A-2014-211103 discloses that although the monitoring control of the charging current for the induction device and the charging voltage across the high-voltage capacitor is performed by a microprocessor having a high-speed A/D converter, the voltage boosting opening/closing device 206 is closed when the exciting current Ix for the induction device 202 reaches a lower setting current Ix1 or smaller and the voltage boosting opening/closing device 206 is opened when the exciting current Ix becomes an upper setting current Ix2 or larger. Thus, when the upper setting current Ix2 is set to the foregoing target peak current Ip and the lower setting current Ix1 is set to approximately zero and when the voltage boosting circuit units 200A in a pair are asynchronously driven, the equations (1) through (10) are directly applied and high-frequency fuel injection can be performed. In the case of an asynchronous cooperative voltage boosting circuit, the charging power is improved; however, there has been a problem that when the peak currents in the voltage boosting circuits in a pair flow at the same time, the overcurrent-burden on the vehicle battery increases, thereby enlarging noise in the voltage boosting control circuit, and hence detection of various kinds of fine signals becomes difficult. For example, when the on/off period of the voltage boosting opening/closing device having a larger inductance is set to 50 μsec and the on/off period of the voltage boosting opening/closing device having a smaller inductance is set to 40 μsec, one and the other one of the voltage boosting opening/closing devices operate 4 cycles and 5 cycles, respectively, in the cycle period of 200 μsec; the band widths of the peak currents almost completely overlap each other in one cycle thereof or a period where the band widths of the peak currents partially overlap each other occurs in two continuous cycles thereof.

However, when the on/off period of one of the voltage boosting opening/closing devices is set to 50 μsec and the on/off period of the other one of the voltage boosting opening/closing devices is set to 45 μsec, the one and the other one of the voltage boosting opening/closing devices operate 9 cycles and 10 cycles, respectively, in the cycle period of 450 μsec; the bandwidths of the peak currents almost completely overlap each other in two cycles thereof or a period where the band widths of the peak currents partially overlap each other occurs twice and a period where the band widths of the peak currents almost completely overlap each other occurs once in three continuous cycles. As described above, as the inductances of the induction devices in a pair become closer to each other, the cycle period becomes longer; in part of the cycle period, the band widths of the peak currents almost completely overlap each other (for example, 70 through 100% of the period of the peak current Ip) or the state where the band widths of the peak currents partially overlap each other continuously occurs. In contrast, when the on/off period of the voltage boosting opening/closing device having a larger inductance is set to 50 μsec and the on/off period of the voltage boosting opening/closing device having a smaller inductance is set to 30 μsec, one and the other one of the voltage boosting opening/closing devices operate 3 cycles and 5 cycles, respectively, in the cycle period of 150 μsec; the bandwidths of the peak currents almost completely overlap each other in one cycle thereof.

As described above, when synchronous control is applied to a pair of voltage boosting circuits in such a manner as disclosed in JP-A-2011-241688, there is demonstrated a characteristic that the bandwidths of peak currents do not overlap each other; however, there has been a problem that when there exists individual unevenness in the inductances of the induction devices, heat-generation loads of the induction devices become nonuniform and hence the heat generated in the induction device having a larger inductance becomes large. In contrast, when asynchronous control is applied to the pair of voltage boosting circuits in such a manner as disclosed in JP-A-2014-211103, the respective charging powers of the induction devices can be equalized even when the inductances thereof differ from each other; however, there has been a problem that because the band widths of peak currents periodically overlap each other, the overcurrent burden on the vehicle battery increases, noise to be generated increases, and elimination of the noise becomes difficult. Because this problem of noise continues longer as the inductance values of the induction devices in a pair become closer to each other, elimination of the noise by use of a filter becomes difficult.

(2) Explanation for the Objective of the Present Invention

The objective of the present invention is to provide a vehicle engine control system that can reduce an overcurrent burden on a vehicle battery and can facilitate elimination of generated noise even when in a voltage boosting control circuit in which in order to raise the charging power for a voltage boosting capacitor, a pair of induction devices is asynchronously on/off-controlled so that high-voltage charging is applied to a common voltage boosting capacitor, there exist diverse combinations, for example, the respective inductance values of the utilized induction devices in a pair are close to each other or the difference therebetween is large.

A vehicle engine control system according to the present invention includes driving control circuit units for a plurality of electromagnetic coils for driving fuel-injection electromagnetic valves provided in respective cylinders of a multi-cylinder engine, first and second voltage boosting circuit units, and a calculation control circuit unit formed mainly of a microprocessor, in order to drive the fuel-injection electromagnetic valves; the first and second voltage boosting circuit units include a first voltage boosting control unit and a second voltage boosting control unit, respectively, that operate independently from each other, a pair of induction devices that are on/off-excited by the first voltage boosting control unit and the second voltage boosting control unit, respectively, a pair of charging diodes that are connected in series with the respective corresponding induction devices in a pair, and one voltage boosting capacitor or a plurality of voltage boosting capacitors that are connected in parallel with each other, each of the voltage boosting capacitors being charged by way of the corresponding charging diodes in a pair with an induction voltage caused through cutting off of an exciting current Ix for the corresponding one of the induction devices in a pair and being charged up to a predetermined boosted voltage Vh through a plurality of the on/off exciting actions; the first voltage boosting control unit and the second voltage boosting control unit include a pair of voltage boosting opening/closing devices that are connected in series with the respective corresponding induction devices in a pair to be connected with a vehicle battery and that perform on/off control of the exciting currents Ix for the respective corresponding induction devices in a pair, and a pair of current detection resistors in each of which the exciting current Ix flows.

In Embodiment 1 of the present invention, there are provided a pair of current comparison determination units that cut off energization of one of or both of the voltage boosting opening/closing devices in a pair when after circuit-closing drive is applied to one of or both of the voltage boosting opening/closing devices in a pair, the exciting current Ix becomes the same as or larger than a target setting current, a pair of circuit-opening time limiting units that perform circuit-closing drive of one of or both of the voltage boosting opening/closing devices in a pair when after energization of one of or both of the voltage boosting opening/closing devices in a pair is cut off, a predetermined setting time or a predetermined current attenuation time elapses, and voltage boosting comparison determination units that prohibit circuit-closing drive of the respective corresponding voltage boosting opening/closing devices in a pair when the respective voltages across the corresponding voltage boosting capacitors become a predetermined threshold value voltage or higher; the circuit-opening time limiting unit is a circuit-opening time limiting timer, which is a time counting circuit that counts the setting time transmitted from the microprocessor, a circuit-opening time limiting means that counts the setting time in the microprocessor, or an attenuated current setting unit that adopts, as the current attenuation time, a time in which the exciting current Ix is attenuated to a predetermined attenuated current value; in accordance with a 1st setting current I1, which is the target setting current, and a 2nd setting current I2, which is a value larger than the 1st setting current I1, a 1st circuit-opening limit time t1, which is the setting time, and a 2nd circuit-opening limit time t2, which is a time that is longer than the 1st circuit-opening limit time t1, or a 1st attenuated current I01 and a 2nd attenuated current I02, each of which is the attenuated current value, any one of a 1st driving mode for small-current high-frequency on/off operation based on the 1st setting current I1, and the 1st circuit-opening limit time t1 or the 1st attenuated current I01, and a 2nd driving mode for large-current low-frequency on/off operation based on the 2nd setting current I2, and the 2nd circuit-opening limit time t2 or the 2nd attenuated current I02 is applied to one of and the other one of the first voltage boosting control unit and the second voltage boosting control unit; a synchronization state detection unit that detects and stores a state where respective circuit-opening timings of the voltage boosting opening/closing devices in a pair are continuously close to each other and generates a selection command signal SELx is further provided in each of the first voltage boosting control unit and the second voltage boosting control unit; the microprocessor includes an initial setting unit that sets the driving modes of the first voltage boosting control unit and the second voltage boosting control unit to a common driving mode, which is any one of the 1st driving mode and the 2nd driving mode, until the time when the selection command signal SELx is generated and an alteration setting unit that sets the driving modes of the first voltage boosting control unit and the second voltage boosting control unit to respective different driving modes, which are any one of the 1st driving mode and the 2nd driving mode and the other one thereof, after the time when the selection command signal SELx is generated.

The second invention of the present invention, which is configured in such a way that the exciting current Ix and the charging current Ic for the voltage boosting capacitor flow in the current detection resistor, includes a pair of current comparison determination units that cut off energization of one of or both of the voltage boosting opening/closing devices in a pair when after circuit-closing drive is applied to one of or both of the voltage boosting opening/closing devices in a pair, the exciting current Ix becomes the same as or larger than a predetermined setting current I0, a pair of attenuated current setting units that perform again circuit-closing drive of one of or both of the voltage boosting opening/closing devices in a pair when after energization of one of or both of the voltage boosting opening/closing devices in a pair are cut off, the exciting current Ix is attenuated to a predetermined attenuated current I00, and voltage boosting comparison determination units that prohibit circuit-closing drive of the respective corresponding voltage boosting opening/closing devices in a pair when the respective voltages across the corresponding voltage boosting capacitors become a predetermined threshold value voltage or higher; the first and second voltage boosting control units further include a synchronization state detection unit and an early-stage-cutoff opening/closing device that opens at an early stage one of the voltage boosting opening/closing devices in a pair, by use of a first early-stage circuit-opening signal FR1 or a second early-stage circuit-opening signal FR2 generated by the synchronization state detection unit, before the exciting current Ix reaches the setting current I0; the synchronization state detection unit includes an addition processing unit that generates an addition amplification voltage obtained by amplifying the addition value of a first current detection voltage Vc1, which is the voltage across one of the current detection resistors in a pair, and a second current detection voltage Vc2, which is the voltage across the other one of the current detection resistors, a synchronization timing detection unit that detects the fact that the respective waveforms of the exciting currents Ix for the corresponding induction devices in a pair synchronize with each other, when the addition amplification voltage of the addition processing unit exceeds an addition value determination threshold value voltage, and then generates an in-synchronization detection pulse PLS0, a first signal generation circuit that performs comparison between the first current detection voltage Vc1 and the second current detection voltage Vc2 and that generates the first early-stage circuit-opening signal FR1 when the in-synchronization detection pulse PLS0 has been generated and the result of said comparison is that Vc1 is larger than Vc2, and a second signal generation circuit that generates the second early-stage circuit-opening signal FR2 when the in-synchronization detection pulse PLS0 has been generated and the result of said comparison is that Vc1 is smaller than Vc2; the addition value determination threshold value voltage is a value that is the same as or larger than 70% but smaller than the maximum value of the addition amplification voltage.

As described above, the vehicle engine control system according to the first invention of the present invention includes the first voltage boosting circuit unit and the second voltage boosting circuit unit that on/off-excite a pair of induction devices so as to charge a common voltage boosting capacitor, in order to apply rapid-excitation to the electromagnetic coil for driving the fuel-injection electromagnetic valve. At least one of the first voltage boosting circuit unit and the second voltage boosting circuit unit can select the first driving mode for small-current high-frequency on/off operation or the second driving mode for large-current low-frequency on/off operation; a common driving mode is applied thereto until the synchronization state detection unit detects that the respective on/off operational actions for the induction devices in a pair synchronize with each other; after a synchronization state is detected and stored, different driving modes are applied thereto. Accordingly, in the case where due to individual unevenness and variation, the respective inductance values of the induction devices in a pair are different from each other, the circuit-closing times, of the voltage boosting opening/closing devices, for obtaining a common setting current differ from each other and hence the synchronization state where the respective circuit-opening timings of the voltage boosting opening/closing devices in a pair are continuously close to each other does not occur; thus, even when the driving is continued as ever before, the addition value of the exciting currents for the induction devices in a pair does not become continuously and excessively large; however, provided the inductance values of the induction devices in a pair are close to each other, the synchronization state where the respective circuit-opening timings of the voltage boosting opening/closing devices in a pair are continuously close to each other occurs and hence the addition value of the exciting currents for the induction devices in a pair become continuously and excessively large.

However, because when the synchronization state is detected, the driving modes are changed in such a way that one of the setting currents becomes the first setting current and the other one of thereof becomes the second setting current, escape from the synchronization state is performed and hence the addition value of the exciting currents for the induction devices in a pair does not become continuously and excessively large; thus, there is demonstrated an effect that continuous and excessively large noise can be prevented and that an overload on the vehicle battery is reduced. In the case where when the detection of a synchronization state is not performed and the drive is implemented with different driving modes from the initial stage, the inductance corresponding to the large current is small and the inductance corresponding to the smaller current is large, the respective on/off periods become close to each other and hence a continuous-synchronization state may occur; however, the present invention demonstrates a characteristic that because the drive is preliminarily implemented with the same driving mode and then the driving modes are changed after confirming that the respective inductance values of the induction devices in a pair are close to each other, the foregoing problem does not occur.

The vehicle engine control system according to the second invention of the present invention includes the first voltage boosting circuit unit and the second voltage boosting circuit unit that on/off-excite a pair of induction devices so as to charge a common voltage boosting capacitor, in order to apply rapid-excitation to the electromagnetic coil for driving the fuel-injection electromagnetic valve; the first voltage boosting circuit unit and the second voltage boosting circuit unit perform on/off-excitation of induction devices with a current ranging from a common setting current to an attenuated current, and when the addition value of the respective exciting currents for the induction devices in a pair exceeds a predetermined value, the exciting current for the induction device in which a larger current is flowing is cut off at an early stage. Accordingly, because before the addition value of the respective exciting currents for the induction devices in a pair becomes excessively large, the exciting current, for the induction device, that is approaching a target setting current is cut off at an early stage, the addition current does not increase up to a predetermined determination threshold value; the charging energy, for the voltage boosting capacitor, that is produced by the induction device that has been cut off at an early stage temporarily decreases; however, because the circuit-closing drive time is shortened, the charging power does not fall and hence the present early stage cutoff causes a time difference in the timing when circuit-closing is performed again; thus, the exciting current for the same induction device is not cut off at an early stage in a recurrent manner. Therefore, even when the respective inductances of the induction devices in a pair differ from each other, it is made possible to implement asynchronous on/off operation so as to charge the voltage boosting capacitor with the same charging power; concurrently, because the large-current low-frequency on/off operation and the small-current high-frequency on/off operation timely alternate with each other, the addition value of the respective exciting currents for the induction devices in a pair does not become excessively large; thus, there is demonstrated an effect that the excessive load on the vehicle battery is reduced and excessive noise is suppressed from occurring.

The foregoing and other object, features, aspects, and advantages of the present invention will become more apparent from the following detailed description of the present invention when taken in conjunction with the accompanying drawings.

BRIEF DESCRIPTION OF THE DRAWINGS

FIG. 4A is a current waveform chart in a first driving mode of the vehicle engine control system in FIG. 1;

FIG. 4B is a current waveform chart in a second driving mode of the vehicle engine control system in FIG. 1;

FIG. 2, is a detailed block diagram representing control of a voltage boosting circuit unit according to a variant embodiment;

FIG. 3, is a detailed block diagram representing control by a synchronization state detection unit according to a variant embodiment;

DETAILED DESCRIPTION OF THE EMBODIMENTS

Figure 1:
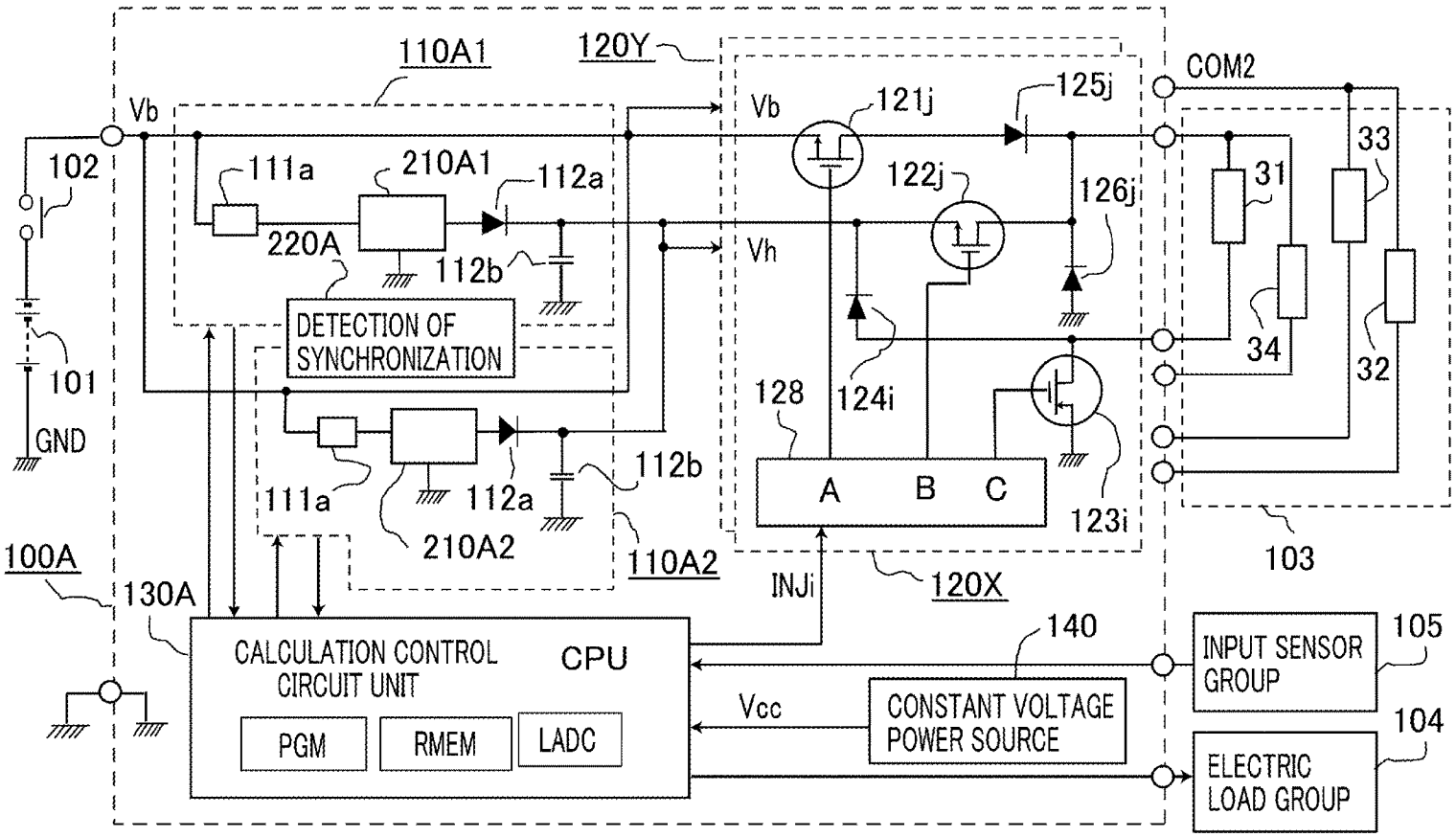
FIG. 1 is a block diagram representing the overall circuit of a vehicle engine control system according to Embodiment 1 of the present invention.

Embodiment 1 and Variant Embodiment Thereof (1) Detailed Description of Configuration At first, with reference to FIG. 1, which is a block diagram representing the overall circuit of a vehicle engine control system according to Embodiment 1 of the present invention, and FIG. 2, which is a detailed block diagram representing control of a voltage boosting circuit unit of the vehicle engine control system in FIG. 1, the configurations thereof will be explained in detail. In FIG. 1, a vehicle engine control system 100A is configured mainly with a calculation control circuit unit 130A including a microprocessor CPU; the vehicle engine control system 100A includes driving control circuit units 120X and 120Y that selectively drive electromagnetic coils 31 through 34 of a fuel-injection electromagnetic valve 103 which is part of a group of electric loads 104, in accordance with a corresponding cylinder group, and first and second voltage boosting circuit units 110A1 and 110A2 that cooperatively supply a boosted voltage Vh to the driving control circuit units 120X and 120Y. A vehicle battery 101, which is one of devices connected with the outside of the vehicle engine control system 100A, supplies a power-source voltage Vb to the vehicle engine control system 100A by way of an output contact 102 of a power supply relay that is energized through an unillustrated power switch.

The electric loads 104 driven by the vehicle engine control system 100A include, for example, main apparatuses such as an ignition coil (in the case of a gasoline engine) and an intake valve opening degree control monitor and auxiliary apparatuses such as a heater for an exhaust-gas sensor, a power source relay for supplying electric power to a load, and an alarm/display apparatus. Input sensors 105 include, for example, opening/closing sensors such as a rotation sensor for detecting the rotation speed of an engine, a crank angle sensor for determining a fuel injection timing, and a vehicle speed sensor for detecting a vehicle speed, switch sensors such as an accelerator pedal switch, a brake pedal switch, and a shift switch that detects the shift lever position of a transmission, and analogue sensors, for performing driving control of an engine, such as an accelerator position sensor for detecting an accelerator pedal depression degree, a throttle position sensor for detecting an intake throttle valve opening degree, an air flow sensor for detecting an intake amount of an engine, an exhaust-gas sensor for detecting the oxygen concentration in an exhaust gas, and an engine coolant temperature sensor (in the case of a water-cooled engine).

With regard to the internal configuration of the vehicle engine control system 100A, the first voltage boosting circuit unit 110A1 and the second voltage boosting circuit unit 110A2 in a pair include a pair of induction devices 111*a* to be controlled by first and second voltage boosting control units 210A1 and 210A2 that include a pair of voltage boosting opening/closing devices 111*b*, described later, a pair of charging diodes 112*a*, and a pair of voltage boosting capacitors 112*b* that are connected in parallel with each other; the first voltage boosting circuit unit 110A1 and the second voltage boosting circuit unit 110A2 are cooperatively controlled by a synchronization state detection unit 220A, described later in FIG. 3. Each of the driving control circuit units 120X and 120Y in a pair, which is provided for each of the cylinder groups, includes an opened-valve holding opening/closing device 121*j* and a rapid magnetization opening/closing device 122*j*; the rapid magnetization opening/closing device 122*j* receives the boosted voltage Vh from the voltage boosting capacitor 112*b* and then supplies a rapid magnetization voltage to electromagnetic coils 31 and 34 or electromagnetic coils 32 and 33. The opened-valve holding opening/closing device 121*j*, which is connected with the electromagnetic coils 31 and 34 or the electromagnetic coils 32 and 33 by way of a reverse-flow prevention element 125*j*, receives the power-source voltage Vb from the vehicle battery 101 and then supplies a opened-valve holding voltage to the electromagnetic coils 31 and 34 or the electromagnetic coils 32 and 33.

Each of commutation circuit elements 126*j* is connected between the vehicle body ground circuit GND and the positive terminals of the electromagnetic coils 31 and 34 or the electromagnetic coils 32 and 33; each of conduction selection opening/closing devices 123*i* is connected between the vehicle body ground circuit GND and each of the negative terminals of the electromagnetic coils 31 through 34; each of recovery diodes 124*i* is connected between each of the negative terminals of the electromagnetic coils 31 through 34 and the positive terminal of the voltage boosting capacitor 112*b*. When while the conduction selection opening/closing device 123*i* is closed, the conduction of the opened-valve holding opening/closing device 121*j* is cut off, the exciting current flowing in any one of the electromagnetic coils 31 through 34 is commutated and attenuated by the commutation circuit element 126*j*; when the conduction selection opening/closing device 123*i* is opened, the exciting current flowing in any one of the electromagnetic coils 31 through 34 flows into the voltage boosting capacitor 112*b* by way of the recovery diode 124*i* and hence high-speed current cutoff is performed through recovery charging.

In response to a fuel injection command signal INJi, for each cylinder, that is sequentially generated by the microprocessor CPU, a gate control circuit 128 performs circuit-closing drive of any one of the conduction selection opening/closing devices 123*i* provided for respective cylinders and temporarily performs circuit-closing drive of the rapid magnetization opening/closing device 122*j* for the cylinder group to which the particular cylinder belongs; then, the gate control circuit 128 performs on/off-drive of the opened-valve holding opening/closing device 121*j*. When the fuel injection command signal INJi is stopped, both the conduction selection opening/closing device 123*i* and the opened-valve holding opening/closing device 121*j* are opened. The microprocessor CPU, which is the main element of the calculation control circuit unit 130A, collaborates with a nonvolatile program memory PGM, which is, for example, a flash memory, a RAM memory RMEM for performing calculation processing, and a multi-channel A/D converter LADC. A constant voltage power source 140, supplied with electric power from the vehicle battery 101 by way of the output contact 102 of the power supply relay, generates a stabilized control voltage Vcc of, for example, DC 5V and then supplies the stabilized control voltage Vcc to the microprocessor CPU.

Figure 2:
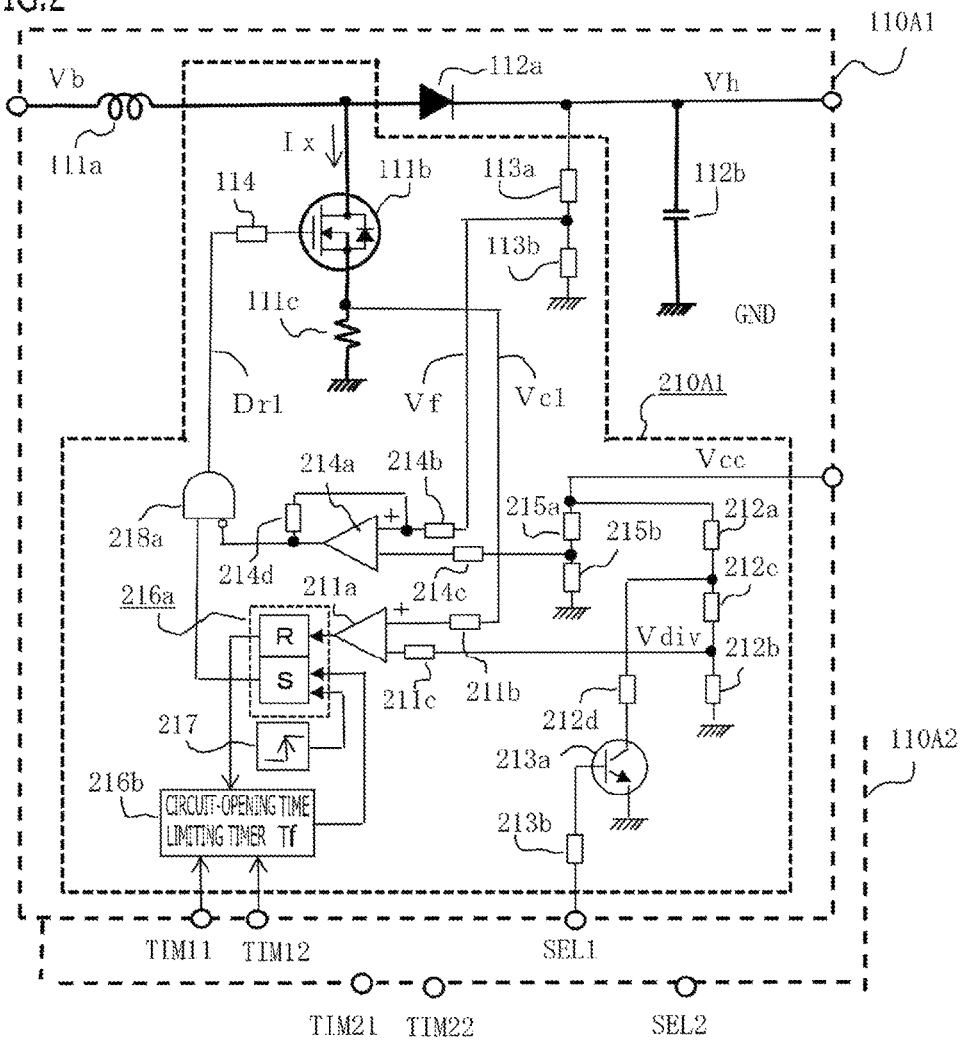
FIG. 2 is a detailed block diagram representing control of a voltage boosting circuit unit in the vehicle engine control system in FIG. 1.

In FIG. 2, each of the first voltage boosting circuit unit 110A1 and the second voltage boosting circuit unit 110A2 is provided with the induction device 111*a*, which is one of inductance devices in a pair, the charging diode 112*a*, which is one of charging diodes in a pair and is connected in series with the induction device 111*a*, and the voltage boosting capacitor 112*b*, which is one of voltage boosting capacitors in a pair, which is connected in parallel with the other one of the voltage boosting capacitors, and which is charged through the charging diode 112*a*. Because configured in the same manner as the first voltage boosting circuit unit 110A1, the second voltage boosting circuit unit 110A2 is not represented in detail in FIG. 2. The respective induction devices 111*a* in a pair are on/off-excited by a first voltage boosting control unit 210A1 and an unillustrated second voltage boosting control unit 210A2. In the first voltage boosting control unit 210A1 (or the second voltage boosting control unit 210A2), the voltage boosting opening/closing device 111*b* and a current detection resistor 111*c* are connected in series with each other, thereby configuring a power feeding circuit for the induction device 111*a*; the voltage across the current detection resistor 111*c* becomes a first current detection voltage Vc1 (or a second current detection voltage Vc2). Voltage boosting voltage dividing resistors 113*a* and 113*b* that divide the voltage across the voltage boosting capacitor 112*b* generate a charging monitoring voltage Vf; a first drive command signal Dr1 (or a second drive command signal Dr2) is provided to the voltage boosting opening/closing device 111*b* by way of a gate resistor 114.

The first current detection voltage Vc1 is applied to the positive terminal of a comparator forming a current comparison determination unit 211*a*, by way of a positive-side input resistor 211*b*; a divided voltage Vdiv, of the control voltage Vcc, that is obtained through voltage dividing resistors 212*a*, 212*c*, and 212*b* is applied to the negative terminal thereof, by way of a negative-side input resistor 211*c*. A post-stage parallel resistor 212*d* is connected in parallel with the middle voltage dividing resistor 212*c* and the lower voltage dividing resistor 212*b* through a selective opening/closing device 213*a*; a setting current selection signal SEL1 (or a setting current selection signal SEL2) is applied to the selective opening/closing device 213*a* by way of a selective driving resistor 213*b*. The charging monitoring voltage Vf is applied to the positive terminal of a comparator forming a voltage boosting comparison determination unit 214*a*, by way of a positive-side input resistor 214*b*; a divided voltage, of the control voltage Vcc, that is obtained through voltage boosting comparison voltage dividing resistors 215*a* and 215*b* is applied to the negative terminal thereof, by way of a negative-side input resistor 214*c*. A positive feedback resistor 214*d* is connected between the output terminal and the positive-side input terminal of the comparator 214*a*; when the charging monitoring voltage Vf exceeds the divided voltage obtained through the voltage boosting comparison voltage dividing resistors 215*a* and 215*b* and hence the output logic of the comparator 214*a* once becomes "H" level, the operation state of the comparator 214*a* is maintained even when the charging monitoring voltage Vf falls, for example, approximately 5%. When the charging monitoring voltage Vf further falls, the output logic of the comparator 214*a* returns to "L" level.

A circuit-closing command storage circuit 216*a* is set by a starting pulse generated by a power source start detection circuit 217; a setting output signal of the circuit-closing command storage circuit 216*a* performs circuit-closing drive of the voltage boosting opening/closing device 111*b* byway of a circuit-closing prohibition gate 218*a* and the gate resistor 114; when the charging monitoring voltage Vf is the same as or larger than a predetermined value, the output logic of the comparator forming the voltage boosting comparison determination unit 214*a* becomes "H" level; then, the circuit-closing prohibition gate 218*a* stops the first drive command signal Dr1, for the voltage boosting opening/closing device 111*b*, that has been produced by the circuit-closing command storage circuit 216*a*. However, when the boosted voltage Vh falls and hence the output logic of the comparator 214*a* becomes "L", the first drive command signal Dr1 becomes effective and circuit-closing drive is applied to the voltage boosting opening/closing device 111*b*. As a result, when the first current detection voltage Vc1 rises and exceeds the divided voltage Vdiv obtained through the voltage dividing resistors 212*a*, 212*c*, and 212*b*, the circuit-closing command storage circuit 216*a* is reset; the first drive command signal Dr1 is stopped; the voltage boosting opening/closing device 111*b* is opened; then, the exciting current Ix flowing in the induction device 111*a* becomes a charging current for the voltage boosting capacitor 112*b* and starts to be attenuated.

However, because this attenuated current does not flow in the current detection resistor 111*c*, the attenuated state thereof cannot be detected; when as the circuit-closing command storage circuit 216*a* is reset, a circuit-opening time limiting timer 216*b* is started; then, after a predetermined 1st circuit-opening limit time t1 elapses, the time-up output thereof resets the circuit-closing command storage circuit 216*a* and hence the circuit-closing drive is applied again to the voltage boosting opening/closing device 111*b*. By use of an unillustrated serial signal line, the microprocessor CPU preliminarily transmits the values of the 1st circuit-opening limit time t1 and the 2nd circuit-opening limit time t2 to the circuit-opening time limiting timer 216*b* provided in the first voltage boosting control unit 210A1; when the logic level of a circuit-opening time limit time selection signal TIM11 to be inputted to the circuit-opening time limiting timer 216*b* becomes "H", the 1st circuit-opening limit time t1 is selected; when the logic level of a circuit-opening time limit time selection signal TIM12 to be inputted to the circuit-opening time limiting timer 216*b* becomes "H", the 2nd circuit-opening limit time t2 is selected. When after the voltage boosting opening/closing device 111*b* is closed again, the circuit-closing command storage circuit 216*a* is reset in due course of time, the circuit-opening time limiting timer 216*b* is started again and the foregoing operation is repeated. In the following explanation, number expressed by alphabet of the first or the second, for example, as the first and second drive command signal Dr1 and Dr2, is applied to the name corresponding to the first voltage boosting circuit unit 110A1 or the second voltage boosting circuit unit 110A2, as the case may be; number expressed by Arabic numerals of the 1st or the 2nd, for example, as the 1st and 2nd circuit-opening limit time t1 and t2, is applied to a plurality of names related to either the first drive command signal Dr1 or the second drive command signal Dr2.

Thus, in the case where it is required to utilize the first voltage boosting circuit unit 110A1 in a 1st driving mode for small-current high-frequency opening/closing operation, the logic level of the setting current selection signal SEL1 is set to "H", thereby closing the selective opening/closing device 213*a*, so that the divided voltage obtained through the voltage dividing resistors 212*a*, 212*c*, and 212*b* and the post-stage parallel resistor 212*d* is decreased; as a result, a 1st setting current I1 is set and the logic level of the circuit-opening time limit time selection signal TIM11 is set to "H", so that the 1st circuit-opening limit time t1 is selected. In the case where it is required to utilize the first voltage boosting circuit unit 110A1 in a 2nd driving mode for large-current low-frequency opening/closing operation, the logic level of the setting current selection signal SEL1 is set to "L", thereby opening the selective opening/closing device 213*a*, so that the divided voltage obtained through the voltage dividing resistors 212*a*, 212*c*, and 212*b* and the post-stage parallel resistor 212*d* is increased; as a result, a 2nd setting current I2 is set and the logic level of the circuit-opening time limit time selection signal TIM12 is set to "H", so that the 2nd circuit-opening limit time t2 is selected.

Methods similar to the foregoing methods can be applied to the second voltage boosting circuit unit 110A2; in the case where it is required to utilize the second voltage boosting circuit unit 110A2 in the 1st driving mode for small-current high-frequency opening/closing operation, the logic level of the setting current selection signal SEL2 is set to "H", thereby closing the selective opening/closing device 213*a*, so that the divided voltage obtained through the voltage dividing resistors 212*a*, 212*c*, and 212*b* and the post-stage parallel resistor 212*d* is decreased; as a result, the 1st setting current I1 is set and the logic level of a circuit-opening time limit time selection signal TIM21 is set to "H", so that the 1st circuit-opening limit time t1 is selected. In the case where it is required to utilize the second voltage boosting circuit unit 110A2 in the 2nd driving mode for large-current low-frequency opening/closing operation, the logic level of the setting current selection signal SEL2 is set to "L", thereby opening the selective opening/closing device 213*a*, so that the divided voltage obtained through the voltage dividing resistors 212*a*, 212*c*, and 212*b* and the post-stage parallel resistor 212*d* is increased; as a result, the 2nd setting current I2 is set and the logic level of a circuit-opening time limit time selection signal TIM22 is set to "H", so that the 2nd circuit-opening limit time t2 is selected.

Next, with reference to FIG. 3, which is a detailed block diagram representing control by the synchronization state detection unit 220A in the vehicle engine control system in FIG. 1, the configuration thereof will be explained in detail. In FIG. 3, the power-source voltage Vb, the control voltage Vcc, the first current detection voltage Vc1 generated in the first voltage boosting control unit 210A1, the second current detection voltage Vc2 generated in the second voltage boosting control unit 210A2, a setting signal for a monitoring period SETx to be transmitted from the microprocessor CPU are inputted to the synchronization state detection unit 220A; the synchronization state detection unit 220A transmits a selection command signal SELx to the microprocessor CPU; a power-source voltage monitoring voltage Vba obtained by dividing the power-source voltage Vb by voltage dividing resistors 229*a* and 229*b* is transmitted to the microprocessor CPU by way of the multi-channel A/D converter LADC in the calculation control circuit unit 130A. The positive-side input terminal of an addition processing unit 221*a*, which is an operational amplifier, is connected with the vehicle body ground circuit GND; the first current detection voltage Vc1 is applied to the negative-side terminal thereof by way of a 1st input resistor 221*b*; the second current detection voltage Vc2 is applied to the negative-side terminal thereof by way of a 2nd input resistor 221*c*; the output voltage of the addition processing unit 221*a* is applied to the negative-side terminal thereof by way of a negative feedback resistor 221*d*. As a result, letting Rin denote the resistance value of each of the 1st input resistor 221*b* and the 2nd input resistor 221*c* and letting Rout denote the resistance value of the negative feedback resistor 221*d*, an addition output voltage Vout of the addition processing unit 221*a* is given by the equation (14).

$$Vout=G\times(Vc1+Vc2) \quad (14)$$

where the amplification factor G=Rout/Rin»1.

The addition output voltage Vout is inputted to the negative-side terminal of a comparator (222A) forming a synchronization timing detection unit 222A; an addition value determination threshold value voltage 225*a* is applied to the positive-side terminal thereof. The value of the addition value determination threshold value voltage 225*a* is smaller than the maximum value of the addition output voltage Vout and is set, for example, to a value that is the same as or larger than 70% of the maximum value of the addition output voltage Vout. Accordingly, when the addition output voltage Vout exceeds the threshold value voltage 225*a*, the output logic of the comparator (222A) becomes "L"; then, the output logic "L" is outputted as an in-synchronization detection pulse PLS0. A driving transistor 222*c*, to which circuit-closing drive is applied byway of a base resistor 222*b* when the in-synchronization detection pulse PLS0 is generated, applies the power-source voltage Vb to a series circuit consisting of an integration resistor 222*d* and an integration capacitor 223*c*. An opening-circuit stabilizing resistor 222*e* is connected between the emitter and base terminals of the driving transistor 222*c*, which is a PNP-type transistor, and stably opens the driving transistor 222*c* when the output logic of the comparator (222A) is "H".

Because the generating period of the in-synchronization detection pulse PLS0 in the present Embodiment has a nature of reducing in inverse proportion to the power-source voltage Vb, the fluctuation thereof is compensated by charging the integration capacitor 223*c* with the power-source voltage VB so that the charging voltage across the integration capacitor 223*c* is stabilized while a single in-synchronization detection pulse PLS0 is generated. A periodic reset processing unit 223A periodically performs circuit-closing drive of a discharging transistor 223*b* so as to discharge electric charges charged on the integration capacitor 223*c*, which is connected in parallel with the discharging transistor 223*b*. The periodic reset processing unit 223A is formed of a clock counter 226*c* that counts the number of occurrence instances of a time counting clock signal 226*t*; a time-up setting value N, preliminarily transmitted from the microprocessor CPU, is stored in a setting value register of the clock counter 226*c*. The periodic reset processing unit 223A forms a ring counter that generates a time-up output so as to perform circuit-closing drive of the discharging transistor 223*b*, when the present counting value of the time counting clock signal 226*t* reaches the setting value N, and that resets its own present counting value and restarts the counting operation, when the logic of the clock signal reverses.

The voltage across the integration capacitor 223*c* is applied to the positive-side input terminal of a post-stage comparator (224*a*), which functions as a synchronization timing integration processing unit 224*a*, and an integration value determination threshold voltage 225*b* is applied to the negative-side input terminal thereof; the integration value determination threshold voltage 225*b* is set to a value corresponding to a charging voltage across the integration capacitor 223*c* at a time when a predetermined plural number of in-synchronization detection pulses PLS0 occur, for example, within a predetermined monitoring period SETx from the timing when the discharging transistor 223*b* has been closed to the timing when the discharging transistor 223*b* is closed next time. Specifically, the monitoring period SETx of the periodic reset processing unit 223A is set to a standard necessary time, for example, at a time when the first drive command signal Dr1 or the second drive command signal Dr2 occurs five times; when the in-synchronization detection pulse PLS0 occurs thrice or more times within the monitoring period SETx, the output logic of the post-stage comparator (224*a*) becomes "H" and there is generated the selection command signal SELx, which is stored in a selection command occurrence storage unit 228A.

When the power is turned on, the selection command occurrence storage unit 228A is preliminarily reset by the power source start detection circuit 224*b*. The standard monitoring period SETx (the necessary time) is the one at a time when the inductance of the induction device 111*a* is the average value in the individual unevenness thereof and the power-source voltage Vb is, for example, DC 14 V. However, because the actual monitoring period SETx (the necessary time) changes in inverse proportion to the power-source voltage Vb, the microprocessor CPU corrects the counting setting value N in such a way the monitoring period SETx (the necessary time) corresponds to the present power-source voltage, then transmits the corrected counting setting value N, as the setting signal for the monitoring period SETx, to the periodic reset processing unit 223A.

(2) Detailed Description of Operation and Action

Hereinafter, the operation and action of the vehicle engine control system 100A, configured as described with reference to FIGS. 1 through 3, according to Embodiment 1 will be explained in detail, based on FIGS. 4A and 4B, which are current waveform charts in the 1st driving mode and the 2nd driving mode, respectively, FIG. 5A, 5B, 5C, 5D which are timing charts for explaining the in-synchronization detection pulse PLS0, and FIG. 6, which is a flowchart for explaining the driving mode selection operation. At first, in FIG. 1, when the unillustrated power switch is closed, the output contact 102 of the power supply relay is closed, so that the power-source voltage Vb is applied to the vehicle engine control system 100A. As a result, the constant voltage power source circuit 140 generates a stabilized control voltage Vcc, which is, for example, DC 5V, and then the microprocessor CPU starts its control operation. The microprocessor CPU generates a load-driving command signal for the electric load group 104, in response to the operation state of the input sensor group 105 and the contents of a control program stored in the non-volatile program memory PGM, and generates the fuel injection command signal INJi for the fuel-injection electromagnetic valve 103, which is a specific electric load in the electric load group 104, so as to drive the electromagnetic coils 31 through 34 by way of the driving control circuit units 120X and 120Y. Before that, the first and second voltage boosting circuit units 110A1 and 110A2 operate, so that the voltage boosting capacitor 112*b* is charged with a high voltage.

FIG. 4A represents the waveform of the exciting current Ix for the induction device 111*a* at a time when the logic level of the setting current selection signal SEL1 in the first voltage boosting circuit unit 110A1 is set to "H" so that the 1st setting current I1 is set, when the logic level of the circuit-opening time limit time selection signal TIM11 is set to "H" so that the 1st circuit-opening limit time t1 is set, and when the 1st driving mode for small-current high-frequency on/off operation is selected. In this situation, the equations (15a) through (17a) are established in the relationship between a 1st circuit-closing time T1, of the voltage boosting opening/closing device 111*b*, that is required to raise the exciting current Ix from a 1st attenuated current I01 to the 1st setting current I1, and the 1st circuit-opening limit time t1, which is the circuit-opening time, of the voltage boosting opening/closing device 111*b*, that is required to attenuate the exciting current Ix from the 1st setting current I1 to the 1st attenuated current I01. In the equations (15a) through (17a), Vb, R, L, τ (=L/R), T01 (=T1+t1), Vc, and K denote the power-source voltage, the resistance value of the induction device 111*a*, the inductance of the induction device 111*a*, the time constant of the induction device 111*a*, a 1st on/off period, the charging voltage of the voltage boosting capacitor 112*b*, and the voltage boosting rate, respectively.

$$L\times(I1-I01)/T1\approx Vb \text{ where } I1\times R\gg Vb.$$

$$\therefore T1\approx(I1-I01)\times L/Vb \tag{15a}$$

$$L\times(I1-I01)/t1\approx Vc-Vb$$

$$\therefore t1\approx(I1-I01)\times L/(Vc-Vb)=T1/K \tag{16a}$$

$$\therefore T01\approx(I1-I01)\times L/Vb\times(1+1/K) \tag{17a}$$

The equation (15a) suggests that the current rising rate (I1−I01)/T1 is proportional to the power-source voltage Vb and the proportionality coefficient thereof is the inductance L. Similarly, the equation (16a) suggests that the current attenuation rate (I1−I01)/t1 is proportional to the reversed power-source voltage (Vc−Vb) and the proportionality coefficient thereof is the inductance L. However, due to the action of the charging diode 112*a*, the attenuated current (i.e., the charging current for the voltage boosting capacitor 112*b*) does not become a negative value. In contrast, letting E1 and W1 denote the electromagnetic energy accumulated in the induction device 111*a* due to a single on/off operational action of the voltage boosting opening/closing device 111*b* and the charging power obtained by dividing the electromagnetic energy E1 by the 1st on/off period T01, respectively, the equations (18a) and (19a) are established.

$$E1=L\times(I1^2-I01^2)/2 \tag{18a}$$

$$W1=E1/T01=0.5\times(I1+I01)\times Vb\times K/(1+K) \tag{19a}$$

Accordingly, even when the inductance L of the induction device 111*a* changes due to the individual unevenness, the charging power W1 is a constant value.

FIG. 4B represents the waveform of the exciting current Ix for the induction device 111*a* at a time when the logic level of the setting current selection signal SEL2 in the second voltage boosting circuit unit 110A2 is set to "L" so that the 2nd setting current I2 is set, when the logic level of the circuit-opening time limit time selection signal TIM22 is set to "H" so that the 2nd circuit-opening limit time t2 is set, and when the 2nd driving mode for large-current low-frequency on/off operation is selected. In this situation, as is the case with FIG. 4A, the equations (15b) through (17b) are established in the relationship between a 2nd circuit-closing time T2, of the voltage boosting opening/closing device 111*b*, that is required to raise the exciting current Ix from a 2nd attenuated current I02 to the 2nd setting current I2, and the 2nd circuit-opening limit time t2, which is the circuit-opening time, of the voltage boosting opening/closing device 111*b*, that is required to attenuate the exciting current Ix from the 2nd setting current I2 to the 2nd attenuated current I02.

$$\therefore T2\approx(I2-I02)\times L/Vb \tag{15b}$$

$$\therefore t2\approx(I2-I02)\times L/(Vc-Vb)=T2/K \tag{16b}$$

$$\therefore T02\approx(I2-I02)\times L/Vb\times(1+1/K) \tag{17b}$$

Also in this case, letting E2 and W2 denote the electromagnetic energy accumulated in the induction device 111*a* due to a single on/off operational action of the voltage boosting opening/closing device 111*b* and the charging power obtained by dividing the electromagnetic energy E2 by the 2nd on/off period T02, respectively, the relationship between E2 and W2 is given by the equations (18b) and (19b).

$$E2=L\times(I2^2-I02^2)/2 \tag{18b}$$

$$W2=E2/T02=0.5\times(I2+I02)\times Vb\times K/(1+K) \tag{19b}$$

Thus, when the relationship "I1+I01=I2+I02" is established, the charging power W1 of the first voltage boosting circuit unit 110A1 whose driving mode is set to the 1st driving mode and the charging power W2 of the second voltage boosting circuit unit 110A2 whose driving mode is set to the 2nd driving mode are equal to each other. The value of the voltage boosting rate K is, for example, 3.57 (=(64−14)/14), and hence the equation "K/(1+K)=0.78" is established. In this situation, letting L1 and L2 denote the inductance of the induction device 111*a* in the first voltage boosting circuit unit 110A1 and the inductance of the induction device 111*a* in the second voltage boosting circuit unit 110A2, respectively, the proportion of the on/off period is given by the equation (20) obtained from the equations (17a) and (17b).

$$T02/T01=[(I2-I02)/(I1-I01)]\times(L2/L1) \tag{20}$$

Figures 5A, 5B, 5C, 5D:
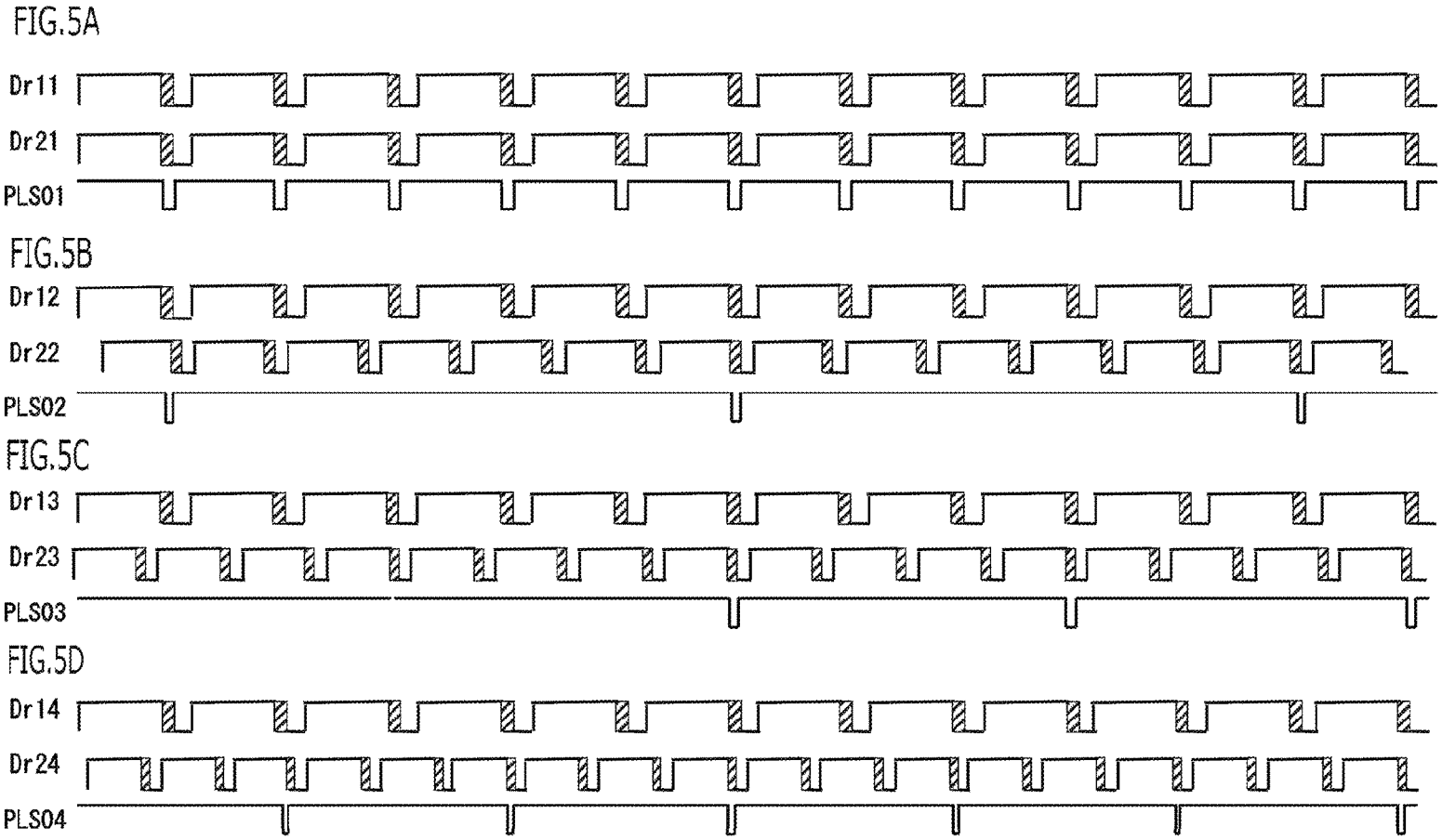
FIG. 5A, 5B, 5C, 5D are a timing chart for explaining an in-synchronization detection pulse (a pulse generated during synchronization) in the vehicle engine control system in FIG. 1.

In FIG. 5A, the three timing charts in the top-stage group represent the opening/closing operation state of the first drive command signal Dr11 of the first voltage boosting circuit unit 110A1, the opening/closing operation state of the second drive command signal Dr21 of the second voltage boosting circuit unit 110A2, and the occurrence state of the in-synchronization detection pulse PLS01, respectively, at a time when both the first and second voltage boosting circuit units 110A1 and 110A2 are operated in the 2nd driving mode for large-current low-frequency on/off operation and when the respective inductances L of both the induction devices 111*a* coincide with each other. In this case, the respective voltage boosting opening/closing devices 111*b* are in synchronization with each other and perform on/off operation in a period of, for example, 40 μs; in a hatched region that is immediately before the region where the circuit-opening operation is performed, the addition value of the exciting currents Ix for the induction devices 111*a* in a pair exceeds the addition value determination threshold value voltage 225*a* in FIG. 3; as a result, the in-synchronization detection pulse PLS01 is generated in response to every on/off operation of the voltage boosting opening/closing device 111*b*. In addition, in this case, when the respective inductances L are even slightly different from each other, generation of the in-synchronization detection pulse PLS01 is stopped in due course of time, although generated for a while after the on/off operation is started; then, there occurs a long-period recurrent operation state in which the state where the in-synchronization detection pulse PLS01 is not generated continues for a long time and then the in-synchronization detection pulse PLS01 is generated again and in which this state sequentially occurs.

In FIG. 5B, the three timing charts in the upper middle-stage group represent the opening/closing operation state of the first drive command signal Dr12 of the first voltage boosting circuit unit 110A1, the opening/closing operation state of the second drive command signal Dr22 of the second voltage boosting circuit unit 110A2, and the occurrence state of the in-synchronization detection pulse PLS02, respectively, at a time when both the first and second voltage boosting circuit units 110A1 and 110A2 are operated in the 2nd driving mode for large-current low-frequency on/off operation and when the respective inductances L of both the induction devices 111*a* are different from each other. In this case, while the first drive command signal Dr12 performs on/off operation in a period of, for example, 40 μs, the second drive command signal Dr22 performs on/off operation in a period of, for example, 35 μs. In addition, in this case, the in-synchronization detection pulse PLS02 occurs once every 5 periods of the first drive command signal Dr12. In FIG. 5C, in the three timing charts in the lower middle-stage group, while the first drive command signal Dr13 performs on/off operation in a period of, for example, 40 μs, the second drive command signal Dr23 performs on/off operation in a period of, for example, 30 μs; in this case, the in-synchronization detection pulse PLS03 occurs every 3 periods of the first drive command signal Dr13.

In FIG. 5D, in the three timing charts in the bottom-stage group, while the first drive command signal Dr14 performs on/off operation in a period of, for example, 40 μs, the second drive command signal Dr24 performs on/off operation in a period of, for example, 25 μs; in this case, the in-synchronization detection pulse PLS04 occurs every 2 periods of the first drive command signal Dr14. As is clear from the foregoing explanation, when the respective on/off periods of the driving command signals in a pair are approximately equal to each other, there alternately occur a continuous synchronization section where the in-synchronization detection pulse PLS0 continuously occurs in conjunction with one of the driving command signals and an asynchronous section where the in-synchronization detection pulse PLS0 does not occur over a long period. However, when the respective on/off periods of the driving command signals in a pair are largely different from each other, there occurs a frequent occurrence state where the occurrence interval of the in-synchronization detection pulse PLS0 is short, although the continuous synchronization section does not occur.

For example, in the case of FIG. 5D, the in-synchronization detection pulse PLS04 occurs thrice every 5 periods of the first drive command signal Dr14; however, in the case of FIG. 5B, the in-synchronization detection pulse PLS02 occurs once every 5 periods of the first drive command signal Dr12. The synchronization state detection unit 220A represented in FIG. 3 selects the respective driving modes of the first voltage boosting circuit unit 110A1 and the second voltage boosting circuit unit 110A2 in such a way as to generate the selection command signal SELx in the state represented in FIG. 5A or 5D and in such a way as to not generate the selection command signal SELx in the state represented in FIG. 5B or 5C so that in-synchronization detection pulse PLS0 does not occur consecutively. In the case where the individual unevenness of the inductance of the induction device 111*a* is ±15%, it is appropriate that the approaching status of the inductances, to be detected by the synchronization state detection unit 220A, is approximately ±5%.

However, because the synchronization state detection unit 220A does not distinguish one of the induction devices 111*a* from the other one based on the inductances thereof, the on/off-period variation between the 1st driving mode and the 2nd driving mode is set to approximately ±10%; as the worst combination, the on/off period that is obtained by setting the on/off period of the −5%-inductance (short-on/off-period) induction device to +10% becomes +5%, and the on/off period that is obtained by setting the on/off period of the +5%-inductance (long-on/off-period) induction device to −10% becomes −5%; therefore, the on/off-period difference of at least ±5% can be secured. In contrast, the on/off period that is obtained by setting the on/off period of the −5%-inductance (short-on/off-period) induction device to −10% becomes −15%, and the on/off period that is obtained by setting the on/off period of the +5%-inductance (long-on/off-period) induction device to +10% becomes +15%; therefore, in the worst case, an on/off-period difference of ±15% occurs. This difference coincides with the difference at a time when the inductance difference is ±15% and the voltage boosting circuit units are utilized in one and the same mode.

Figure 6:
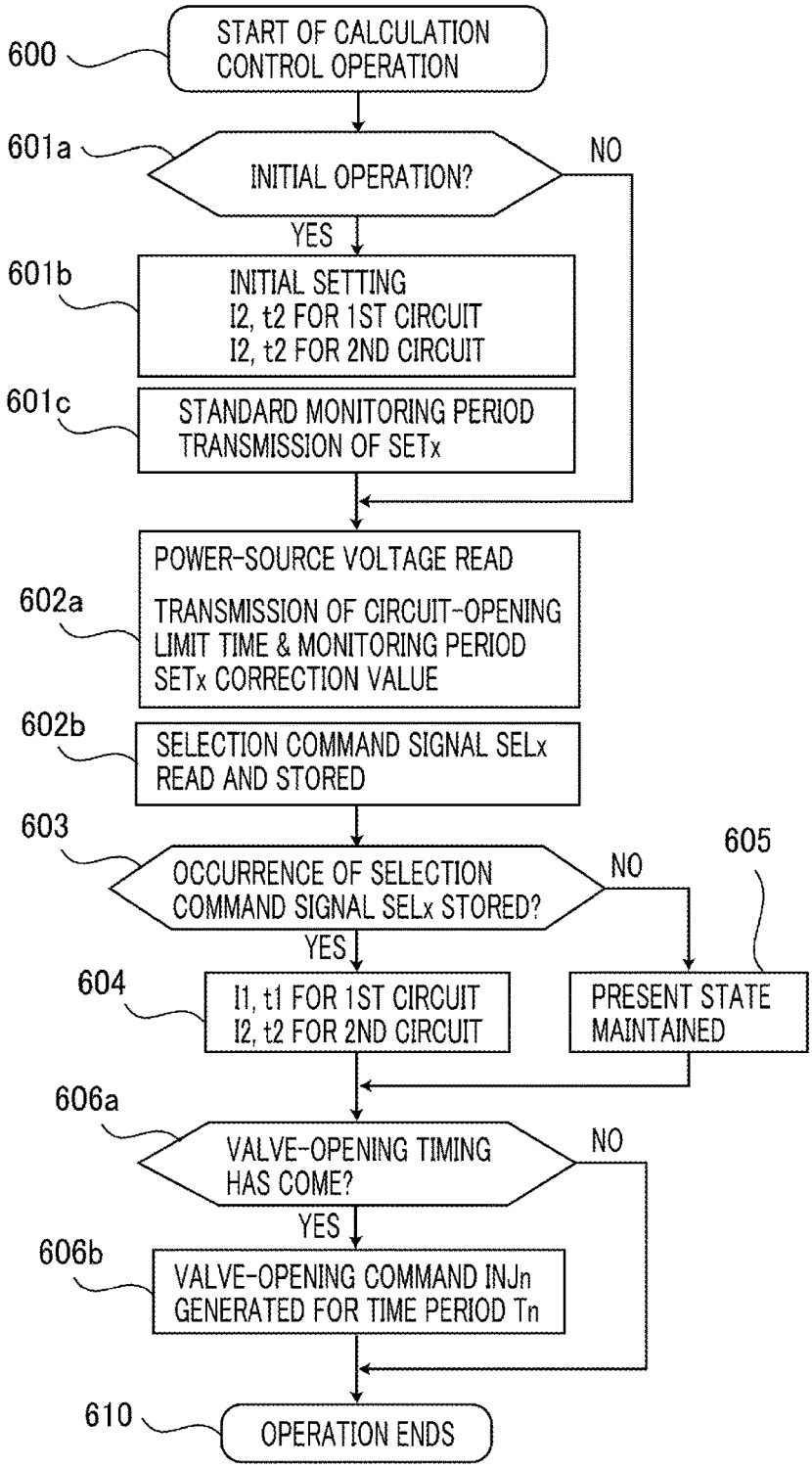
FIG. 6 is a flowchart for explaining driving mode selection operation of the vehicle engine control system in FIG. 1.

In FIG. 6 that is a flowchart for explaining the driving mode selection operation of the vehicle engine control system in FIG. 1, the process 600 is a step where the microprocessor CPU starts its operation; the microprocessor CPU recurrently implements the flow from the operation starting process 600 to the operation ending process 610. The process 601*a* is a determination step in which it is determined whether or not the present control operation is initial control operation after the power is turned on, in which in the case where the present control operation is initial control operation, the result of the determination becomes "YES", and then, the process 601*a* is followed by the process 601*b*, and in which in the case where the present control operation is not initial control operation, the result of the determination becomes "NO", and then the process 601*a* is followed by the process 602*a*. The process 601*b* is a step functioning as an initial setting unit, in which the logic level of the setting current selection signal SEL1 in the first voltage boosting control unit 210A1 is set to "L" and the logic level of the circuit-opening time limit time selection signal TIM12 is set to "H" so that the 2nd driving mode for large-current low-frequency on/off operation is set and in which the logic level of the setting current selection signal SEL2 in the second voltage boosting control unit 210A2 is set to "L" and the logic level of the circuit-opening time limit time selection signal TIM22 is set to "H" so that the 2nd driving mode for large-current low-frequency on/off operation is set.

The process 601*c* is an initial setting step in which for example, the power-source voltage Vb is the reference voltage of DC 14V and the inductance L of the induction device 111*a* is the average value of individual-unevenness variation values thereof and in which the monitoring period SETx with which the time that is five times as long as the signal period of the first drive command signal Dr1 or the second drive command signal Dr2 can be obtained is transmitted so that the clock counter 226*c* of the periodic reset processing unit 223A is set; the process 601*c* is followed by the process 602*a*. The process 602*a* is a step, which functions as a voltage correction means, in which the present power-source voltage Vb is read with reference to the power-source voltage monitoring voltage Vba and then the monitoring period SETx that has been initially set in the process 601*c* is corrected to a value that is in inverse proportion to the power-source voltage Vb. As is the case with the circuit-opening time limiting timer 216*b*, the current attenuation characteristic of the induction device 111*a* at a time when the voltage boosting opening/closing device 111*b* is opened is determined by the difference value between the charging voltage Vc, across the voltage boosting capacitor 112*b*, that is a stable high voltage and the variable power-source voltage Vb; therefore, because the effect of a change in the power-source voltage Vb is reduced, the voltage correction, of the 1st circuit-opening limit time t1 or the 2nd circuit-opening limit time t2, that is set by the circuit-opening time limiting timer 216*b* may be omitted.

The process 602*b* is a step in which whether or not the selection command occurrence storage unit 228A has stored occurrence of the selection command signal SELx is read and which is then followed by the process 603. The process 603 is a determination step in which in the case where the selection command signal SELx has occurred, the result of the determination becomes "YES" and which is then followed by the process 604. The process 603 is also a determination step in which in the case where the selection command signal SELx has not occurred, the result of the determination becomes "NO" and which is then followed by the process 605. The process 604 is a step functioning as an alteration setting unit, in which the logic level of the setting current selection signal SEL1 in the first voltage boosting control unit 210A1 is set to "H" and the logic level of the circuit-opening time limit time selection signal TIM11 is set to "H" so that the 1st driving mode for small-current high-frequency on/off operation is set, and in which with regard to the second voltage boosting control unit 210A2, the logic level of the setting current selection signal SEL2 is set to "L" and the logic level of the circuit-opening time limit time selection signal TIM22 is set to "H", as the present condition, so that the 2nd driving mode for large-current low-frequency on/off operation is set and which is then followed by the process 606*a*. The process 605 is a step in which the driving mode that has been set in the process 601*b* or 604 is maintained and which is then followed by the process 606*a*. The process 606*a* is a determination step in which it is determined whether or not the valve opening timing for the fuel-injection electromagnetic valve 103 has come and in the case where the valve opening timing has come, the result of the determination becomes "YES" and which is then followed by the process 606*b*. The process 606*a* is also a determination step in which it is determined whether or not the valve opening timing for the fuel-injection electromagnetic valve 103 has come and in the case where the valve opening timing has not come, the result of the determination becomes "NO" and which is then followed by the operation ending process 610. The process 606*b* is a step in which it is determined which ones of the electromagnetic coils 31 through 34 are energized and then a valve-opening command signal INJn is generated within a predetermined valve opening period Tn; then, the process 606*b* is followed by the operation ending process 610.

As is clear from the foregoing explanation, in Embodiment 1, the role, related to voltage boosting control, of the microprocessor CPU is to manage setting values for the circuit-opening time limiting timer 216*b* and the clock counter 226*c*, to generate the setting current selection signals SEL1 and SEL2 by use of the selection command signal SELx obtained from the synchronization state detection unit 220A formed of hardware, and to generate the circuit-opening time limit time selection signals TIM11, TIM12, TIM21, and TIM22 so as to implement switching of the driving modes. In the foregoing explanation, when the selection command signal SELx is generated, the driving mode of the first voltage boosting circuit unit 110A1 is always switched from the 2nd driving mode to the 1st driving mode and the second voltage boosting circuit unit 110A2 is operated while being maintained in the 2nd driving mode; however, it may be allowed that these conditions are periodically exchanged, i.e., the driving mode of the first voltage boosting circuit unit 110A1 is returned to the 2nd driving mode and the driving mode of the second voltage boosting circuit unit 110A2 is switched from the 2nd driving mode to the 1st driving mode; as a result, the temperature rises in the first voltage boosting circuit unit 110A1 and the second voltage boosting circuit unit 110A2 can be equalized.

In the foregoing explanation, each of the values of the 1st circuit-opening limit time t1 and the 2nd circuit-opening limit time t2 is set to a time that is shorter than the time in which the exciting current Ix flowing in the induction device 111*a* is discharged into the voltage boosting capacitor 112*b* and the attenuated current becomes zero; however, it is also made possible to make setting in which the circuit-opening time of the voltage boosting opening/closing device 111*b* is lengthened so as to include the current-zero period. In that case, the conditions for making the charging power W1 at a time when operation is performed in the 1st driving mode with the 1st setting current I1, the 1st circuit-closing time T1, and the 1st circuit-opening limit time t1 (≈T1/K) coincide with the charging power W2 at a time when operation is performed in the 2nd driving mode with the 2nd setting current I2, the 2nd circuit-closing time T2, and the 2nd circuit-opening limit time t2 (>T2/K) are calculated by use of the equations (21a) through (23a) and the equations (21b) through (23b). In this regard, however, the voltage boosting rate K=(Vc−Vb)/Vb; for example, K=(64−14)/14=3.57.

$$T1=I1\times L/Vb \tag{21a}$$

$$E1=L\times I1^2/2 \tag{22a}$$

$$W1=E1/(T1+t1) \tag{23a}$$

$$T2=I2\times L/Vb \tag{21b}$$

$$E2=L\times I2^2/2 \tag{22b}$$

$$W2=E2/(T2+t2) \tag{23b}$$

In this situation, when it is assumed that the rate γ=I2/I1, T2/T1=γ and E2/E1=$\gamma^2$. Accordingly, in order to establish the equation "W2/W1=1", it is required that the equation (24) is established.

$$\begin{aligned} W2/W1 &= (E2/E1)\times(T1+t1)/(T2+t2) \\ &= \gamma^2\times(T1+t1)/(\gamma\times T1+t2) \\ &= 1 \\ \therefore t2 &= \gamma\times T1(\gamma-1)+\gamma^2\times t1 \end{aligned} \tag{24}$$

In the case where the 1st circuit-opening limit time t1 is set to be equal to a time that is required for the current flowing in the induction device 111*a* to be attenuated to zero, the equation "t1=T1/K" is established; therefore, the equation (24) at a time when K=3.57 is simplified as represented by the equation (25).

$$t2/t1=(4.57\times\gamma-3.57)\times\gamma \tag{25}$$

(3) Detailed Description of Variant Embodiment 1

Figure 7:
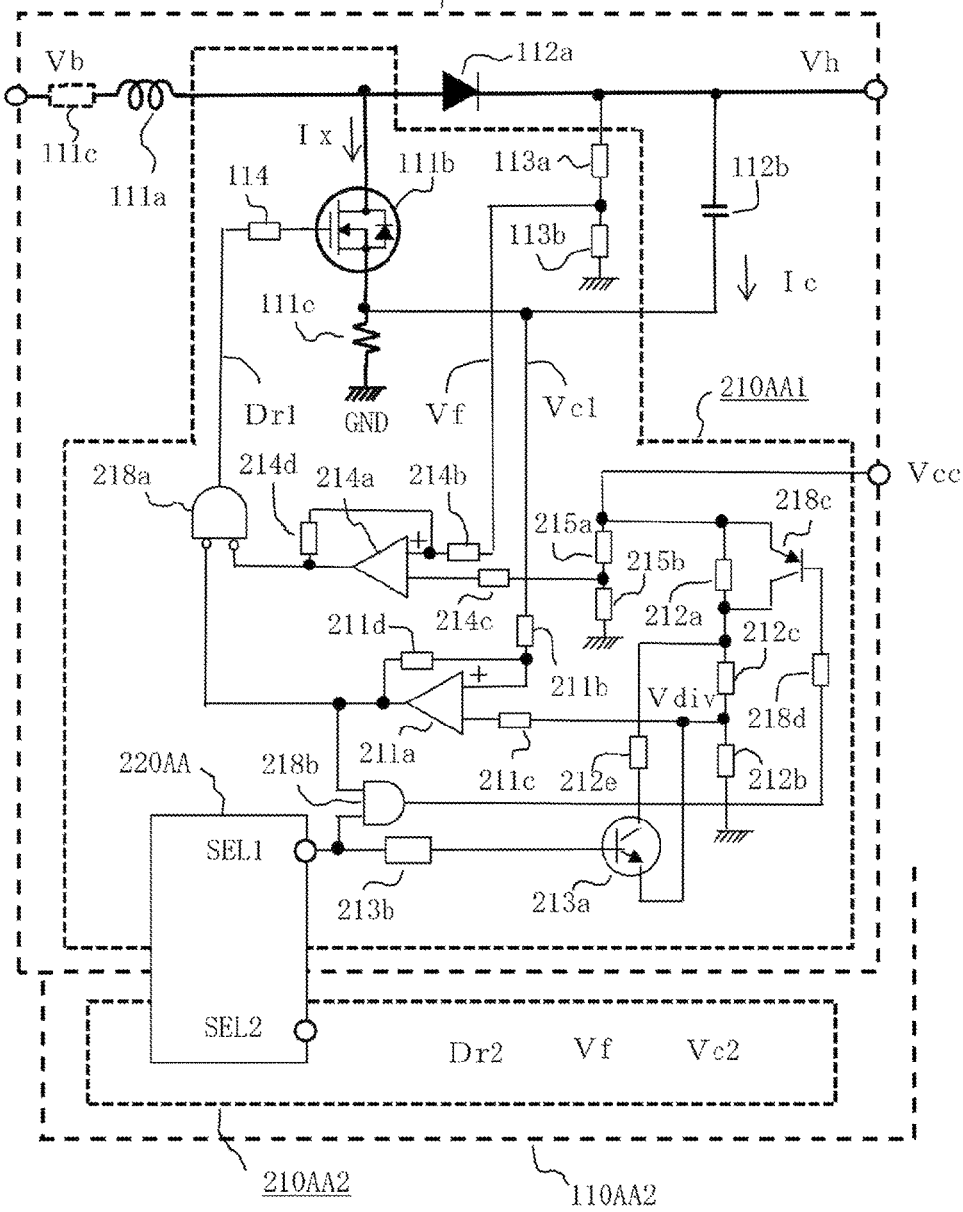
FIG. 7, replacing

Next, with regard to a vehicle engine control system according to an Embodiment, which is a partial variant of Embodiment 1 of the present invention, FIG. 7, replacing FIG. 2, that is a detailed block diagram representing control of a voltage boosting circuit unit according to a variant embodiment and FIG. 8, replacing FIG. 3, that is a detailed block diagram representing control by a synchronization state detection unit according to the variant embodiment will be explained in detail, mainly in terms of the respective differences from FIG. 2 and FIG. 3, respectively. In FIG. 7, the first voltage boosting circuit unit 110AA1, the second voltage boosting circuit unit 110AA2, and the synchronization state detection unit 220AA replace the first voltage boosting circuit unit 110A1, the second voltage boosting circuit unit 110A2, and the synchronization state detection unit 220A, respectively, in FIG. 1; the main different points are that while in each of FIGS. 1 and 2, the circuit-opening time limiting timer 216*b* is utilized in order to determine the circuit-opening time of the voltage boosting opening/closing device 111*b*, a method of directly detecting the attenuated current is adopted in FIG. 7; the current detection resistor 111*c* is connected at a common downstream position of the voltage boosting opening/closing device 111*b* and the voltage boosting capacitor 112*b* or an upstream position of the induction device 111*a* so that the exciting current Ix at a time when the voltage boosting opening/closing device 111*b* is closed and the charging current Ic that flows from the induction device 111*a* to the voltage boosting capacitor 112*b* at a time when the voltage boosting opening/closing device 111*b* is opened flow in the current detection resistor 111*c*. The other constituent elements, i.e., the induction device 111*a*, the voltage boosting opening/closing device 111*b*, the charging diode 112*a*, the driving circuit unit for the voltage boosting capacitor 112*b*, and the input/output signal circuits before and after the voltage boosting comparison determination unit 214*a* are the same as those in FIG. 2.

The first current detection voltage Vc1 is applied to the positive terminal of a comparator forming the current comparison determination unit 211*a*, by way of the positive-side input resistor 211*b*; the divided voltage Vdiv, of the control voltage Vcc, that is obtained through voltage the dividing resistors 212*a*, 212*c*, and 212*b* is applied to the negative terminal thereof, by way of the negative-side input resistor 211*c*. A middle-stage parallel resistor 212*e* is connected in parallel with the middle-stage voltage dividing resistor 212*c* through the selective opening/closing device 213*a*; the setting current selection signal SEL1 (or the setting current selection signal SEL2) is applied to the selective opening/closing device 213*a* by way of the selective driving resistor 213*b*. A positive feedback resistor 211*d* is connected between the output terminal and the positive-side input terminal of the comparator 211*a*; when the exciting current Ix for the induction device 111*a* reaches, for example, the 1st setting current I1, the first current detection voltage Vc1 exceeds the divided voltage Vdiv obtained through the voltage dividing resistors 212*a* through 212*c* and hence the output logic of the comparator 211*a* once becomes "H" level. When the output logic once becomes "H" level, the operation state of the comparator 211*a* is maintained until the first current detection voltage Vc1 falls to a voltage, for example, corresponding to the 1st attenuated current I01; when the first current detection voltage Vc1 further falls, the output logic of the comparator 211*a* returns to "L" level.

A switching transistor 218*c* is connected in parallel with the upper-stage voltage dividing resistor 212*a*; when the logic level of the output of a logical multiplication circuit 218*b* becomes "L", the switching transistor 218*c* is driven by the logical multiplication circuit 218*b* through a base resistor 218*d*. When circuit-closing drive is being applied to the switching transistor 218*c* and the logic level of the setting current selection signal SEL1 (or SEL2) is "L", the divided voltage Vdiv becomes a small voltage V1 obtained through the voltage dividing resistors 212*c* and 212*b*; when circuit-closing drive is being applied to the switching transistor 218*c* and the logic level of the setting current selection signal SEL1 (or SEL2) is "H", the divided voltage Vdiv becomes a large voltage V2 obtained through the voltage dividing resistors 212*c* and 212*b* and the middle-stage parallel resistor 212*e*. In the case where when the logic level of the setting current selection signal SEL1 (SEL2) is "H" and hence the 2nd driving mode for large-current low-frequency opening/closing operation is selected, the exciting current Ix increases up to the 2nd setting current I2 and hence the output of the comparator 211*a* is "H" level, the output logic of the logical multiplication circuit 218*b* becomes "H"; as a result, the switching transistor 218*c* is opened and hence the divided voltage Vdiv is made to fall to the minimum level. As a result, there is obtained the relationship in which the 1st setting current I1 is smaller than the 2nd setting current I2 and the 1st attenuated current I01 is larger than the 2nd attenuated current I02.

The foregoing explanation can be applied also to the second voltage boosting circuit unit 110AA2; in the case where it is desired to utilize the second voltage boosting circuit unit 110AA2 in the 1st driving mode for small-current high-frequency opening/closing operation, the logic level of the setting current selection signal SEL2 is set to "L" and hence the selective opening/closing device 213*a* is opened, so that the divided voltage Vdiv obtained through the voltage dividing resistors 212*c* and 212*b* is made to fall; as a result, the 1st setting current I1 is set. Due to hysteresis characteristics caused by the positive feedback resistor 211*d*, the 1st attenuated current I01 is set to a value that is smaller than the 1st setting current I1. In the case where it is required to utilize the second voltage boosting circuit unit 110AA2 in the 2nd driving mode for large-current low-frequency opening/closing operation, the logic level of the setting current selection signal SEL2 is set to "H", thereby closing the selective opening/closing device 213*a*, so that the divided voltage Vdiv obtained through the voltage dividing resistors 212*c* and 212*b* and the middle-stage parallel resistor 212*e* is increased; as a result, the 2nd setting current I2 is set. Due to the hysteresis characteristics caused by the positive feedback resistor 211*d* and the switching transistor 218*c*, the 2nd attenuated current I02 is set to a value that is smaller than the 1st attenuated current I01.

The foregoing control operation will be theoretically explained below. It is assumed that the resistance values R111*c*, R211*b*, and R211*d* of the current detection resistor 111*c*, the positive-side input resistor 211*b*, and the positive feedback resistor 211*d* are R0, Rb, and Rd, respectively, that the resistance values R212*a*, R212*b*, and R212*c* of the voltage dividing resistors 212*a*, 212*b*, and 212*c* are Ra, Rbb, and Rc, respectively, and that the resistance value of the parallel combination resistor R212*c*//R212*e* consisting of the middle-stage voltage dividing resistor 212*c* and the middle-stage parallel resistor 212*e* is Rec. At first, the voltage across the lower-stage voltage dividing resistor 212*b*, which is generically referred to as the divided voltage Vdiv, is given by the equation (26a), (26b), or (26c) in accordance with the operation states of the switching transistor 218*c* and the selective opening/closing device 213*a*.

In the case where the switching transistor 218*c* is closed and the selective opening/closing device 213*a* is opened, $$V\text{div}=V1=Vcc\times Rbb/(Rc+Rbb) \tag{26a}$$

In the case where the switching transistor 218*c* is closed and the selective opening/closing device 213*a* is closed, $$V\text{div}=V2=Vcc\times Rbb/(Rec+Rbb)>V1 \tag{26b}$$

In the case where the switching transistor 218*c* is opened and the selective opening/closing device 213*a* is closed, $$V\text{div}=V2'=Vcc\times Rbb/(Ra+Rec+Rbb)<V2 \tag{26c}$$

With reference to the equations (26a) and (26b), the values of the 1st setting current I1 and the 2nd setting current I2 are determined by the equations (27a) and (27b), respectively.

$$R0\times I1=V1\ \therefore I1=Vcc/R0\times[Rbb/(Rc+Rbb)] \quad (27a)$$

$$R0\times I2=V2\ \therefore I2=Vcc/R0\times[Rbb/(Rec+Rbb)] \quad (27b)$$

In addition, from the equations (26b) and (26c), the relationship represented by the equation (26bc) is established.

$$\alpha=V2'/V2=(Rec+Rbb)/(Ra+Rec+Rbb) \quad (26bc)$$

In contrast, when the exciting current Ix reaches the 1st setting current I1, the output voltage of the comparator 211*a* changes from 0 V to the control voltage Vcc (=5 V), and hence the voltage boosting opening/closing device 111*b* is opened, charging of the voltage boosting capacitor 112*b* starts; when the charging current is attenuated to the 1st attenuated current I01, the equation (28) is established.

$$(Vcc-V1)/Rd=(V1-R0\times I01)/Rb \quad (28)$$

In this situation, by setting the relationship "Rd>>Rb", the equation (28a) is obtained.

$$I01=I1-(Vcc/R0)\times(Rb/Rd) \quad (28a)$$

Similarly, when the exciting current Ix reaches the 2nd setting current I2, the output voltage of the comparator 211*a* changes from 0 V to the control voltage Vcc (=5 V), and hence the voltage boosting opening/closing device 111*b* is opened, charging of the voltage boosting capacitor 112*b* starts; when the charging current is attenuated to the 2nd attenuated current I02, the equation (29) is established.

$$(Vcc-V2')/Rd=(V2'-R0\times I02)/Rb \quad (29)$$

In this situation, by setting the relationship "Rd>>Rb" and setting V2' to (α×V2) in the equation (26bc), the equation (29a) is obtained.

$$I02=\alpha I2-(Vcc/R0)\times(Rb/Rd) \quad (29a)$$

Thus, by setting the constant "α" in such a way that the relationship "αI2<I1" is established, the relationship "I02<I01" is established and hence the conditional equation for the equivalent power, i.e., "I1+I01=I2+I02" can be satisfied even when I2>I1; the positive feedback resistor 211*d* for determining the value of the attenuated current is a main element in an attenuated current setting unit.

Figure 3:
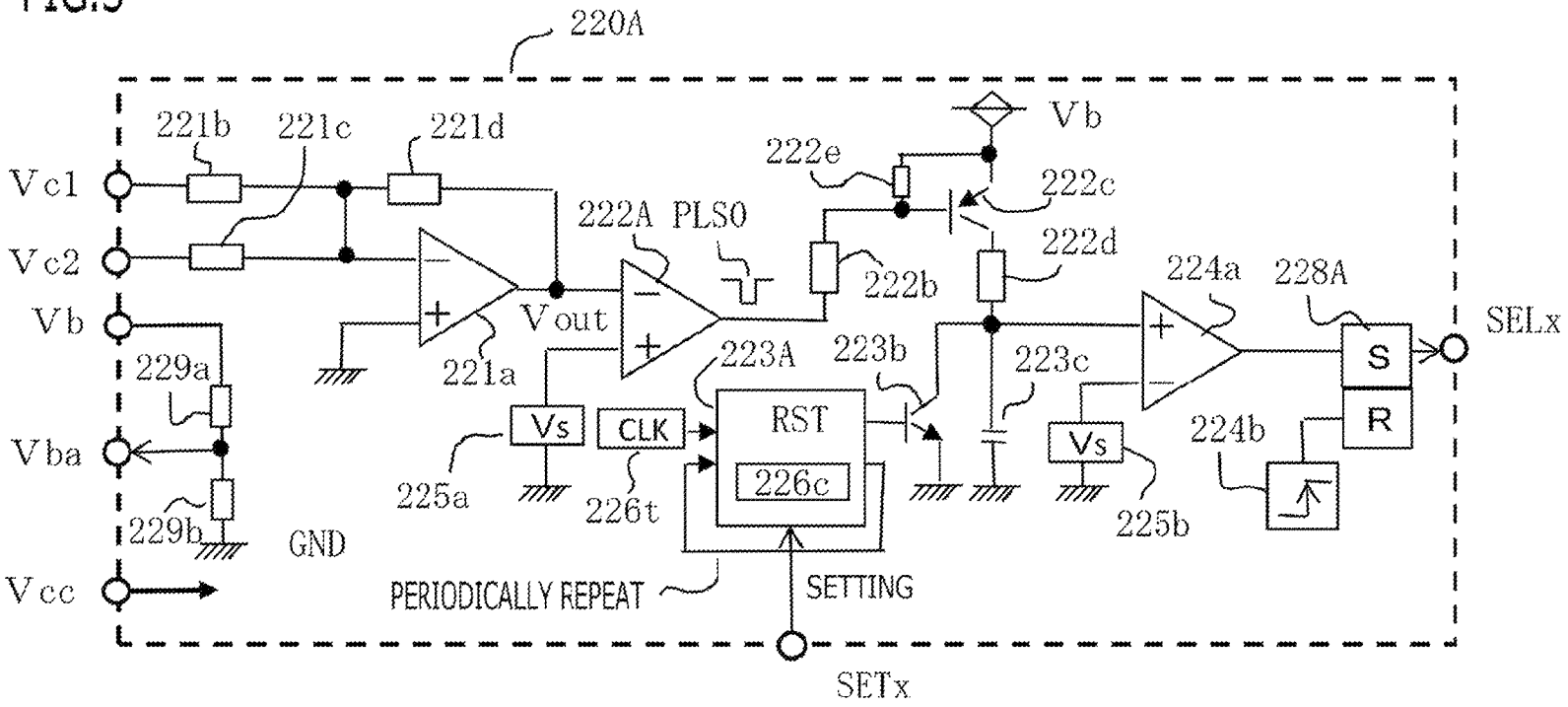
FIG. 3 is a detailed block diagram representing control by a synchronization state detection unit in the vehicle engine control system in FIG. 1.
Figure 8:
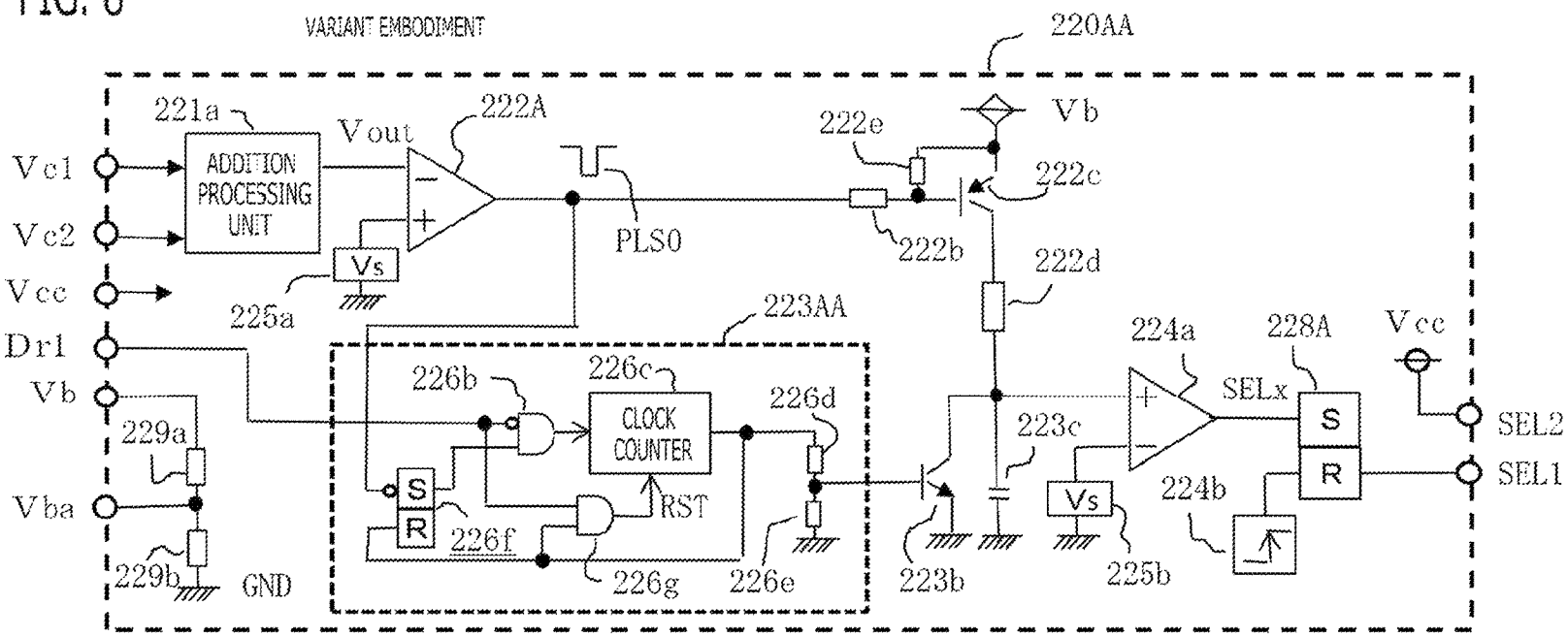
FIG. 8, replacing

In FIG. 8, the framework configuration of the synchronization state detection unit 220AA is similar to that of the synchronization state detection unit 220A represented in FIG. 3; the difference therebetween exists in a periodic reset processing unit 223AA. Therefore, as is the case with FIG. 3, the addition processing unit 221*a* includes the 1st input resistor 221*b*, the 2nd input resistor 221*c*, the negative feedback resistor 221*d*, and the comparator 211*a;* the synchronization timing detection unit 222A, the charging/discharging circuit for the integration capacitor 223*c*, the synchronization timing integration processing unit 224*a*, and the selection command occurrence storage unit 228A are also configured in the same manner. However, in the periodic reset processing unit 223AA, the time counting clock signal 226*t* as the counting input for the clock counter 226*c* is replaced by the first drive command signal Dr1 (or the second drive command signal Dr2), and a gate circuit 226*b* and an initial storage circuit 226*f* are provided in the counting input circuit of the clock counter 226*c*. When the synchronization timing detection unit 222A generates the in-synchronization detection pulse PLS0, the initial storage circuit 226*f* is set and the set output opens the gate circuit 226*b*, so that the clock counter 226*c* can count the number of instances where the logic level of the first drive command signal Dr1 changes from "H" to "L", i.e., the number of circuit-opening actions of the voltage boosting opening/closing device 111*b*.

When its counting value reaches a setting value "2", which is preliminarily set, the clock counter 226*c* generates a counting-up output so as to perform circuit-closing drive of the discharging transistor 223*b* by way of a base resistor 226*d*, and resets the initial storage circuit 226*f* so as to stop the counting operation of the clock counter 226*c*; when the logic level of the first drive command signal Dr1 changes from "L" to "H", the present counting value of the clock counter 226*c* is initialized through a reset circuit 226*g*. The clock counter 226*c* performs initial counting at a timing immediately after the in-synchronization detection pulse PLS0 is generated; when after this particular timing, the first period of the first drive command signal Dr1 ends and then the logic thereof changes from "H" to "L" again, the counting value becomes "2"; then, the clock counter 226*c* counts up. Therefore, the monitoring period SETx obtained through the clock counter 226*c* approximately corresponds to the on/off period T01 of the first drive command signal Dr1; when the in-synchronization detection pulse PLS0 is generated again in the monitoring period SETx, the number of instances where the driving transistor 222*c* is closed becomes "2", from the addition of this particular in-synchronization detection pulse PLS0 and the initial in-synchronization detection pulse PLS0; accordingly, the voltage across the integration capacitor 223*c* exceeds the integration value determination threshold voltage 225*b* and hence the selection command signal SELx is generated.

When the second in-synchronization detection pulse PLS0 is not generated, the discharging transistor 223*b* is closed, the electric charges on the integration capacitor 223*c* are discharged, and the present counting value of the clock counter 226*c* is initialized; then, the same operation is repeated. After that, initial generation of the in-synchronization detection pulse PLS0 makes the clock counter 226*c* restart its counting operation. As is clear from the foregoing explanation, the synchronization state detection unit 220A represented in FIG. 3 adopts a macro-monitoring method in which a standard necessary time at a time when the number of occurrence instances of the first drive command signal Dr1 or the second drive command signal Dr2 is "5" is utilized as the monitoring period SETx and in which when the in-synchronization detection pulse PLS0 is generated thrice or more times in the monitoring period SETx, the selection command signal SELx is generated; the macro-monitoring method is suitable for performing a determination on the synchronization state in collaboration with the microprocessor CPU. However, the synchronization state detection unit 220AA represented in FIG. 8 adopts a micro-monitoring method in which a timing when one period of the first drive command signal Dr1 or the second drive command signal Dr2 elapses from the timing when the in-synchronization detection pulse PLS0 is initially generated is utilized as the monitoring period SETx and in which when the in-synchronization detection pulse PLS0 is generated twice or more times in the monitoring period SETx, the selection command signal SELx is generated; the micro-monitoring method is suitable for performing a determination on the synchronization state, without relying on the microprocessor CPU.

In the case where the integration capacitor 223*c* and the synchronization timing integration processing unit 224*a*, represented in FIG. 8, are utilized, the width of the in-synchronization detection pulse PLS0 changes in accordance with the length of the overlap between the waveforms of the exciting currents; therefore, because it is required to regard two short pulses as one wide pulse, it is safer that two-period monitoring period SETx is utilized. In this case, the setting value of the clock counter 226*c* is "3". In this regard, however, even in the case where when one-period monitoring period SETx is utilized, no selection command signal SELx is generated in the time of two short pulses, the selection command signal SELx is generated in the following monitoring operation. Until the selection command signal SELx is generated, the logic levels of the setting current selection signals SEL1 and SEL2 are both set to "H" so that a common driving mode for large-current low-frequency on/off operation is selected; then, when the selection command signal SELx is generated, the logic level of the setting current selection signal SEL1 is set to "L" so that the driving mode moves to a different kind of driving mode for small-current high-frequency on/off operation. As described above, in the variant Embodiment of Embodiment 1, the setting current selection signal SEL1 or SEL2 is directly inputted to the selective opening/closing device 213*a*, based on the output of the selection command occurrence storage unit 228A in FIG. 8. Therefore, all the control items related to voltage boosting control are implemented through hardware, and the microprocessor CPU is not involved; however, it may be allowed that the selection command signal SELx is temporarily transmitted to the microprocessor CPU and then the microprocessor CPU generates the setting current selection signals SEL1 and SEL2 so that the driving modes are switched.

(4) Gists and Features of Embodiment 1 and Variant Embodiment Thereof

As is clear from the foregoing explanation, in order to drive the respective fuel-injection electromagnetic valves 103 provided in the cylinders of a multi-cylinder engine, the vehicle engine control system according to Embodiment 1 of the present invention or a variant Embodiment thereof includes the driving control circuit units 120X and 120Y for two or more electromagnetic coils 31 through 34 for driving respective corresponding electromagnetic valves, the first voltage boosting circuit unit 110A1 (110AA1) and the second voltage boosting circuit unit 110A2 (110AA2), and the calculation control circuit unit 130A formed mainly of the microprocessor CPU. The first voltage boosting circuit unit 110A1 (110AA1) and the second voltage boosting circuit unit 110A2 (110AA2) include the first voltage boosting control unit 210A1 (210AA1) and the second voltage boosting control unit 210A2 (210AA2), respectively, that operate independently from each other, a pair of respective induction devices 111*a* that are on/off-excited by the first voltage boosting control unit 210A1 (210AA1) and the second voltage boosting control unit 210A2 (210AA2), respectively, a pair of respective charging diodes 112*a* that are connected in series with the respective corresponding induction devices 111*a* in a pair, and one voltage boosting capacitor 112*b* or a plurality of voltage boosting capacitors 112*b* that are connected in parallel with each other; each of the voltage boosting capacitors 112*b* is charged by way of the corresponding charging diode 112*a* in a pair by an induction voltage caused through cutting off of the exciting current Ix for the corresponding induction device 111*a* in a pair, and is charged up to the predetermined boosted voltage Vh through a plurality of the on/off exciting actions.

The first voltage boosting control unit 210A1 (210AA1) and the second voltage boosting control unit 210A2 (210AA2) include a pair of respective voltage boosting opening/closing devices 111*b* that are connected in series with the respective corresponding induction devices 111*a* in a pair to be connected with the vehicle battery 101 and that perform on/off control of the respective corresponding exciting currents Ix for the induction devices 111*a* in a pair, a pair of respective current detection resistors 111*c* in which the respective exciting currents Ix flow, a pair of current comparison determination units 211*a* that cut off energization of one of or both of the pair of voltage boosting opening/closing devices 111*b* when after circuit-closing drive is applied to one of or both of the pair of voltage boosting opening/closing devices 111*b*, the exciting current Ix reaches a target setting current or larger, a pair of circuit-opening time limiting units that perform circuit-closing drive of one of or both of the pair of voltage boosting opening/closing devices 111*b* when after energization of one of or both of the pair of voltage boosting opening/closing devices 111*b* is cut off, a predetermined setting time or a predetermined current attenuation time elapses, and the respective voltage boosting comparison determination units 214*a* that prohibit circuit-closing drive of the respective corresponding voltage boosting opening/closing devices 111*b* in a pair when the respective voltages across the corresponding voltage boosting capacitors 112*b* become a predetermined threshold value voltage or higher.

The circuit-opening time limiting unit is the circuit-opening time limiting timer 216*b*, which is a time counting circuit that counts the setting time transmitted from the microprocessor CPU, or the attenuated current setting unit 211*d* (in the variant Embodiment) that adopts, as the current attenuation time, the time in which the exciting current Ix is attenuated to a predetermined attenuated current value; in accordance with the 1st setting current I1, which is the target setting current, and the 2nd setting current I2, which is a value larger than the 1st setting current I1, the 1st circuit-opening limit time t1, which is the setting time, and the 2nd circuit-opening limit time t2, which is a time longer than the 1st circuit-opening limit time t1, or the 1st attenuated current I01, which is the attenuated current value, and the 2nd attenuated current I02, any one of the 1st driving mode for small-current high-frequency on/off operation based on the 1st setting current I1, and the 1st circuit-opening limit time t1 or the 1st attenuated current I01 and the 2nd driving mode for large-current low-frequency on/off operation based on the 2nd setting current I2, and the 2nd circuit-opening limit time t2 or the 2nd attenuated current I02 is applied to one of and the other one of the first voltage boosting control unit 210A1 (210AA1) and the second voltage boosting control unit 210A2 (210AA2); furthermore, the synchronization state detection unit 220A (220AA) that detects and stores the state where the circuit-opening timings for the pair of voltage boosting opening/closing devices 111*b* are continuously close to each other and that generates the selection command signal SELx is provided in each of the first voltage boosting control unit 210A1 (210AA1) and the second voltage boosting control unit 210A2 (210AA2); the microprocessor CPU includes the initial setting unit 601*b* that sets the driving modes of the first voltage boosting control unit 210A1 (210AA1) and the second voltage boosting control unit 210A2 (210AA2) to a common driving mode, which is anyone of the 1st driving mode and the 2nd driving mode, until the time when the selection command signal SELx is generated and the alteration setting unit 604 that sets the driving modes of the first voltage boosting control unit 210A1 (210AA1) and the second voltage boosting control unit 210A2 (210AA2) to respective different driving modes, which are any one of the 1st driving mode and the 2nd driving mode and the other one thereof, after the time when the selection command signal SELx is generated.

In the case where after one of the voltage boosting opening/closing devices 111*b* is opened at the 1st setting current I1, the one of the voltage boosting opening/closing devices 111*b* is closed again at the timing when the 1st circuit-opening limit time t1 elapses, the exciting current Ix for one of the induction devices 111*a* becomes the 1st attenuated current I01; in the case where after the other one of the voltage boosting opening/closing devices 111*b* is opened at the 2nd setting current I2, the other one of the voltage boosting opening/closing devices 111*b* is closed again at the timing when the 2nd circuit-opening limit time t2 elapses, the exciting current Ix for the other one of the induction devices 111*a* becomes the 2nd attenuated current I02; under the condition that the relationship "the 2nd setting current I2 is larger than the 1st setting current I1" and the relationship "the 1st attenuated current I01 is larger than the 2nd attenuated current I02" are established, the addition value (I1+I01) of the 1st setting current I1 and the 1st attenuated current I01 and the addition value (I2+I02) of the 2nd setting current I2 and the 2nd attenuated current I02 are close to and approximate to each other.

As described above, with regard to claim 2 of the present invention, when the voltage boosting opening/closing device is closed again, there exists an attenuated current; the addition value (I1+I01) of the 1st setting current I1 and the 1st attenuated current I01 and the addition value (I2+I02) of the 2nd setting current I2 and the 2nd attenuated current I02 are close to each other; the relationship "I2>I1" and the relationship "I01>I02" are established. In this case, the electromagnetic energy, of one of the induction devices 111*a*, that is discharged into the voltage boosting capacitor due to a single on/off operational action is proportional to ($I1^2-I01^2$) and the on/off period is proportional to (I1−I01); thus, the charging power for the voltage boosting capacitor is $(I1^2-I01^2)/(I1-I01)=(I1+I01)$, i.e., proportional to the addition value of the 1st setting current I1 and the 1st attenuated current I01. The foregoing explanation can be applied to the other induction device; the charging power, through the other induction device, for the voltage boosting capacitor is proportional to the addition value (I2+I02) of the 2nd setting current I2 and the 2nd attenuated current I02. Accordingly, because the opening/closing period of the induction device for which a larger setting current is utilized becomes low-frequency and the opening/closing period of the induction device for which a smaller setting current is utilized becomes high-frequency, the charging power obtained by dividing the energy, for the voltage boosting capacitor, of single-time charging with the 1st setting current I1 or the 2nd setting current I2 by the on/off period can be made constant; thus, there is demonstrated a characteristic that it is made possible that whichever driving mode is utilized, the charging power for the voltage boosting capacitor does not change. Each of Embodiments 2 and 3 demonstrates the same characteristic.

The synchronization state detection unit 220A (220AA) includes the addition processing unit 221*a* that generates an addition amplification voltage obtained by amplifying the addition value of the first current detection voltage Vc1, which is the voltage across one of the current detection resistors 111*c*, in a pair, and the second current detection voltage Vc2, which is the voltage across the other one of the current detection resistors 111*c*, the synchronization timing detection unit 222A that detects the synchronization timing when the respective waveforms of the exciting currents Ix for the corresponding induction devices 111*a* in a pair synchronize with each other, when the addition amplification voltage of the addition processing unit 221*a* exceeds the addition value determination threshold value voltage 225*a*, and then generates the in-synchronization detection pulse PLS0, the synchronization timing integration processing unit 224*a* that determines that the synchronization timing has continuously occurred, when the number of occurrence instances of the in-synchronization detection pulse PLS0 exceeds a predetermined value determined by the integration value determination threshold voltage 225*b*, that generates the selection command signal SELx, and that stores this particular selection command signal SELx in the selection command occurrence storage unit 228A, and the periodic reset processing unit 223A (223AA) that periodically resets the number of occurrence instances of the in-synchronization detection pulse PLS0 integrated by the synchronization timing integration processing unit 224*a* and that prevents the number of occurrence instances of the in-synchronization detection pulse PLS0 from exceeding the integration value determination threshold voltage 225*b*, when the occurrence frequency of the in-synchronization detection pulse PLS0 generated by the synchronization timing detection unit 222A is low; the synchronization timing integration processing unit 224*a* includes the integration capacitor 223*c* to be charged through the integration resistor 222*d* when the synchronization timing detection unit 222A generates the in-synchronization detection pulse PLS0, and determines that the synchronization timing has continuously occurred, when the voltage across the integration capacitor 223*c* exceeds the integration value determination threshold voltage 225*b*; the periodic reset processing unit 223A (223AA) periodically discharges the integration capacitor 223*c* in a forcible manner; the addition value determination threshold value voltage 225*a* is a value that is the same as or larger than 70% but smaller than the maximum value of the addition amplification voltage; and the integration value determination threshold voltage 225*b* corresponds to the charging voltage at a time when in the interval from the immediate previous forcible discharging by the periodic reset processing unit 223A (223AA) to the following forcible discharging, a predetermined plurality of maximum-duration charges are applied to the integration capacitor 223*c*.

As described above, with regard to claim 3 of the present invention, the synchronization state detection unit includes the synchronization timing detection unit that generates the in-synchronization detection pulse, when the addition value of the exciting currents for a pair of induction devices exceeds the addition value determination threshold value voltage, the synchronization timing integration processing unit that determines that the synchronization state has occurred, when the voltage across the integration capacitor, which is charged as the synchronization timing occurs and is periodically discharged in a forcible manner by the periodic reset processing unit, exceeds the integration value determination threshold voltage, and the selection command occurrence storage unit that responds to the above determination. Therefore, there is demonstrated a characteristic that it is determined whether or not the respective circuit-opening timings of the voltage boosting opening/closing devices in a pair are close to each other, based on the level of the addition value of the peak values of the exciting currents in the state immediately before the circuit-opening timing, and that based on whether or not this state continues, the synchronization state can be determined. When the interval where the current waveforms overlap each other is short, the time in which the addition current exceeds the addition value determination threshold value voltage becomes short and hence a single-time charging voltage for the integration capacitor becomes low, and when the interval where the current waveforms overlap each other is long, the time in which the addition current exceeds the addition value determination threshold value voltage becomes long and hence the single-time charging voltage for the integration capacitor becomes high; thus, there is demonstrated a characteristic that the overlapping state can accurately be detected in comparison with the case where the number of occurrence instances of the overlapping state is counted simply.

The power-source voltage Vb of the vehicle battery 101 is applied to the integration capacitor 223*c* by way of the integration resistor 222*d* and the driving transistor 222*c* that responds to the in-synchronization detection pulse PLS0 generated by the synchronization timing detection unit 222A. As described above, with regard to claim 4 of the present invention, when a synchronization timing is detected, the integration capacitor is charged with the power-source voltage of the vehicle battery by way of the integration resistor. Accordingly, although the interval where the addition amplification voltage generated by the addition processing unit exceeds the addition value determination threshold value voltage is in inverse proportion to the power-source voltage of the vehicle battery, the charging current for the integration capacitor is proportional to the power-source voltage; therefore, there is demonstrated a characteristic that even when the power-source voltage fluctuates, the single-time charging voltage, generated through the occurrence of a synchronization timing, for the integration capacitor does not change and hence the synchronization state can accurately be determined.

The periodic reset processing unit 223A includes the clock counter 226*c* that counts the time counting clock signal 226*t*; the clock counter 226*c* operates while utilizing the time, as the monitoring period SETx, that corresponds to a period that is five times as long as the occurrence period of the first drive command signal Dr1 or the second drive command signal Dr2 in the common driving mode, and periodically and forcibly resets the number of occurrence instances of the in-synchronization detection pulse PLS0 to be integrated by the synchronization timing integration processing unit 224*a*, each time the time to be monitored reaches the monitoring period SETx; when the forcible reset has been completely implemented, the clock counter 226*c* resets its own present counting value and then recurrently performs the following counting operation at least until the selection command signal SELx is generated; when the number of occurrence instances of the in-synchronization detection pulse PLS0 is three or larger in the interval between a time of the immediately previous forcible reset and a time of the present forcible reset, the synchronization timing integration processing unit 224*a* generates the selection command signal SELx.

As described above, with regard to claim 10 of the present invention, every monitoring period SETx corresponding to a period that is five times as long as the period of the driving command signal for the voltage boosting opening/closing device, the periodic reset processing unit periodically resets the integrated occurrence value of the in-synchronization detection pulse PLS0, integrated by the synchronization timing integration processing unit, or the number of occurrence instances of the in-synchronization detection pulse PLS0; when the number of occurrence instances of the in-synchronization detection pulse PLS0 is three or larger in the interval between a time of the immediately previous forcible reset and a time of the present forcible reset, the synchronization timing integration processing unit generates the selection command signal SELx. Therefore, there is demonstrated a characteristic that because the number of occurrence instances of the in-synchronization detection pulse PLS0 is three or larger, which is the same as or larger than half the number of occurrence instances of the driving command signal, in the interval that is five times as longer as the period of the driving command signal for the voltage boosting opening/closing device in the 2nd driving mode, it can be determined that the state where the respective periods of the first drive command signal Dr1 and the second drive command signal Dr2 are close to each other and hence the addition value of the respective exciting currents for the induction devices in a pair becomes excessive is continuing.

The periodic reset processing unit 223AA includes the clock counter 226*c* that counts the number of occurrence instances of the first drive command signal Dr1 or the second drive command signal Dr2 for performing circuit-closing drive of corresponding one of the voltage boosting opening/closing devices 111*b* in a pair; the clock counter 226*c* operates while utilizing the time, as the monitoring period SETx, that is a time period between a time when in the common driving mode, the in-synchronization detection pulse PLS0 is generated and a time when any one of the first drive command signal Dr1 and the second drive command signal Dr2 is newly generated once, and periodically and forcibly resets the number of occurrence instances of the in-synchronization detection pulse PLS0 to be integrated by the synchronization timing integration processing unit 224*a*, each time the time to be monitored reaches the monitoring period SETx; when the forcible reset has been completely implemented, the clock counter 226*c* resets its own present counting value; then, at least until the selection command signal SELx is generated, the clock counter 226*c* recurrently performs the time counting operation even after the occurrence of the in-synchronization detection pulse PLS0, which is generated thereafter, is stored; when the number of occurrence instances of the in-synchronization detection pulse PLS0 is two or larger in the interval between a time of the immediately previous forcible reset and a time of the present forcible reset, the synchronization timing integration processing unit 224*a* generates the selection command signal SELx.

As described above, with regard to claim 11 of the present invention, after the present in-synchronization detection pulse PLS0 has been generated, every resetting period corresponding to one or two periods of the driving command signal for the voltage boosting opening/closing device, the periodic reset processing unit periodically resets the integrated occurrence value of or the number of occurrence instances of the in-synchronization detection pulse PLS0, integrated by the synchronization timing integration processing unit; when the number of occurrence instances of the in-synchronization detection pulse PLS0 is two or larger in the interval between a time of the immediately previous forcible reset and a time of the present forcible reset, the synchronization timing integration processing unit generates the selection command signal SELx. Therefore, there is demonstrated a characteristic that because after the immediately previous in-synchronization detection pulse PLS0 has been generated, the following in-synchronization detection pulse PLS0 is generated before the two period of the first drive command signal Dr1 or the second drive command signal Dr2 elapses, it can be determined that the state where the respective periods of the first drive command signal Dr1 and the second drive command signal Dr2 are close to each other and hence the addition value of the respective exciting currents for the induction devices in a pair becomes excessive is continuing. As described in each of Embodiments 1 and 2, in the case where the synchronization timing integration processing unit including the integration capacitor is utilized, the width of the in-synchronization detection pulse PLS0 changes depending on the length of the overlap between the respective waveforms of the exciting currents; therefore, it is desirable that two narrow-width pulses are regarded as one wide-width pulse and the determination is performed twice every two periods or more frequently; in the case where such a synchronization instance counter as describe in Embodiment 3 is utilized, it is desirable that the determination is performed twice every one period or more frequently.

The clock counter 226*c* counts the time counting clock signal 226*t* so as to monitor the number of occurrence instances of the first drive command signal Dr1 or the second drive command signal Dr2; the calculation control circuit unit 130A includes the program memory PGM that collaborates with the microprocessor CPU, and the program memory PGM includes a control program, which functions as a voltage correction means 602*a* for the monitoring period SETx; the value of the monitoring period SETx is corrected by the voltage correction means 602*a* so as to become a value that is in inverse proportion to the value of the power-source voltage monitoring voltage Vba, which is a divided voltage of the power-source voltage Vb of the vehicle battery 101. As described above, with regard to claim 12 of the present invention, the value of the monitoring period SETx for periodically monitoring the number of occurrence instances of the in-synchronization detection pulse is in inverse proportion to the power-source voltage. Accordingly, there is demonstrated a characteristic that in the case where the microprocessor does not generate the driving command signal and setting of the monitoring period SETx depends on the time counting clock signal, the setting value of the monitoring period SETx is corrected in accordance with the period of the driving command signal that is in inverse proportion to the power-source voltage, it is made possible to obtain the monitoring period SETx that responds to the number of occurrence instances of the driving command signal.

In the vehicle engine control system in which the first voltage boosting circuit unit 110A1 and the second voltage boosting circuit unit 110A2 have the respective circuit-opening time limiting timers 216*b*, as the pair of circuit-opening time limiting units, the values of the 1st circuit-opening limit time t1 and the 2nd circuit-opening limit time t2 to be set by the pair of circuit-opening time limiting units are corrected by the voltage correction means 602*a* so as to become values in inverse proportion to the value of the power-source voltage monitoring voltage Vba, which is a divided voltage of the power-source voltage Vb of the vehicle battery 101. As described above, with regard to claim 13 of the present invention, the values of the 1st circuit-opening limit time t1 and the 2nd circuit-opening limit time t2 to be set by the pair of circuit-opening time limiting units are corrected so as to become values in inverse proportion to the power-source voltage Vb. Accordingly, there is demonstrated a characteristic that in the case where in the vehicle engine control system having no attenuated current detection circuit, the circuit-opening limit time is set in accordance with the current attenuation time that is in inverse proportion to the power-source voltage, the voltage boosting opening/closing device can be closed again at the timing when a target attenuated current is reached. This characteristic is the same as that of each of Embodiments 1 through 3.

Each of the current detection resistors 111*c*, in a pair is connected at an upstream position of each of the induction devices 111*a* in a pair or the charging diodes 112*a* in a pair or at a downstream position of each of the voltage boosting capacitors 112*b*, each of which and the corresponding one of the voltage boosting opening/closing devices 111*b* in a pair form a pair; in the case where each of the current detection resistors 111*c* in a pair is connected at a downstream position of the corresponding one of the voltage boosting opening/closing devices 111*b* in a pair, the voltage boosting capacitors 112*b* form a pair and each of the voltage boosting capacitors 112*b* in a pair is connected at an upstream position of the corresponding one of the current detection resistors 111*c*, in a pair; the exciting current Ix, which flows in each of the induction devices 111*a* in a pair when the corresponding one of the voltage boosting opening/closing devices 111*b* in a pair is closed, and the charging current Ic, which flows from each of the induction devices 111*a* in a pair to the corresponding one of the voltage boosting capacitors 112*b* in a pair when the corresponding one of the voltage boosting opening/closing devices 111*b* in a pair is opened, flow into the corresponding one of the current detection resistors 111*c*, in a pair; by way of the positive-side input resistor 211*b*, the current detection voltage Vc1 (Vc2) determined by the product of the resistance value of the current detection resistor 111*c* and the exciting current Ix or the charging current Ic is inputted to the positive-side input terminal of each of the comparators in a pair, which forms the corresponding one of the current comparison determination units 211*a* in a pair; a comparison setting voltage Vdiv that is in proportion to the target setting current I1 (I2), which is a peak value of the exciting current Ix, is inputted to the negative-side input terminal of each of the comparators in a pair, and the output voltage of each of the comparators in a pair is connected with the positive-side input terminal of the particular comparator by way of the positive feedback resistor 211*d*; when any one of the voltage boosting opening/closing devices 111*b* in a pair is closed and hence the current detection voltage Vc1 (Vc2) of the induction device 111*a*, to which energization drive is applied by the particular one of the voltage boosting opening/closing devices 111*b*, becomes the same as or higher than the comparison setting voltage Vdiv, the particular one of the voltage boosting opening/closing devices 111*b* is opened; as a result, when the charging current Ic is attenuated to the predetermined attenuated current I01 (I02) or smaller, the particular one of the voltage boosting opening/closing devices 111*b* is closed again; the value of the predetermined attenuated current I01 (I02) is adjusted in accordance with the rate of the resistance value Rb of the positive-side input resistor 211*b* to the resistance value Rd of the positive feedback resistor 211*d*; the positive feedback resistor 211*d* is included in the attenuated current setting unit.

As described above, with regard to claim 17 of the present invention, when the current detection voltage Vc1 (Vc2) in proportion to the value of the exciting current Ix that flows in the induction device or the value of the charging current Ic for the voltage boosting capacitor becomes the same as or higher than the comparison setting voltage Vdiv in proportion to the target setting current, the current comparison determination unit that performs on/off control of the voltage boosting opening/closing device opens the voltage boosting opening/closing device; then, when the charging current Ic is attenuated to a predetermined attenuated current or smaller, the current comparison determination unit again closes the voltage boosting opening/closing device; the value of the predetermined attenuated current is set by the attenuated current setting unit including a positive feedback resistor provided in the current comparison determination unit. Therefore, there is demonstrated a characteristic that the value of the attenuated current at a time when the voltage boosting opening/closing device is closed again can accurately be set and that on/off control of the induction device can be performed without depending on the control operation of the microprocessor CPU.

Embodiment 2

(1) Detailed Description of Configuration and Operation

Figure 9:
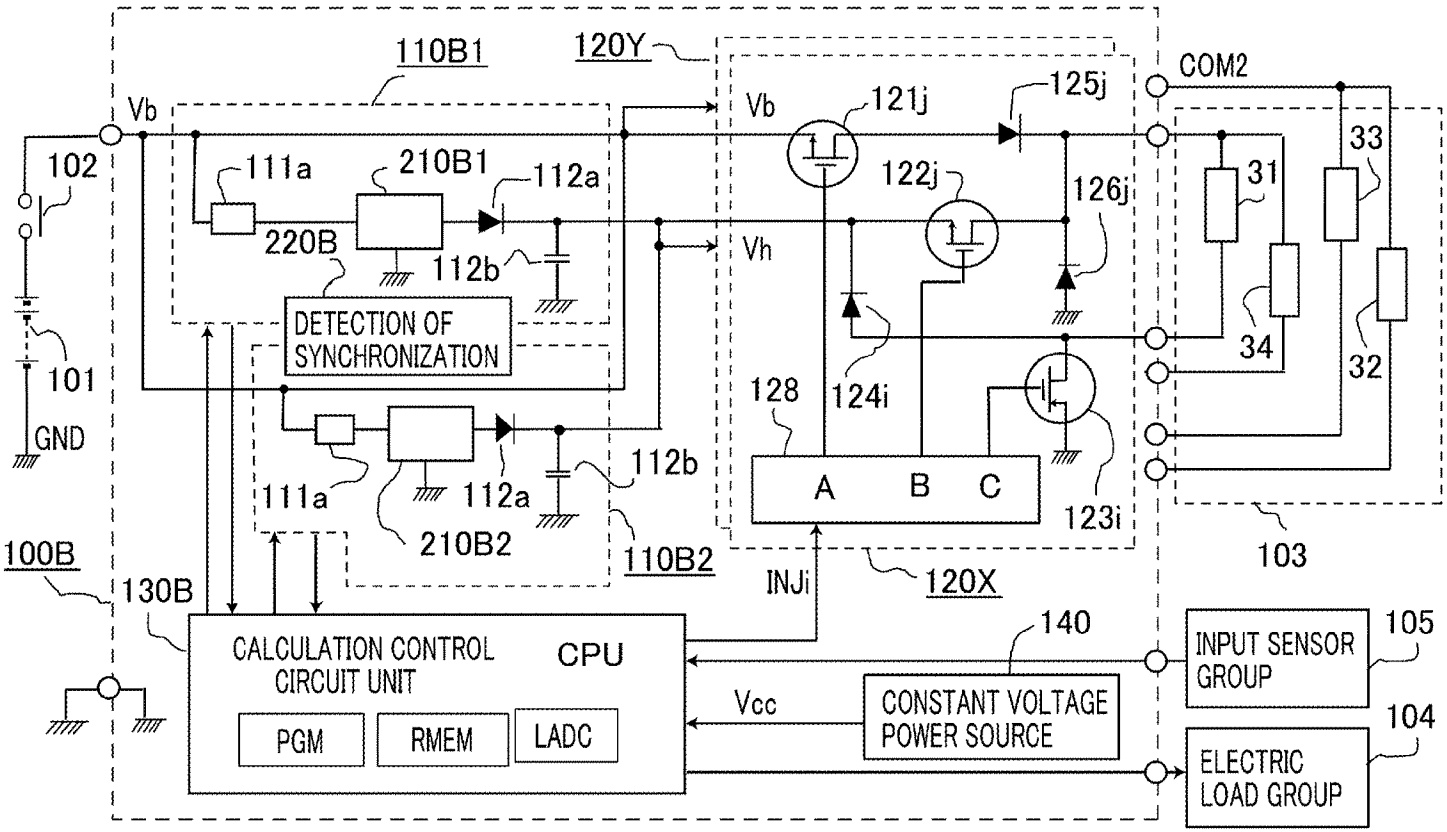
FIG. 9 is a block diagram representing the overall circuit of a vehicle engine control system according to Embodiment 2 of the present invention.

Hereinafter, with reference to FIG. 9, which is a block diagram representing the overall circuit of a vehicle engine control system according to Embodiment 2 of the present invention, and FIG. 10, which is a detailed block diagram representing control of a voltage boosting circuit unit of the vehicle engine control system in FIG. 9, the configuration thereof, mainly the difference between the respective vehicle engine control systems in FIGS. 1 and 9, will be explained in detail. In each of the drawings, the same reference characters designate the same or equivalent constituent elements; the upper-case alphabetic characters denote the corresponding constituent elements that vary in accordance with the embodiment. In FIG. 9, a first voltage boosting circuit unit 110B1, a second voltage boosting circuit unit 110B2, a synchronization state detection unit 220B, the driving control circuit units 120X and 120Y, a calculation control circuit unit 130B, and the constant voltage power source 140 that are included in a vehicle engine control system 100B are configured in the same manner as in FIG. 1; the vehicle battery 101, the output contact 102 of the power supply relay, the fuel-injection electromagnetic valve 103 having the electromagnetic coils 31 through 34, the electric load group 104, and the input sensor group 105 are connected with the external portion thereof in the same manner as in FIG. 1. The main different point between the vehicle engine control system 100A and the vehicle engine control system 100B relates to the synchronization state detection unit 220B that makes first and second voltage boosting control units 210B1 and 210B2, provided in the first voltage boosting circuit unit 110B1 and the second voltage boosting circuit unit 110B2, respectively, collaborate with each other; the detection method of a synchronization timing detection unit 222B in the synchronization state detection unit 220B is different.

Figure 10:
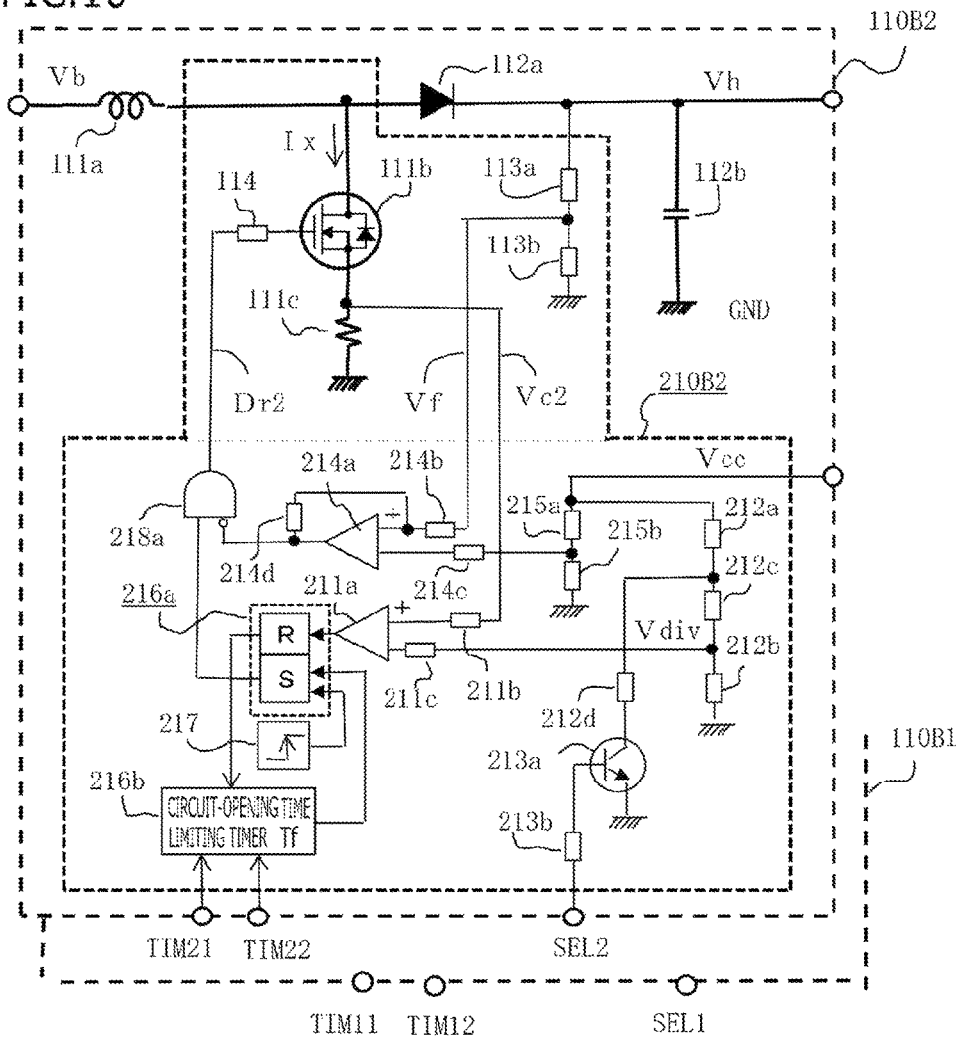
FIG. 10 is a detailed block diagram representing control of a voltage boosting circuit unit in the vehicle engine control system in FIG. 9.

In FIG. 10, as is the case with FIG. 2, each of the first voltage boosting circuit unit 110B1 and the second voltage boosting circuit unit 110B2 is provided with the induction device 111*a*, which is one of inductance devices in a pair, the charging diode 112*a*, which is one of charging diodes in a pair and is connected in series with the induction device 111*a*, and the voltage boosting capacitor 112*b*, which is one of voltage boosting capacitors in a pair, which is connected in parallel with the other one of the voltage boosting capacitors, and which is charged through the charging diode 112*a*. Because configured in the same manner as the second voltage boosting circuit unit 110B2, the first voltage boosting circuit unit 110B1 is not represented in detail in FIG. 10. The respective induction devices 111*a* in a pair are on/off-excited by the second voltage boosting control unit 210B2 and the unillustrated first voltage boosting control unit 210B1. The configuration of the second voltage boosting control unit 210B2 (or the first voltage boosting control unit 210B1) is the same as that of the second voltage boosting control unit 210A2 (or the first voltage boosting control unit 210A1) in FIG. 2; the second voltage boosting control unit 210B2 (or the first voltage boosting control unit 210B1) is configured with main elements such as the voltage boosting opening/closing device 111*b*, the current detection resistor 111*c*, the current comparison determination unit 211*a*, the voltage boosting comparison determination unit 214*a*, the circuit-opening time limiting timer 216*b*, and the selective opening/closing device 213*a* and the accompanying circuits thereof.

Figure 11:
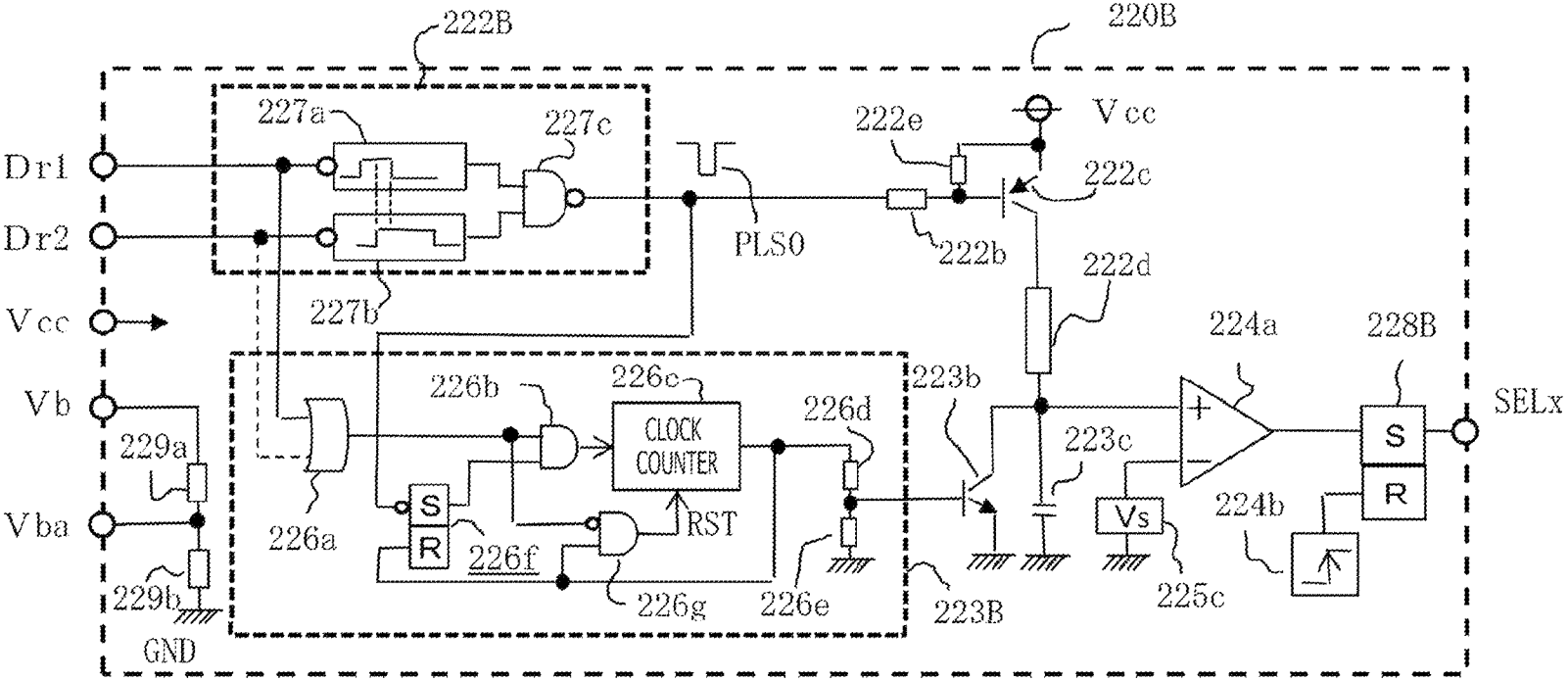
FIG. 11 is a detailed block diagram representing control by a synchronization state detection unit in the vehicle engine control system in FIG. 9.

Next, with reference to FIG. 11, which is a detailed block diagram representing control by the synchronization state detection unit 220B in the vehicle engine control system in FIG. 9, the configuration thereof, mainly the difference between the respective synchronization state detection units in FIGS. 11 and 3, will be explained in detail. The main differences therebetween are the difference in the synchronization timing detection method of the synchronization timing detection unit 222B and the difference in the time counting method of a periodic reset processing unit 223B; the synchronization timing integration processing unit 224*a*, a selection command occurrence storage unit 228B, the integration capacitor 223*c*, and the charging and discharging circuits thereof are configured in the same manner as those in FIG. 3. However, the charging voltage for the integration capacitor 223*c* is changed from the power-source voltage Vb to the control voltage Vcc; this change is due to the difference in the synchronization timing detection method. In FIG. 11, the synchronization timing detection unit 222B is configured with a pair of pulse generating circuits 227*a* and 227*b* and a logic combining circuit 227*c*; the pulse generating circuits 227*a* generates a pulse signal whose logic level becomes "H" in a 1st predetermined time after the timing when the logic level of the first drive command signal Dr1 for one of the voltage boosting opening/closing devices 111*b* changes from "H" to "L"; the 1st predetermined time corresponds to the 1st circuit-opening limit time t1 to be set by the circuit-opening time limiting timer 216*b*.

The pulse generating circuits 227*b* generates a pulse signal whose logic level becomes "H" in a 2nd predetermined time after the timing when the logic level of the second drive command signal Dr2 for the other one of the voltage boosting opening/closing devices 111*b* changes from "H" to "L"; the 2nd predetermined time corresponds to the 2nd circuit-opening limit time t2 to be set by the circuit-opening time limiting timer 216*b*. The logic combining circuit 227*c* is a NAND circuit whose logic level becomes "L" when there is established a predominant logic where both the respective output logics of the pulse generating circuits 227*a* and 227*b* in a pair are "H"; the output signal "L" of the logic combining circuit 227*c* becomes the in-synchronization detection pulse PLS0. Accordingly, the in-synchronization detection pulse PLS0 in FIG. 3 is detected in the case where while being close to each other, the first and second drive command signals Dr1 and Dr2 change their respective logic levels from "H" to "L" and hence the addition current becomes excessive immediately before those changes; in contrast, in the case of FIG. 11, the in-synchronization detection pulse PLS0 is detected in the case where while being close to each other, the first and second drive command signals Dr1 and Dr2 change their respective logic levels from "H" to "L" and hence the pulse signals, having a predetermined time period, that are generated immediately after those changes, overlap each other. Accordingly, in the synchronization state detection unit 220B in FIG. 11, because the fluctuation of the power-source voltage Vb does not provide a substantial effect to the pulse width of the in-synchronization detection pulse PLS0, the stabilized control voltage Vcc is utilized as the power-source voltage for the integration capacitor 223*c*.

The periodic reset processing unit 223B is configured in the same manner as the periodic reset processing unit 223AA in FIG. 8; the time counting clock signal 226*t* as the counting input for the clock counter 226*c* is replaced by the first drive command signal Dr1 (or the second drive command signal Dr2), and the gate circuit 226*b* and the initial storage circuit 226*f* are provided in the counting input circuit of the clock counter 226*c*. When the synchronization timing detection unit 222B generates the in-synchronization detection pulse PLS0, the initial storage circuit 226*f* is set and the set output opens the gate circuit 226*b*, so that the clock counter 226*c* can count the number of instances where the logic level of the first drive command signal Dr1 changes from "H" to "L", i.e., the number of circuit-closing actions for the voltage boosting opening/closing device 111*b*. When its counting value reaches a setting value "2", which is preliminarily set, the clock counter 226*c* generates a counting-up output so as to perform circuit-closing drive of the discharging transistor 223*b* by way of the base resistor 226*d*, and resets the initial storage circuit 226*f* so as to stop the counting operation of the clock counter 226*c*; when the logic level of the first drive command signal Dr1 changes from "L" to "H", the present counting value of the clock counter 226*c* is initialized by way of the reset circuit 226*g*.

The clock counter 226*c* performs initial counting at a timing immediately after the in-synchronization detection pulse PLS0 is generated; when after this particular timing, the first period of the first drive command signal Dr1 ends and then the logic thereof changes from "H" to "L" again, the counting value becomes "2"; then, the clock counter 226*c* outputs a counting-up output. Therefore, the monitoring period SETx obtained through the clock counter 226*c* approximately corresponds to the on/off period of the first drive command signal Dr1; when the in-synchronization detection pulse PLS0 is generated again in the monitoring period SETx, the number of instances where the driving transistor 222*c* is closed becomes "2", from the addition of this particular in-synchronization detection pulse PLS0 and the initial in-synchronization detection pulse PLS0; accordingly, the voltage across the integration capacitor 223*c* exceeds the integration value determination threshold voltage 225*b* and hence the selection command signal SELx is generated.

When the second in-synchronization detection pulse PLS0 is not generated, the discharging transistor 223*b* is closed, the electric charges on the integration capacitor 223*c* are discharged, and the present counting value of the clock counter 226*c* is initialized; then, the same operation is repeated. After that, initial generation of the in-synchronization detection pulse PLS0 makes the clock counter 226*c* restart its counting operation.

In the case where the integration capacitor 223*c* and the synchronization timing integration processing unit 224*a*, represented in FIG. 11, are utilized, the width of the in-synchronization detection pulse PLS0 changes in accordance with the length of the overlap between the respective pulse signals, having a predetermined time period, that are generated immediately after the first and second drive command signals Dr1 and Dr2 are in the respective circuit-opening command states; therefore, because it is required to regard two short pulses as one wide pulse, it is safer that two-period monitoring period SETx is utilized. In this case, the setting value of the clock counter 226*c* is "3". In this regard, however, even in the case where when one-period monitoring period SETx is utilized, no selection command signal SELx is generated in the time of two short pulses, the selection command signal SELx is generated in the following monitoring operation. It may be allowed that both the first drive command signal Dr1 and the second drive command signal Dr2, as the inputs for the clock counter 226*c*, are counted through a logical sum device 226*a* and that the setting value for counting-up is set to "4". In this regard, however, the number of occurrence instances of the in-synchronization detection pulse PLS0 for determining the synchronization state is two or larger.

Next, the operation and action of the vehicle engine control system 100B, configured as described with reference to FIGS. 9 and 10, according to Embodiment 2 will be explained in detail, based on FIG. 6, which is a flowchart for explaining the driving mode selection operation in Embodiment 1. The current waveform charts of the first and 2nd driving modes are as explained in FIGS. 4A and 4B, respectively; the concept can be applied also to FIG. 5A, 5B, 5C, 5D, which are timing charts for explaining the in-synchronization detection pulse PLS0. In this regard, however, although in FIG. 5, the timing when the in-synchronization detection pulse PLS0 is generated is represented immediately before the changes in the first and second drive command signals Dr1 and Dr2, the timing in Embodiment 2 moves to a position immediately after the logic levels of the first and second drive command signals Dr1 and Dr2 change to "L".

In FIG. 6, because in Embodiment 2, the clock counter 226*c* does not count the time counting clock signal 226*t*, the setting of the monitoring period SETx in the process 601*c* is not required and hence the correction of the monitoring period SETx in the process 602*a* is not required, either. From a viewpoint that the fluctuation of the power-source voltage Vb does not provide a substantial effect to the attenuation characteristics of the charging current Ic for the voltage boosting capacitor 112*b*, neither the process 601*c* nor the process 602*a* is required. The other configurations are the same as those explained in FIG. 6. As is clear from the foregoing explanation, in Embodiment 2, the role, related to voltage boosting control, of the microprocessor CPU is to manage setting values for the circuit-opening time limiting timer 216*b*, to generate the setting current selection signals SEL1 and SEL2 by use of the selection command signal SELx obtained from the synchronization state detection unit 220B formed of hardware, and to generate the circuit-opening time limit time selection signals TIM11, TIM12, TIM21, and TIM22 so as to implement switching of the driving modes.

(2) Gist and Feature of Embodiment 2

As is clear from the foregoing explanation, in order to drive the respective fuel-injection electromagnetic valves 103 provided in the cylinders of a multi-cylinder engine, the vehicle engine control system 100B according to Embodiment 2 of the present invention includes the driving control circuit units 120X and 120Y for two or more electromagnetic coils 31 through 34 for driving respective corresponding electromagnetic valves, the first voltage boosting circuit unit 110B1 and the second voltage boosting circuit unit 110B2, and the calculation control circuit unit 130B formed mainly of the microprocessor CPU. The first and second voltage boosting circuit units 110B1 and 110B2 include the first voltage boosting control unit 210B1 and the second voltage boosting control unit 210B2, respectively, that operate independently from each other, a pair of induction devices 111*a* that are on/off-excited by the first voltage boosting control unit 210B1 and the second voltage boosting control unit 210B2, respectively, a pair of respective charging diodes 112*a* that are connected in series with the respective corresponding induction devices 111*a* in a pair, and one voltage boosting capacitor 112*b* or a plurality of voltage boosting capacitors 112*b* that are connected in parallel with each other; each of the voltage boosting capacitors 112*b* is charged by way of the corresponding charging diode 112*a* in a pair by an induction voltage caused through cutting off of the exciting current Ix for the corresponding induction device 111*a* in a pair, and is charged up to the predetermined boosted voltage Vh through a plurality of the on/off exciting actions.

The first voltage boosting control unit 210B1 and the second voltage boosting control unit 210B2 include a pair of respective voltage boosting opening/closing devices 111*b* that are connected in series with the respective corresponding induction devices 111*a* in a pair to be connected with the vehicle battery 101 and that perform on/off control of the respective corresponding induction devices 111*a* in a pair, a pair of respective current detection resistors 111*c* in which the respective exciting currents Ix flow, a pair of current comparison determination units 211*a* that cut off energization of one of or both of the pair of voltage boosting opening/closing devices 111*b* when after circuit-closing drive is applied to one of or both of the pair of voltage boosting opening/closing devices 111*b*, the exciting current Ix reaches a target setting current or larger, a pair of circuit-opening time limiting units that perform circuit-closing drive of one of or both of the pair of voltage boosting opening/closing devices 111*b* when after energization of one of or both of the pair of voltage boosting opening/closing devices 111*b* is cut off, a predetermined setting time elapses, and the respective voltage boosting comparison determination units 214*a* that prohibit circuit-closing drive of the respective corresponding voltage boosting opening/closing devices 111*b* in a pair when the respective voltages across the corresponding voltage boosting capacitors 112*b* become a predetermined threshold value voltage or higher.

The circuit-opening time limiting unit is the circuit-opening time limiting timer 216*b*, which is a time counting circuit that counts the setting time transmitted from the microprocessor CPU; in accordance with the 1st setting current I1, which is the target setting current, and the 2nd setting current I2, which is a value larger than the 1st setting current I1, the 1st circuit-opening limit time t1, which is the setting time, and the 2nd circuit-opening limit time t2, which is a time longer than the 1st circuit-opening limit time t1, any one of the 1st driving mode for small-current high-frequency on/off operation based on the 1st setting current I1 and the 1st circuit-opening limit time t1 and the 2nd driving mode for large-current low-frequency on/off operation based on the 2nd setting current I2 and the 2nd circuit-opening limit time t2 is applied to one of and the other one of the first voltage boosting control unit 210B1 and the second voltage boosting control unit 210B2; furthermore, the synchronization state detection unit 220B that detects and stores the state where the circuit-opening timings for the pair of voltage boosting opening/closing devices 111*b* are continuously close to each other and that generates the selection command signal SELx is provided in each of the first voltage boosting control unit 210B1 and the second voltage boosting control unit 210B2; the microprocessor CPU includes the initial setting unit 601*b* that sets the driving modes of the first voltage boosting control unit 210B1 and the second voltage boosting control unit 210B2 to a common driving mode, which is any one of the 1st driving mode and the 2nd driving mode, until the time when the selection command signal SELx is generated and the alteration setting unit 604 that sets the driving modes of the first voltage boosting control unit 210B1 and the second voltage boosting control unit 210B2 to respective different driving modes, which are any one of the 1st driving mode and the 2nd driving mode and the other one thereof, after the time when the selection command signal SELx is generated.

The synchronization state detection unit 220B includes the synchronization timing detection unit 222B provided with a pair of pulse generating circuits 227*a* and 227*b* that each generate a pulse signal having a predetermined time period, when the respective states of the first drive command signal Dr1 and the second drive command signal Dr2 for driving the corresponding voltage boosting opening/closing devices 111*b* in a pair become the circuit-opening command state and with the logic combining circuit 227*c* that generates the in-synchronization detection pulse PLS0 when both the pulse signals in a pair that are generated by the pair of pulse generating circuits are predominant logic, the synchronization timing integration processing unit 224*a* that determines that the synchronization timing where the circuit-opening timings of the voltage boosting opening/closing devices 111*b* in a pair synchronize with each other has continuously occurred, when the number of occurrence instances of the in-synchronization detection pulse PLS0 exceeds a predetermined value determined by an integration value determination threshold voltage 225*c*, that generates the selection command signal SELx, and that stores this particular selection command signal SELx in the selection command occurrence storage unit 228B, and the periodic reset processing unit 223B that periodically resets the number of occurrence instances of the in-synchronization detection pulse PLS0 integrated by the synchronization timing integration processing unit 224*a* and that prevents the number of occurrence instances of the in-synchronization detection pulse PLS0 from exceeding the predetermined integration value determination threshold voltage 225*c*, when the occurrence frequency of the in-synchronization detection pulse PLS0 generated by the synchronization timing detection unit 222B is low; the synchronization timing integration processing unit 224*a* includes the integration capacitor 223*c* to be charged through the integration resistor 222*d* when the synchronization timing detection unit 222B generates the in-synchronization detection pulse PLS0, and determines that the synchronization timing has continuously occurred, when the voltage across the integration capacitor 223*c* exceeds the integration value determination threshold voltage 225*c*; the periodic reset processing unit 223B periodically discharges the integration capacitor 223*c* in a forcible manner; the time period of each of the pulse signals to be generated by the pulse generating circuits 227*a* and 227*b* in a pair is the same as or longer than the 1st circuit-opening limit time t1 and is the same as or shorter than the 2nd circuit-opening limit time t2; the integration value determination threshold voltage 225*c* corresponds to the charging voltage at a time when in the interval from the immediate previous forcible discharging by the periodic reset processing unit 223B to the following forcible discharging, a predetermined plurality of maximum-duration charges are applied to the integration capacitor 223*c*.

As described above, with regard to claim 5 of the present invention, the synchronization state detection unit includes the synchronization timing detection unit that generates a pulse signal having a predetermined time period when each of the voltage boosting opening/closing devices in a pair is opened and that generates the in-synchronization detection pulse when both of the pulse signals in a pair are predominant, the synchronization timing integration processing unit that determines that the synchronization state has occurred, when the voltage across the integration capacitor, which is charged as the synchronization timing occurs and is periodically discharged in a forcible manner by the periodic reset processing unit, exceeds the determination threshold voltage, and the selection command occurrence storage unit that responds to the above determination. Therefore, there is demonstrated a characteristic that it is determined whether or not the respective circuit-opening timings of the voltage boosting opening/closing devices in a pair are close to each other, based on the length of the overlap between the pulse signals that each are generated immediately after the circuit-opening timing, and that based on whether or not this state continues, the synchronization state can be determined. Moreover, there is demonstrated a characteristic that in the case where the respective circuit-opening time limiting units generate the 1st circuit-opening limit time t1 and the 2nd circuit-opening limit time t2, the circuit-opening time limiting units can directly be utilized as the pulse generating circuits in a pair. When the interval where the pulse signals in a pair overlap each other is short, a single-time charging voltage for the integration capacitor becomes low, and when the interval where the pulse signals overlap each other is long, the single-time charging voltage for the integration capacitor becomes high; thus, there is demonstrated a characteristic that the overlapping state can accurately be detected in comparison with the case where the number of occurrence instances of the overlapping state is counted simply.

The stabilized control voltage Vcc obtained through the constant voltage power source 140 from the power-source voltage Vb of the vehicle battery 101 is applied to the integration capacitor 223*c* by way of the integration resistor 222*d* and the driving transistor 222*c* that responds to the in-synchronization detection pulse PLS0 generated by the synchronization timing detection unit 222B. As described above, with regard to claim 6 of the present invention, when a synchronization timing is detected, the integration capacitor is charged with the stabilized control voltage by way of the integration resistor. Accordingly, there is demonstrated a characteristic that because the charging voltage, for the integration capacitor, that is produced when a single synchronization timing occurs is proportional to the length of the overlap between the pulse signals in a pair and hence is affected neither by the fluctuation in the power-source voltage nor by the fluctuation, in the rising characteristic of the exciting current, that is caused by the fluctuation in the power-source voltage, the synchronization state can accurately be determined.

The periodic reset processing unit 223B includes the clock counter 226*c* that counts the number of occurrence instances of the first drive command signal Dr1 or the second drive command signal Dr2 for performing circuit-closing drive of corresponding one of the voltage boosting opening/closing devices 111*b* in a pair; the clock counter 226*c* operates while utilizing the time, as the monitoring period SETx, that is a time period between a time when in the common driving mode, the in-synchronization detection pulse PLS0 is generated and a time when any one of the first drive command signal Dr1 and the second drive command signal Dr2 is newly generated once or twice, and periodically and forcibly resets the number of occurrence instances of the in-synchronization detection pulse PLS0 to be integrated by the synchronization timing integration processing unit 224*a*, each time the time to be monitored reaches the monitoring period SETx; when the forcible reset has been completely implemented, the clock counter 226*c* resets its own present counting value; then, at least until the selection command signal SELx is generated, the clock counter 226*c* recurrently performs the time counting operation even after the occurrence of the in-synchronization detection pulse PLS0, which is generated thereafter, is stored; when the number of occurrence instances of the in-synchronization detection pulse PLS0 is two or larger in the interval between a time of the immediately previous forcible reset and a time of the present forcible reset, the synchronization timing integration processing unit 224*a* generates the selection command signal SELx.

As described above, with regard to claim 11 of the present invention, after the present in-synchronization detection pulse PLS0 has been generated, every monitoring period SETx corresponding to one or two periods of the driving command signal for the voltage boosting opening/closing device, the periodic reset processing unit periodically resets the integrated occurrence value of the in-synchronization detection pulse PLS0, integrated by the synchronization timing integration processing unit; when the number of occurrence instances of the in-synchronization detection pulse PLS0 is two or larger in the interval between a time of the immediately previous forcible reset and a time of the present forcible reset, the synchronization timing integration processing unit generates the selection command signal SELx. Therefore, there is demonstrated a characteristic that because after the immediately previous in-synchronization detection pulse PLS0 has been generated, the following in-synchronization detection pulse PLS0 is generated before the two period of the first drive command signal Dr1 or the second drive command signal Dr2 elapses, it can be determined that the state where the respective periods of the first drive command signal Dr1 and the second drive command signal Dr2 are close to each other and hence the addition value of the respective exciting currents for the induction devices in a pair becomes excessive is continuing. As described in each of Embodiments 1 and 2, in the case where the synchronization timing integration processing unit including the integration capacitor is utilized, the width of the in-synchronization detection pulse PLS0 changes depending on the length of the overlap between the respective waveforms of the exciting currents; therefore, it is desirable that two narrow-width pulses are regarded as one wide-width pulse and the determination is performed twice every two periods or more frequently; in the case where such a synchronization instance counter as describe in Embodiment 3 is utilized, it is desirable that the determination is performed twice every one period or more frequently.

Embodiment 3 and Variants of Each Embodiment (1) Detailed Description for Configuration and Operation/Action of Embodiment 3

Figure 12:
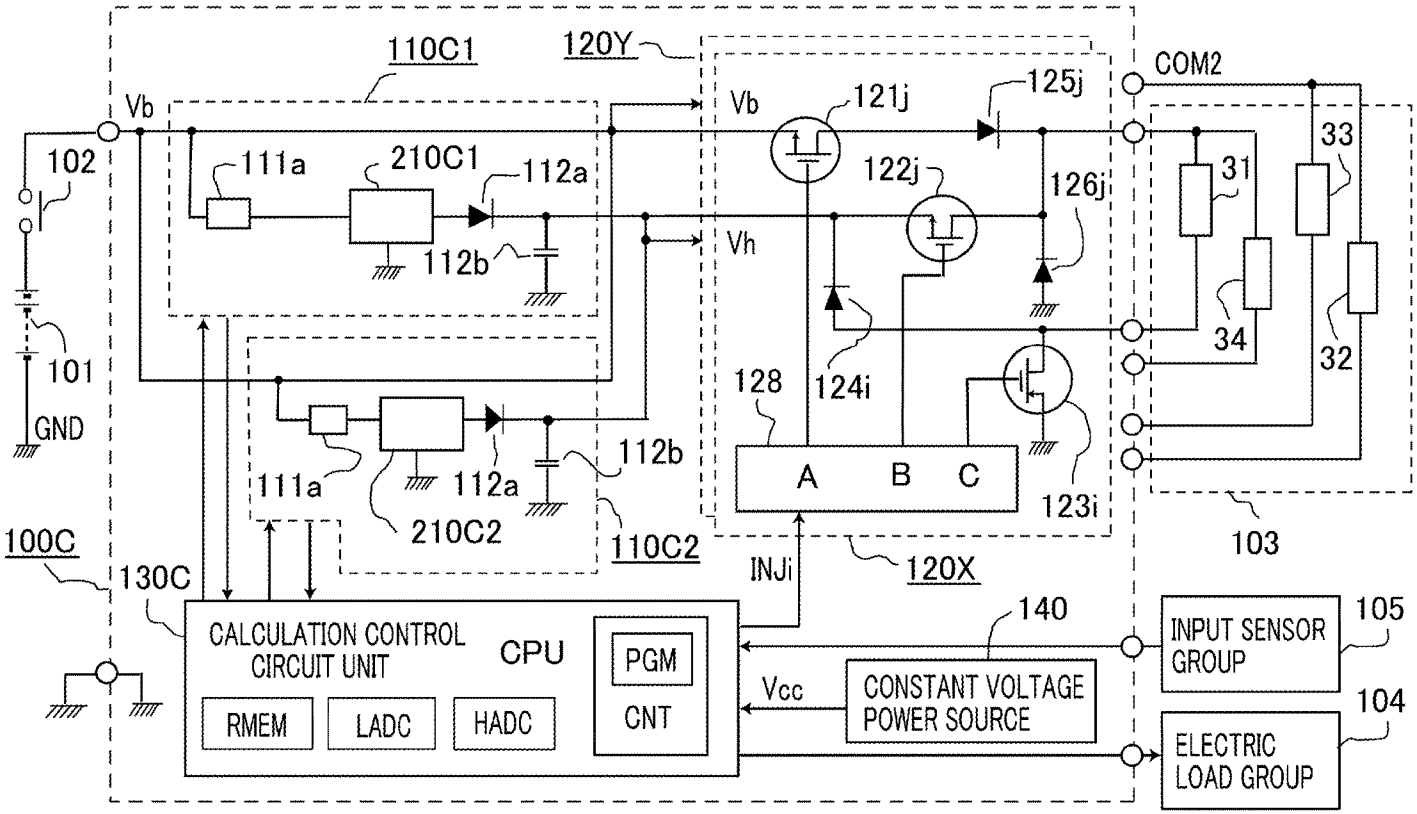
FIG. 12 is a block diagram representing the overall circuit of a vehicle engine control system according to Embodiment 3 of the present invention.

Hereinafter, with reference to FIG. 12, which is a block diagram representing the overall circuit of a vehicle engine control system according to Embodiment 3 of the present invention, and FIG. 13, which is a detailed block diagram representing control of a voltage boosting circuit unit of the vehicle engine control system in FIG. 12, the configuration thereof, mainly the difference between the respective vehicle engine control systems in FIGS. 1 and 12, will be explained in detail. In each of the drawings, the same reference characters designate the same or equivalent constituent elements; the upper-case alphabetic characters denote the corresponding constituent elements that vary in accordance with the embodiment. In FIG. 12, a first voltage boosting circuit unit 110C1, a second voltage boosting circuit unit 110C2, the driving control circuit units 120X and 120Y, a calculation control circuit unit 130C, and the constant voltage power source 140 that are included in a vehicle engine control system 100C are configured in the same manner as in FIG. 1; the vehicle battery 101, the output contact 102 of the power supply relay, the fuel-injection electromagnetic valve 103 having the electromagnetic coils 31 through 34, the electric load group 104, and the input sensor group 105 are connected with the external portion thereof in the same manner as in FIG. 1. The main differences therebetween are that the synchronization state detection unit 220A represented in FIG. 1 is removed and the function thereof is implemented by a voltage boosting control program CNT in the calculation control circuit unit 130C and that the calculation control circuit unit 130C includes a high-speed A/D converter HADC, which performs AD conversion for each channel, in addition to the multi-channel A/D converter LADC.

Figure 13:
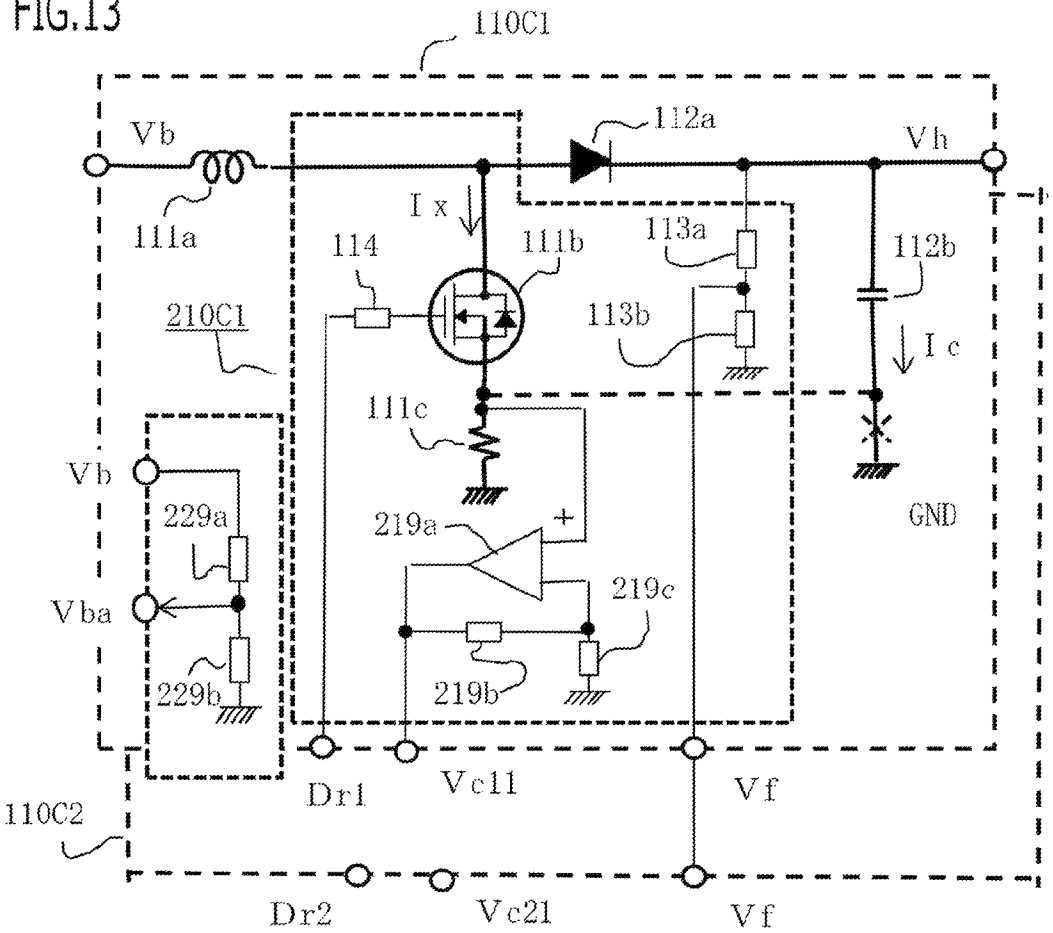
FIG. 13 is a detailed block diagram representing control of a voltage boosting circuit unit in the vehicle engine control system in FIG. 12.

In FIG. 13, as is the case with FIG. 2, each of the first voltage boosting circuit unit 110C1 and the second voltage boosting circuit unit 110C2 is provided with the induction device 111*a*, which is one of inductance devices in a pair, the charging diode 112*a*, which is one of charging diodes in a pair and is connected in series with the induction device 111*a*, and the voltage boosting capacitor 112*b*, which is one of voltage boosting capacitors in a pair, which is connected in parallel with the other one of the voltage boosting capacitors, and which is charged through the charging diode 112*a*. Because configured in the same manner as the first voltage boosting circuit unit 110C1, the second voltage boosting circuit unit 110C2 is not represented in detail in FIG. 13. The respective induction devices 111*a* in a pair are on/off-excited by a first voltage boosting control unit 210C1 and an unillustrated second voltage boosting control unit 210C2. In the first voltage boosting control unit 210C1 (or the second voltage boosting control unit 210C2), the voltage boosting opening/closing device 111*b* and the current detection resistor 111*c* are connected at a downstream position of the induction device 111*a;* the negative-side terminal of the voltage boosting capacitor 112*b* is connected with the vehicle body ground circuit GND or at an upstream position of the current detection resistor 111*c*. When the logic level of the first drive command signal Dr1 is "H", circuit-closing drive is applied to one of the voltage boosting opening/closing devices 111*b*; the other one thereof is driven by the second drive command signal Dr2; the respective drive command signals are transmitted from the microprocessor CPU.

Each of amplifiers 219*a* in a pair amplifies the voltage across the corresponding one of the current detection resistors 111*c*, in a pair and inputs the amplified voltage, as a first current detection amplification voltage Vc11 or a second current detection amplification voltage Vc21, to the high-speed A/D converter HADC provided in the calculation control circuit unit 130C. Negative feedback resistors 219*b* and 219*c* are connected with the output terminal of the amplifier 219*a*; the positive-side input resistor thereof is connected with the upstream terminal of the current detection resistor 111*c*, and a divided voltage obtained through the negative feedback resistors 219*b* and 219*c* is applied to the negative-side input terminal thereof. As a result, the amplification factor, i.e., the rate of the first current detection amplification voltage Vc11 or the second current detection amplification voltage Vc21 to the voltage across the current detection resistor 111*c*, is (R219*b*+R219*c*)/R219*c*≈R219*b*/R219*c*. R219*b* and R219*c* denote the respective resistance values of the negative feedback resistors 219*b* and 219*c*. The divided voltage obtained through the voltage boosting voltage dividing resistors 113*a* and 113*b* connected between the positive-side terminal of the voltage boosting capacitor 112*b* and the vehicle body ground circuit GND is inputted, as the charging monitoring voltage Vf, to the high-speed A/D converter HADC. The voltage dividing resistors 229*a* and 229*b* divide the power-source voltage Vb so as to generate the power-source voltage monitoring voltage Vba, which is inputted to the microprocessor CPU by way of the multi-channel A/D converter LADC.

Figure 14:
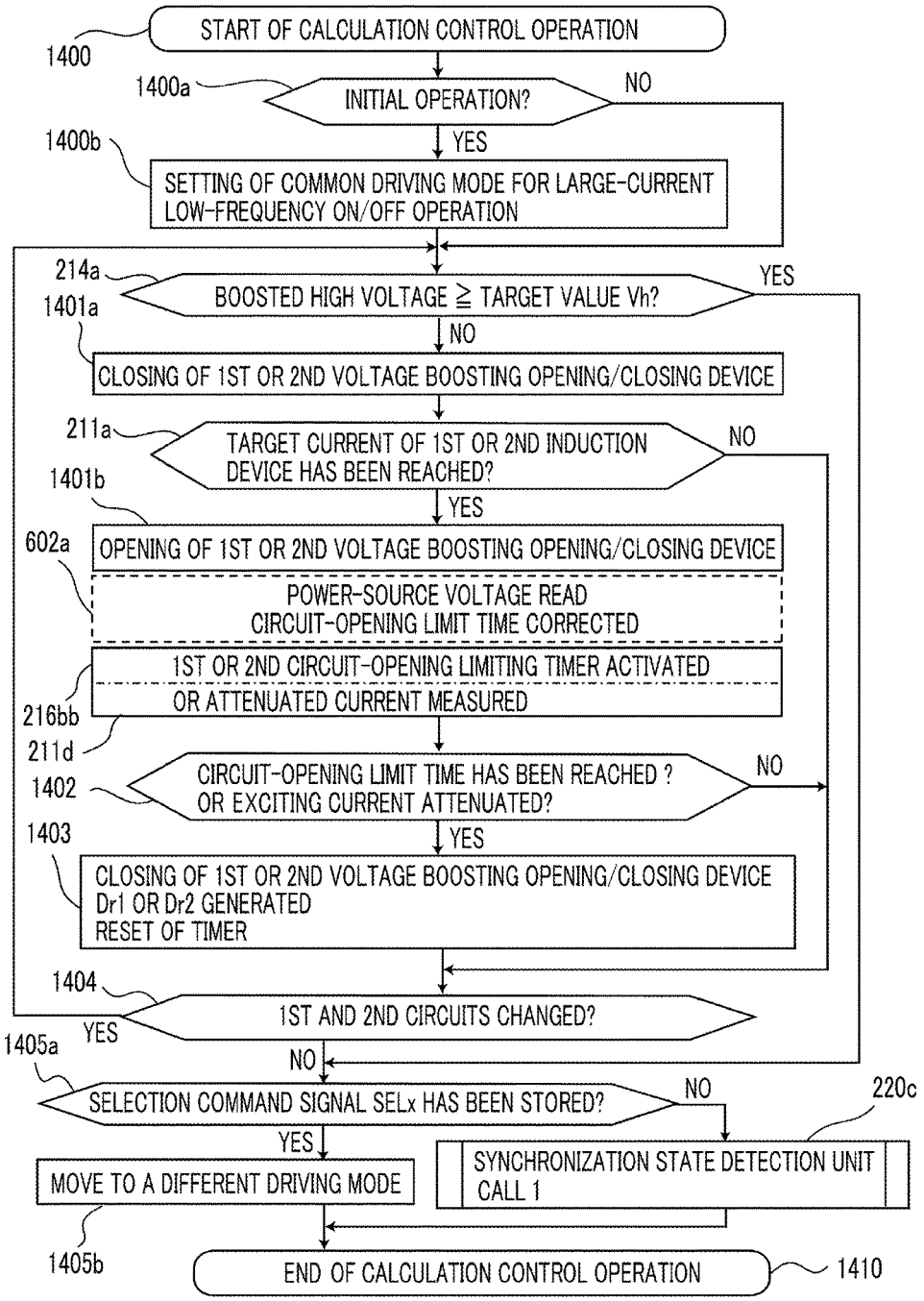
FIG. 14 is a flowchart for explaining voltage boosting control operation of the vehicle engine control system in FIG. 12.

Next, with reference to FIG. 14, which is a flowchart for explaining the voltage boosting control operation of the vehicle engine control system in FIG. 12, the action/operation thereof will be explained in detail. FIG. 14 represents the outline of a control program in which a program memory PRG, which collaborates with the microprocessor CPU, performs on/off control, of the voltage boosting opening/closing device 111*b*, that utilizes the circuit-opening time limiting timer 216*b* represented in FIG. 2, or on/off control, of the voltage boosting opening/closing device 111*b*, according to the attenuated current detection method represented in FIG. 7. In FIG. 14, the process 1400 is the starting process where the control operation by the microprocessor CPU is started; the microprocessor CPU recurrently implements the control flow between the operation starting process 1400 and the operation ending process 1410. In the foregoing control flow, the intermediate flow between the process 214*a* and the process 1404, related to on/off control of a pair of voltage boosting opening/closing devices 111*b*, is recurrently implemented twice, based on the determination in the process 1404; in the first circulation, the voltage boosting opening/closing device 111*b* in the first voltage boosting circuit unit 110C1 is controlled; in the second circulation, the voltage boosting opening/closing device 111*b* in the second voltage boosting circuit unit 110C2 is controlled. In the process 1400*a*, it is determined whether or not the present control flow is the first one; in the case where the present control flow is the first one, the result of the determination becomes "YES", and the process 1400*a* is followed by the process 1400*b*; in the case where the present control flow is not the first one, the result of the determination becomes "NO", and the process 1400*a* is followed by the process 214*a*. In the process 1400*b*, respective driving modes are set for one and the other one of the voltage boosting opening/closing devices 111*b* in a pair; in this case, the 2nd driving mode for large-current low-frequency on/off operation is set for both of the voltage boosting opening/closing devices 111*b*, and then the process 1400*b* is followed by the process 214*a*.

Accordingly, both of the voltage boosting opening/closing devices 111*b* in a pair are set to perform on/off operation with the 2nd setting current I2 and the 2nd circuit-opening limit time t2 (or the 2nd attenuated current I02). The process 214*a* is a determination step; in the process 214*a*, the charging monitoring voltage Vf is read and when the charging voltage of the voltage boosting capacitor 112*b* becomes the same as or higher than the target boosted voltage Vh, the result of the determination becomes "YES" and then the process 214*a* is followed by the process 1405*a*; when the charging voltage of the voltage boosting capacitor 112*b* is lower than the boosted voltage Vh, the result of the determination becomes "NO" and then the process 214*a* is followed by the process 1401*a*. When the result of the determination in the process 214*a* has once become "YES", the determination result "YES" is maintained until the charging voltage falls to, for example, 95% of the target boosted voltage Vh or lower. The process 1401*a* is a step in which in the driving mode initially set in the process 1400*b* or in the different driving mode that is obtained through setting change in the after-mentioned process 1405*b*, the first drive command signal Dr1 or the second drive command signal Dr2 is transmitted to one of the voltage boosting opening/closing devices 111*b* so as to apply circuit-closing drive to this voltage boosting opening/closing device 111*b*. The process 211*a* is a determination step in which the exciting current Ix for the induction device to which circuit-closing drive is applied in the process 1401*a* has reached the target 1st setting current I1 or the target 2nd setting current I2; in the case where the exciting current Ix has reached the target current, the result of the determination becomes "YES", and then the process 211*a* is followed by the process 1401*b*; in the case where the exciting current Ix has not reached the target current, the result of the determination becomes "NO", and then the process 211*a* is followed by the process 1404.

The process 1401*b* is a step in which the voltage boosting opening/closing device 111*b* to which circuit-closing drive has been applied in the process 1401*a* is opened; the process 1401*b* is followed by the process 602*a* or the process 211*d*. The process 602*a* is a voltage correction means which is utilized when the circuit-opening time of the voltage boosting opening/closing device 111*b* is set by a timer; in the process 602*a*, the power-source voltage monitoring voltage Vba inputted by way of the multi-channel A/D converter LADC is read and the setting of the circuit-opening limit time is corrected in accordance with the present value of the power-source voltage Vb; then, the process 602*a* is followed by the process 216*bb*. The process 216*bb* is a step in which the first or the second circuit-opening time limiting timer is activated and which is followed by the process 1402; this timer's counting function is performed in the microprocessor CPU. In contrast, in the case where the charging current Ic for the voltage boosting capacitor 112*b* flows into the current detection resistor 111*c* (as represented by a dotted line in FIG. 13), the process 602*a* is not required; in that case, in the process 211*d*, which is the attenuated current setting unit, the present value of the attenuating charging current Ic for the voltage boosting capacitor 112*b* is read; then, the process 211*d* is followed by the process 1402. In the process 1402, it is determined whether or not the counting time of the first or the second circuit-opening time limiting timer has been up after exceeding the 1st circuit-opening limit time t1 or the 2nd circuit-opening limit time t2 or it is determined whether or not the charging current Ic read in the process 211*d* has been attenuated to the target 1st attenuated current I01 or the target 2nd attenuated current I02; in the case where the attenuation has been completed, the result of the determination becomes "YES", and then the process 1402 is followed by the process 1403; in the case where the attenuation has not been completed, the result of the determination becomes "NO", and then the process 1402 is followed by the process 1404.

In the process 1403, the voltage boosting opening/closing device 111*b* that has been opened in the process 1401*b* is closed again, and when the circuit-opening time limiting timer is provided, the present value thereof is reset; then, the process 1403 is followed by the process 1404. The process 1404 is a determination step in which in the case where the first circulation of the intermediate flow from the process 214*a* to the process 1403 is followed by the second circulation thereof, the result of the determination becomes "YES" and which is then followed by the process 214*a*; in the case where the second circulation thereof has been completed, the result of the determination becomes "NO"; then, the process 1404 is followed by the process 1405*a*. In this regard, however, even when in the first circulation or the second circulation, the result of the determination becomes "NO" in the process 211*a* or 1402, the opening/closing control is applied alternately to the voltage boosting opening/closing devices 111*b* in a pair. The process 1405*a* is a determination step in which it is determined whether or not generation of the selection command signal SELx, detected in the process 220*c* described in FIG. 15, has been stored; in the case where the generation has been stored, the result of the determination becomes "YES" and then, the process 1405*a* is followed by the process 1405*b*; in the case where the generation has not been stored, the result of the determination becomes "NO" and then, the process 1405*a* is followed by the process 220*c*. In the process 1405*b*, the 2nd driving mode, which is a common mode, set in the process 1400*b* is cancelled and the driving mode of the first voltage boosting circuit unit 110C1 moves to the 1st driving mode for small-current high-frequency on/off operation, so that the driving mode, different from the driving mode of the second voltage boosting circuit unit 110C2, is selected; then, the process 1405*b* is followed by the operation ending process 1410. In the process block 220*c*, it is detected whether or not the selection command signal SELx has been generated; then, the process block 220*c* is followed by the operation ending process 1410.

Explaining the outline of the operation in the control flow represented in FIG. 14, the process 1400*b* is an initial setting unit in which both the respective driving modes of the first voltage boosting circuit unit 110C1 and the second voltage boosting circuit unit 110C2 are set to the 2nd driving mode for large-current low-frequency on/off operation; accordingly, both the respective target setting currents of the first drive command signal Dr1 and the second drive command signal Dr2 are set to the 2nd setting current I2, and the circuit-opening limit time (or the attenuation setting current) is set to the 2nd circuit-opening limit time t2 (or the 2nd attenuated current I02). In the processes 214*a* through 1404, on/off operation of the voltage boosting opening/closing device 111*b* is performed based on the designated driving mode; however, in the case where in the process 214*a*, which is the voltage boosting comparison determination unit, the charging voltage of the voltage boosting capacitor 112*b* is the target boosted voltage Vh or higher, the on/off operation of the voltage boosting opening/closing device 111*b* is not performed. In the process 211*a*, which is the current comparison determination unit, it is determined whether or not the exciting current Ix for the induction device 111*a* to which energization drive is applied in the process 1401*a* has reached the 2nd setting current I2; in the case where the exciting current Ix has reached the 2nd setting current I2, the voltage boosting opening/closing device 111*b* is opened in the process 1401*b*. At the timing when the 2nd circuit-opening limit time t2 elapses (or at the timing when the exciting current is attenuated to the 2nd attenuated current I02), the process 216*bb*, which is a circuit-opening time limiting means, is followed by the process 1403, where the voltage boosting opening/closing device 111*b* is closed again.

The process block 220*c* functions as the synchronization state detection unit in which it is determined whether or not the respective inductances of the induction devices 111*a* in a pair correspond to each other in such a way as to be within ±5% of the standard value (10% in the variation width); in the case where the respective inductances of the induction devices 111*a* in a pair correspond to each other, the selection command signal SELx is generated and stored. The process 1405*b* is the alteration setting unit in which, for example, the driving mode of the first voltage boosting circuit unit 110C1 is changed to the 1st driving mode for small-current high-frequency on/off operation so that the respective different driving modes are set; accordingly, the 1st setting current (I1<I2), the 1st circuit-opening limit time (t1<t2) (or the 1st attenuated current I01>I02) are set with regard to the first drive command signal Dr1. In addition, in the case where the respective inductances L of the induction devices 111*a* in a pair coincide with each other, the on/off period of the voltage boosting opening/closing device 111*b* in the 2nd driving mode is, for example, 20% longer than that of the voltage boosting opening/closing device 111*b* in the 1st driving mode. Thus, when the respective inductances L differ from each other by ±5% or more, a common driving mode is utilized, and when the variation width of the inductance L is small, different driving modes are utilized, so that excessive current is not continuously generated.

Figure 15:
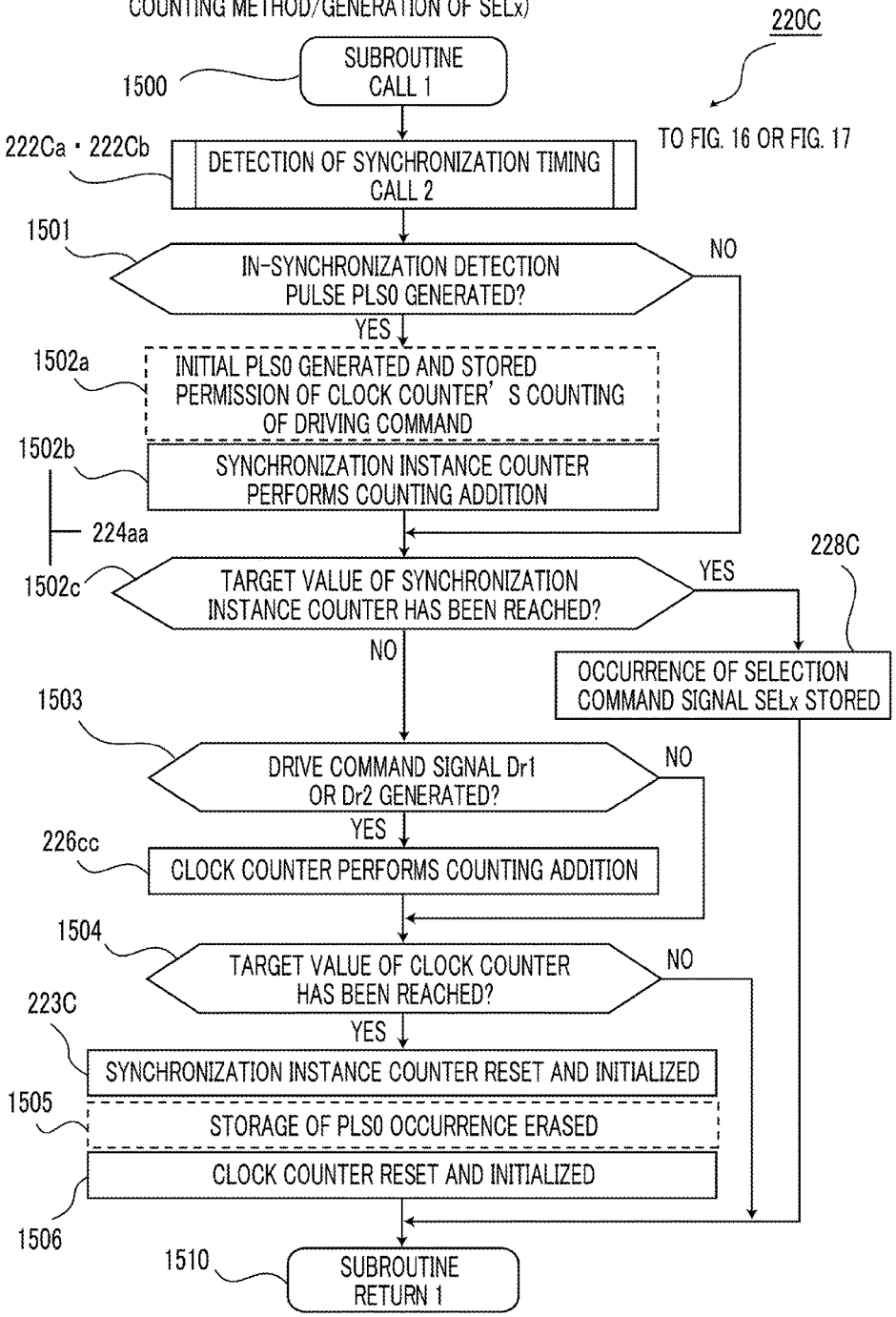
FIG. 15 is a flowchart for explaining the operation of a synchronization state detection unit in FIG. 14.

Next, FIG. 15, which is a flowchart for explaining the operation of the process block 220C, in FIG. 14, that functions as the synchronization state detection unit, will be explained. FIG. 15 includes a clock counter 226*cc*, which corresponds to the clock counter 226*c* represented in FIG. 3, a synchronization timing integration processing means 224*aa*, which corresponds to the synchronization timing integration processing unit 224*a*, and a selection command occurrence storage unit 228C, which corresponds to the selection command occurrence storage unit 228A; as represented in FIG. 8 or FIG. 11, the clock counter that determines the monitoring period SETx counts the number of occurrence instances of the first drive command signal Dr1 or the second drive command signal Dr2 instead of the time counting clock signal 226*t*. Anticipating the case where with regard to the counting input of the clock counter 226*cc*, the gate circuit 226*b* represented in FIG. 8 or FIG. 11 is provided and the case where as represented in FIG. 3, the gate circuit 226*b* is not provided, the initial value of the clock counter is set to 2 or 5 based on whether the gate circuit corresponding means (the process 1502*a*) is provided or not, and in accordance with the setting of the initial value, the counting-up counting value of the synchronization instance counter is set to 2 or 3, as the case may be. In FIG. 15, the process 1500 is a subroutine operation starting process that is implemented when the implementation of the process block 220*c* in FIG. 14 is started; after a series of processes from the process 1500 to a subroutine operation ending process 1510, the process 1510 is followed by the operation ending process 1410 in FIG. 14. The process block 222Ca (or the process block 222Cb) functions as a synchronization timing detection unit represented in FIG. 16 (or FIG. 17); in the process block 222Ca, it is detected whether or not the in-synchronization detection pulse PLS0 has been generated; then, the process block 222Ca is followed by the process 1501.

The process 1501 is a determination step in which it is determined whether or not the in-synchronization detection pulse PLS0 has been generated in the process block 222Ca (or the process block 222Cb); in the case where the in-synchronization detection pulse PLS0 has been generated, the result of the determination becomes "YES", and then, the process 1501 is followed by the process 1502*a* or 1502*b*; in the case where the in-synchronization detection pulse PLS0 has not been generated, the result of the determination becomes "NO", and then, the process 1501 is followed by the process 1502*c*. The process 1502*a* corresponds to the gate circuit 226*b* in FIG. 8 and is utilized when the setting value, of the after-mentioned clock counter 226*cc*, that determines the monitoring period SETx is 2; the process 1502*a* is a step in which when the in-synchronization detection pulse PLS0 is initially generated after the clock counter 226*cc* is reset in the process 1506, the start of counting by the clock counter 226*cc* is permitted and which is then followed by the process 1502*b*; in the case where the process 1502*a* is not provided, the setting value of the clock counter 226*cc* is set to 5. The process 1502*b* is a step in which the synchronization instance counter, which counts the number of occurrence instances of the in-synchronization detection pulse PLS0, perform addition of the present counting; then, the process 1502*b* is followed by the process 1502*c*. The process 1502*c* is a determination step in which the counting value of the synchronization instance counter has reached the target value 2 or 3, which is the setting value thereof; in the case where counting value of the synchronization instance counter has reached the target value 2 or 3, the result of the determination becomes "YES", and then the process 1502*c* is followed by the process 228*c*; in the case where the counting value of the synchronization instance counter has not reached the target value 2 or 3, the result of the determination becomes "NO", and then the process 1502*c* is followed by the process 1503. The processes 1502*b* and 1502*c* configure the synchronization timing integration processing means 224*aa* corresponding to the synchronization timing integration processing unit 224*a* in FIG. 3 or FIG. 8; although in the synchronization timing integration processing unit 224*a*, the integrated charging voltage of the integration capacitor 223*c* is monitored, the counting value of the synchronization instance counter is monitored in the synchronization timing integration processing means 224*aa*.

The process 228*c* is a step, which is the selection command occurrence storage unit that generates and stores the selection command signal SELx; then, the process 228*c* is followed by the subroutine ending process 1510. Sequentially, the subroutine ending process 1510 is followed by the operation ending process 1410 in FIG. 14. The process 1503 is a determination step in which it is determined whether or not the logic level of the first drive command signal Dr1 or the second drive command signal Dr2 becomes "H" in the process 1401*a* or the process 1403 in FIG. 14 so that circuit-closing drive has been applied to the voltage boosting opening/closing device 111*b*; in the case where the driving command has been generated, the result of the determination becomes "YES", and then the process 1503 is followed by the process 226*cc*; in the case where the driving command has not been generated, the result of the determination becomes "NO", and then the process 1503 is followed by the process 1504. The process 226*cc* is a step in which the clock counter performs addition of the occurrence of the first drive command signal Dr1 or the second drive command signal Dr2 and which is followed by the process 1504. The process 1504 is a determination step in which it is determined whether or not the counted addition value calculated in the process 226*cc* has reached 2 or 5, which is an initial setting value; in the case where the counted addition value has reached 2 or 5, the result of the determination becomes "YES", and then the process 1504 is followed by the process 223*c*; in the case where the counted addition value has not reached 2 or 5, the result of the determination becomes "NO", and then the process 1504 is followed by the subroutine ending process 1510; after that, the subroutine ending process 1510 is followed by the operation ending process 1410. In the process 223*c*, the synchronization instance counter that has performed counting addition in the process 1502*b* is reset; the process 1505 is the periodic reset processing unit that resets the in-synchronization detection pulse PLS0 when in the process 1505 or 1502*a*, the occurrence of the in-synchronization detection pulse PLS0 has been stored. In the process 1506, the clock counter itself that has performed counting addition in the process 226*cc* is reset; then, the process 1506 is followed by the subroutine ending process 1510; after than the subroutine ending process 1510 is followed by the operation ending process 1410 in FIG. 14.

Explaining the outline of the operation in the control flow represented in FIG. 15, in the overall control flow, the occurrence frequency of the in-synchronization detection pulse PLS0 detected in the process block 222Ca (or 222Cb) is monitored in a macro or micro manner, and when the occurrence frequency is high, the selection command signal SELx is generated and stored so that the transfer from a common driving mode to a different driving mode is urged; in the case of the macro monitoring, the selection command signal SELx is generated and stored when within 5 periods of the first drive command signal Dr1 or the second drive command signal Dr2, the in-synchronization detection pulse PLS0 is generated thrice or more times; in the case of the micro monitoring, the selection command signal SELx is generated and stored when within 2 periods of the first drive command signal Dr1 or the second drive command signal Dr2 immediately after the in-synchronization detection pulse PLS0 is generated, the in-synchronization detection pulse PLS0 is generated again.

Figure 16:
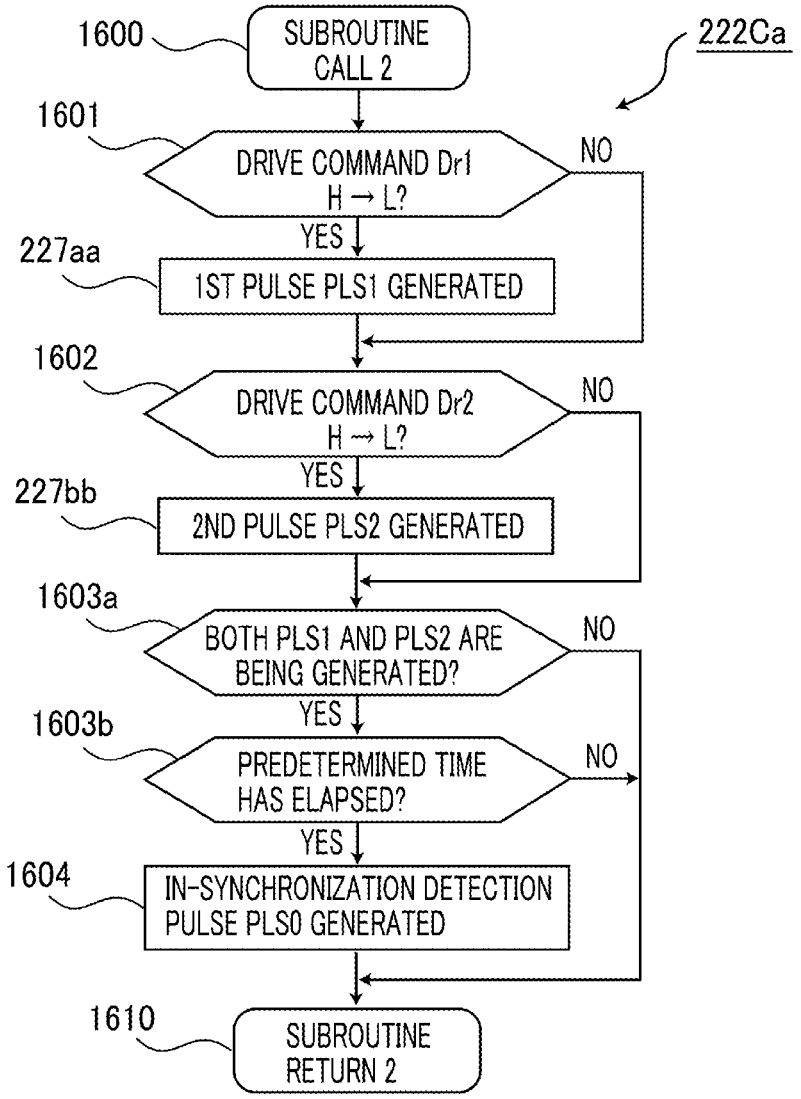
FIG. 16 is a flowchart for explaining the operation of a synchronization timing detection unit in FIG. 15.

Next, FIG. 16, which is a flowchart for explaining the operation of the process block 222Ca, in FIG. 15, that functions as the synchronization timing detection unit, will be explained. FIG. 16, which corresponds to the synchronization timing detection unit 222B in FIG. 11, includes a first pulse generation unit 227*aa* and a second pulse generation unit 227*bb* that correspond to the pulse generating circuit 227*a* and 227*b*, respectively. In FIG. 16, the process 1600 is a subroutine operation starting process that is implemented when the implementation of the process block 222Ca in FIG. 15 is started; after a series of processes from the process 1601 to a subroutine operation ending process 1610, the process 1610 is followed by the process 1501 in FIG. 15. The process 1601 following the process 1600 is a determination step in which it is determined whether or not the logic level of the first drive command signal Dr1 has changed from "H" to "L"; in the case where the logic level of the first drive command signal Dr1 has changed from "H" to "L", the result of the determination becomes "YES", and then the process 1601 is followed by the process 227*aa*; in the case where the logic level of the first drive command signal Dr1 has not changed from "H" to "L", the result of the determination becomes "NO", and then the process 1601 is followed by the process 1602. In the process 227*aa*, a first pulse PLS1 is generated, and then the process 227*aa* is followed by the process 1602; the pulse width of the first pulse PLS1 is a time corresponding to the 1st circuit-opening limit time t1. The process 1602 is a determination step in which it is determined whether or not the logic level of the second drive command signal Dr2 has changed from "H" to "L"; in the case where the logic level of the second drive command signal Dr2 has changed from "H" to "L", the result of the determination becomes "YES", and then the process 1602 is followed by the process 227*bb*; in the case where the logic level of the second drive command signal Dr2 has not changed from "H" to "L", the result of the determination becomes "NO", and then the process 1602 is followed by the process 1603*a*. In the process 227*bb*, a second pulse PLS2 is generated, and then the process 227*bb* is followed by the process 1603*a*; the pulse width of the second pulse PLS2 is a time corresponding to the 2nd circuit-opening limit time t2.

The process 1603*a* is a determination step in which it is determined whether or not both the respective output logics of the first pulse PLS1 and the second pulse PLS2 are "H"; in the case where both the respective output logics of the first pulse PLS1 and the second pulse PLS2 are "H", the result of the determination becomes "YES", and then, the process 1603*a* is followed by the process 1603*b;* in the case where both the respective output logics of the first pulse PLS1 and the second pulse PLS2 are not "H", the result of the determination becomes "NO", the process 1603*a* is followed by the subroutine ending process 1610, and then the subroutine ending process 1610 is followed by the process 1501 in FIG. 15. The process 1603*a* corresponds to the logic combining circuit 227*c* in FIG. 11. The process 1603*b* is a determination step in which it is determined whether or not the state where both the respective output logics of the first pulse PLS1 and the second pulse PLS2 are "H" has continued for a predetermined time or longer; in the case where the state has continued for a predetermined time or longer, the result of the determination becomes "YES", and then, the process 1603*b* is followed by the process 1604; in the case where the state has not continued for a predetermined time or longer, the result of the determination becomes "NO", and the process 1603*b* is followed by the subroutine ending process 1610, and after that, the subroutine ending process 1610 is followed by the process 1501 in FIG. 15. The process 1603*b* functions as a dominant logic confirming determination unit. In the dominant logic confirming determination unit, the time of the state where both the respective output logics of the first pulse PLS1 and the second pulse PLS2 are "H" is set to be shorter than the time period of the first pulse PLS1 but longer than 50% thereof. The process 1604 is a step that functions as an in-synchronization detection pulse generation unit in which when the state where both the respective output logics of the first pulse PLS1 and the second pulse PLS2 are "H" has continued for a predetermined time or longer, the in-synchronization detection pulse PLS0 having the output logic of "L" is generated; the process 1604 is followed by the subroutine ending process 1610, and then the subroutine ending process 1610 is followed by the process 1501 in FIG. 15.

Explaining the outline of the operation in the control flow represented in FIG. 16, the overall control flow is a means, for generating the in-synchronization detection pulse PLS0, that corresponds to the synchronization timing detection unit 222B in FIG. 11. In this regard, however, although in the case of FIG. 11, the in-synchronization detection pulse PLS0 is smoothed by the integration capacitor 223*c* when the pulse width thereof is short, the synchronization instance counter simply performs counting addition of the in-synchronization detection pulse PLS0, obtained through the process 1604 in FIG. 16, in the process 1502*b* in FIG. 15. Accordingly, the process 1603*b* functions as a filter for preventing a response to a minimum-time synchronization state.

Figure 17:
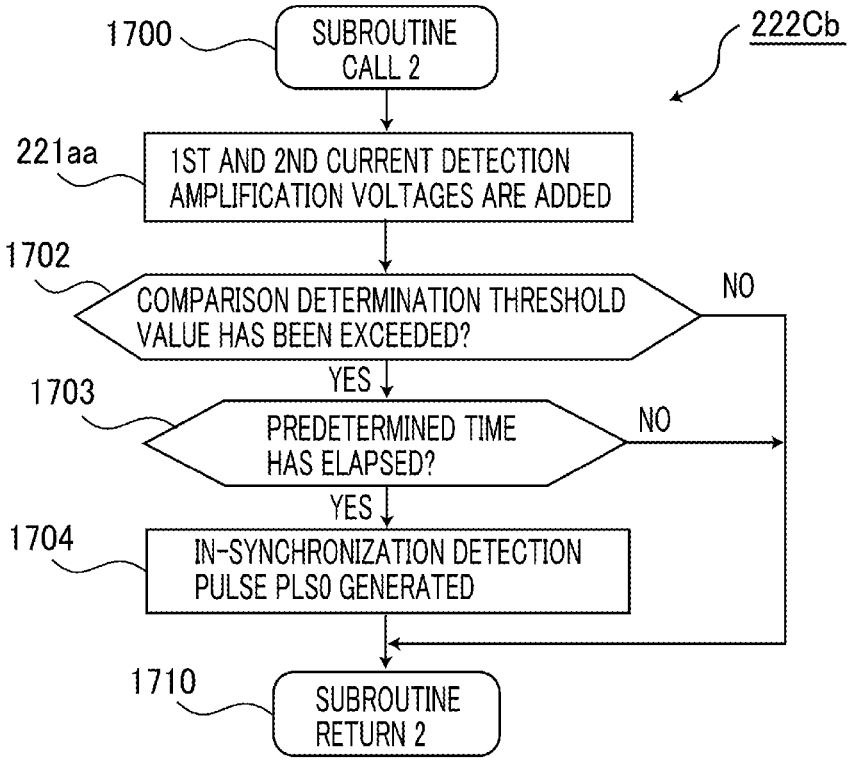
FIG. 17 is a flowchart, replacing FIG. 16, for explaining the operation of a synchronization timing detection unit according to a variant Embodiment.

Next, FIG. 17, which is a flowchart for explaining the operation of the process block 222Cb, in FIG. 15, that functions as the synchronization timing detection unit, will be explained. FIG. 17 corresponds to the synchronization timing detection unit 222A in FIG. 3 or FIG. 8 and includes an addition processing unit 221*aa* that corresponds to the addition processing unit 221*a* in FIG. 3 or FIG. 8. In FIG. 17, the process 1700 is a subroutine operation starting process that is implemented as the implementation of the process 222Cb in FIG. 15 starts; after a series of processes following it, the process 1700 is followed by the subroutine operation ending process 1710; then, the subroutine operation ending process 1710 is followed by the process 1501 in FIG. 15. The process 221*aa* following the process 1700 is an addition processing unit that performs digital addition of the respective digital conversion values of the first and second current detection amplification voltages Vc11 and Vc21 in FIG. 13. The process 1702 is a determination step in which it is determined whether or not the digital addition value obtained in the process 221*aa* has exceeded an addition value determination threshold value; in the case where the digital addition value has exceeded the addition value determination threshold value, the result of the determination becomes "YES", and then, the process 1702 is followed by the process 1703; in the case where the digital addition value has not exceeded the addition value determination threshold value, the result of the determination becomes "NO", and the process 1702 is followed by the subroutine ending process 1710; then, the subroutine ending process 1710 is followed by the process 1501 in FIG. 15. The addition value determination threshold value in the process 1702 is a predetermined value that is approximately 70% of the maximum addition value obtained in the process 221*aa*.

The process 1703 is a determination step in which it is determined whether or not the comparison exceedance state in the process 1702 has continued for a predetermined time period or longer; in the case where the state has continued for a predetermined time or longer, the result of the determination becomes "YES", and then, the process 1703 is followed by the process 1704; in the case where the state has not continued for a predetermined time or longer, the result of the determination becomes "NO", and the process 1703 is followed by the subroutine ending process 1710, and after that, the subroutine ending process 1710 is followed by the process 1501 in FIG. 15. The process 1703 functions as an exceedance determination/confirmation unit. In the exceedance determination/confirmation unit, the time period is set to a time that is shorter than the 1st circuit-opening limit time t1 or the time required for the attenuation to the 1st attenuated current I01 but is the same as or longer than 50% thereof. The process 1704 is a step that functions as an in-synchronization detection pulse generation unit in which when the state where the addition current is the same as or larger than a predetermined value has continued for a predetermined time or longer, the in-synchronization detection pulse PLS0 having the output logic of "L" is generated; the process 1704 is followed by the subroutine ending process 1710, and then the subroutine ending process 1710 is followed by the process 1501 in FIG. 15.

Explaining the outline of the operation in the control flow represented in FIG. 17, the overall control flow is a means, for generating the in-synchronization detection pulse PLS0, that corresponds to the synchronization timing detection unit 222A in FIG. 3. In this regard, however, although in the case of FIG. 3, the in-synchronization detection pulse PLS0 is smoothed by the integration capacitor 223*c* when the pulse width thereof is short, the synchronization instance counter simply performs counting addition of the in-synchronization detection pulse PLS0, obtained through the process 1704 in FIG. 17, in the process 1502*b* in FIG. 15. Accordingly, the process 1703 functions as a filter for preventing a response to a minimum-time synchronization state.

As is clear from the foregoing explanation, in the synchronization timing detection unit 222Ca or 222Cb represented in FIG. 16 or FIG. 17, as the case may be, the in-synchronization detection pulse PLS0 is generated; in the synchronization state detection unit 220C represented in FIG. 15, the occurrence frequency of the in-synchronization detection pulse PLS0 is monitored; in the case where the occurrence frequency is high, the selection command signal SELx is generated so that in the process 1405*a* in FIG. 14, the driving modes are changed. The determination method for the occurrence frequency of the in-synchronization detection pulse PLS0 includes the macro-monitoring method and the micro-monitoring method, distinguished from each other based on the length of the monitoring period SETx; as a variant Embodiment of the micro-monitoring method, an after-mentioned adjacent pulse monitoring method can be adopted. In other words, the selection command occurrence storage unit stores occurrence of the in-synchronization detection pulse PLS0, and generates and stores the selection command signal SELx when the in-synchronization detection pulse PLS0 is recurrently and continuously generated; in the case where after the in-synchronization detection pulse PLS0 has been generated and stored, the next in-synchronization detection pulse PLS0 is not generated before any one of the voltage boosting opening/closing devices 111*b* in a pair completes its opening/closing operation, the periodic reset processing unit erases the occurrence storage of the immediately previous in-synchronization detection pulse PLS0.

(2) Explanation for the Operation/Action of Variant Embodiment

Figure 18:
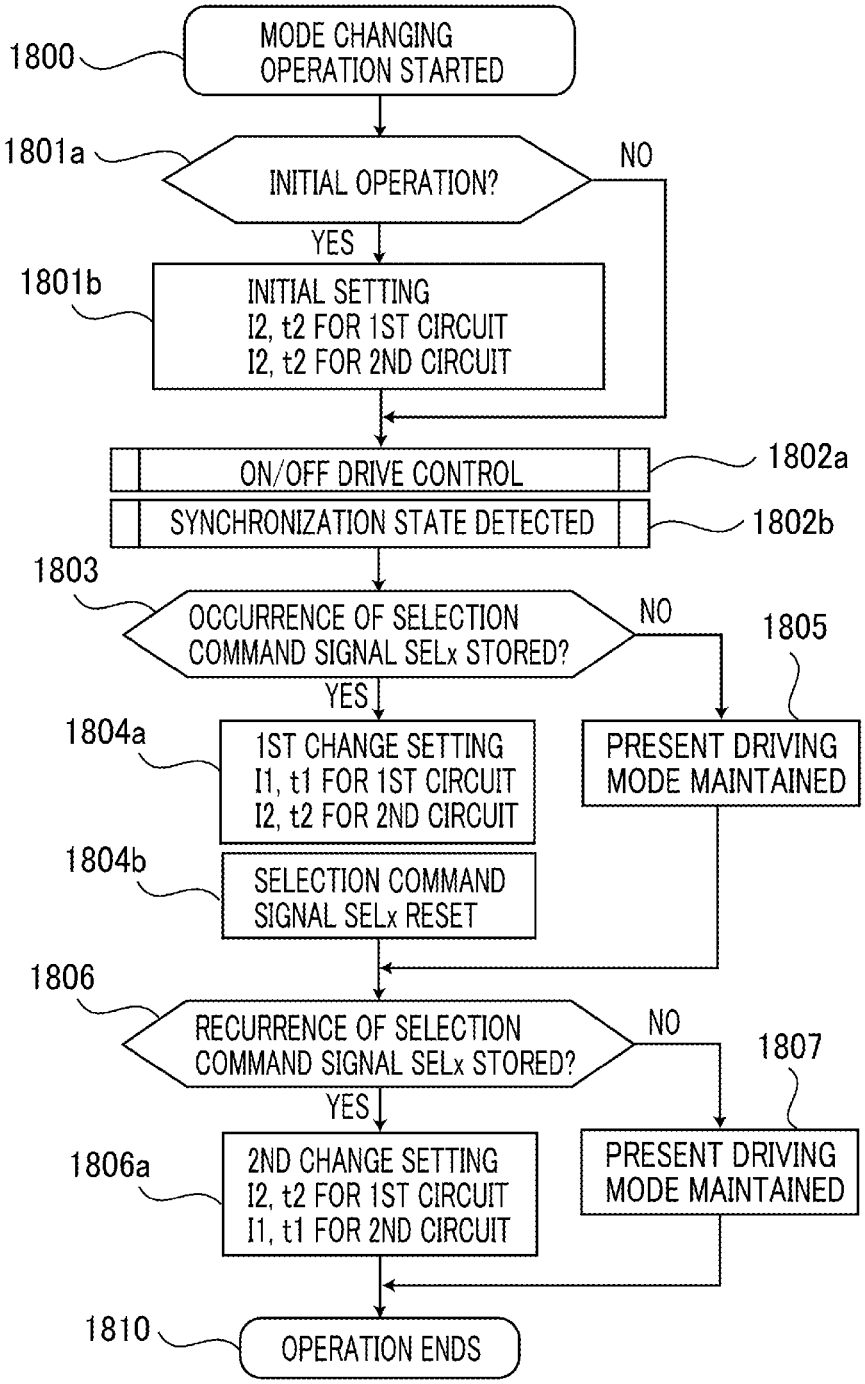
FIG. 18 is a flowchart for explaining the operation of a variant embodiment with regard to driving mode selection operation of each of Embodiments 1 through 3.

Next, with reference to FIG. 18, which is a flowchart for explaining the operation of a variant embodiment with regard to driving mode selection operation of each of Embodiments 1 through 3, the action and operation thereof will be explained in detail. In FIG. 18, the process 1800 is a start step for mode changing control operation of the microprocessor CPU; the microprocessor CPU recurrently implements the process block from the operation starting process 1800 to the operation ending process 1810. The process 1801*a* is a determination step in which it is determined whether or not the present control operation is the initial control operation; in the case where the present control operation is the initial control operation, the result of the determination becomes "YES", and then, the process 1801*a* is followed by the process 1801*b*; in the case where the present control operation is not the initial control operation, the result of the determination becomes "NO", and then the process 1801*a* is followed by the process 1802*a*. The process 1801*b* is an initial setting unit in which both the respective driving modes of the first voltage boosting control unit (210A1, 210AA1, 210B1, 210C1) and the second voltage boosting control unit (210A2, 210AA2, 210B2, 210C2) are set to the 2nd driving mode for large-current low-frequency on/off operation; then, the process 1801*b* is followed by the process block 1802*a*. The process block

1802*a* is a control block related to the opening/closing operation control of a pair of voltage boosting opening/closing devices 111*b*; the process block 1802*b* is a control block related to the synchronization state detection operation for generating the selection command signal SELx.

The process 1803 is a determination step; in the case where in the process block 1802*b*, the selection command signal SELx is generated, the result of the determination becomes "YES", the process 1803 is followed by the process 1804*a*; in the case where the selection command signal SELx is not generated, the result of the determination becomes "NO", and then the process 1803 is followed by the process 1805. The process 1804*a* is a 1st alteration setting unit in which setting of the driving mode of the first voltage boosting control unit (210A1, 210AA1, 210B1, 210C1) is changed to the 1st driving mode for small-current high-frequency on/off operation and the driving mode of the second voltage boosting control unit (210A2, 210AA2, 210B2, 210C2) is left set to the 2nd driving mode for large-current low-frequency on/off operation; the process 1804*a* is followed by the process 1804*b*. The process 1804*b* is a step in which the selection command signal SELx generated in the process block 1802*b* is reset; the process 1804*b* is followed by the process 1806. The process 1805 is a step in which the driving mode that has been set in the process 1801*b*, 1804*a*, or 1806*a* is maintained and which is then followed by the process 1806. The process 1806 is a determination step; in the case where in the process block 1802*b*, the selection command signal SELx is generated, the result of the determination becomes "YES", the process 1806 is followed by the process 1806*a*; in the case where the selection command signal SELx is not generated, the result of the determination becomes "NO", and then the process 1806 is followed by the process 1807.

The process 1806*a* is a 2nd alteration setting unit in which setting of the driving mode of the first voltage boosting control unit (210A1, 210AA1, 210B1, 210C1) is changed to the 2nd driving mode for large-current low-frequency on/off operation and setting of the driving mode of the second voltage boosting control unit (210A2, 210AA2, 210B2, 210C2) is changed to the 1st driving mode for small-current high-frequency on/off operation; the process 1806*a* is followed by the process 1810. The process 1807 is a step in which the driving mode that has been set in the process 1801*b*, 1804*a*, or 1806*a* is maintained and which is then followed by the process 1810. In the foregoing explanation, it may be allowed that as the initial setting in the process 1801*b*, both the driving mode of the first voltage boosting control unit (210A1, 210AA1, 210B1, 210C1) and the driving mode of the second voltage boosting control unit (210A2, 210AA2, 210B2, 210C2) are set to the 1st driving mode for small-current high-frequency on/off operation and then, in the process 1804*a* or 1806*a*, setting of the driving mode of any one of the first voltage boosting control unit and the second voltage boosting control unit is changed to the 2nd driving mode for large-current low-frequency on/off operation. The 1st on/off period T01 for the voltage boosting opening/closing device 111*b* in the 1st driving mode and the 2nd on/off period T02 for the voltage boosting opening/closing device 111*b* in the 2nd driving mode are set in such a way that the relationship "T02>T01" is established; however, the actual on/off period increases or decreases in proportion to the inductance value L of the induction device 111*a*.

Accordingly, provided the respective inductance values L of the induction devices 111*a* in a pair coincide with each other at a time when the drive is performed in a common mode based on the initial setting, the selection command signal SELx is generated, as a matter of course, and hence the driving modes move to different driving modes; after that, because no continuous synchronization occurs, the selection command signal SELx is not generated. In contrast, in the case where the respective inductances L of the induction devices 111*a* in a pair largely differ from each other, the selection command signal SELx is not generated even when the driving mode based on the initial setting is maintained and hence the drive is continued in the same driving mode. However, in the case where the respective inductances L of the induction devices 111*a* in a pair slightly differ from each other, the selection command signal SELx is generated, depending on the level of the difference, and hence the driving modes move to different driving modes; in this situation, the problem is that it is uncertain which one of the respective inductances L of the induction devices 111*a* is larger than the other one; provided the driving mode of the voltage boosting control unit corresponding to a larger inductance L (the on/off period becomes longer) is set to the 1st driving mode (the on/off period becomes shorter) and the driving mode of the voltage boosting control unit corresponding to a smaller inductance L is set to the 2nd driving mode, the effect of the mode change is reduced and hence escape from the continuous synchronization state may not be implemented. When the 2nd on/off period T02 is set to be sufficiently larger than the 1st on/off period T01, this problem is avoided; however, when the relationship "T02»T01" is established and when the driving mode of the voltage boosting control unit corresponding to a smaller inductance L (the on/off period becomes shorter) is set to the 1st driving mode (the on/off period becomes shorter) and the driving mode of the voltage boosting control unit corresponding to a larger inductance L is set to the 2nd driving mode, there is posed a problem that the difference between one of the on/off periods and the other one thereof becomes excessive and hence the voltage boosting opening/closing device 111*b* having a shorter on/off period is abnormally overheated.

According to the control operation represented in FIG. 18, in the case where due to reduction of the effect of the mode change, escape from the continuous synchronization state cannot be performed, the selection command signal SELx, which has been once reset, is generated again; therefore, at this moment, the driving mode of the voltage boosting control unit corresponding to a larger inductance L (the on/off period becomes longer) is set to the 2nd driving mode (the on/off period becomes longer) and the driving mode of the voltage boosting control unit corresponding to a smaller inductance L is set to the 1st driving mode, so that the effect of the mode change is enhanced and hence escape from the continuous synchronization state can be performed even when the 1st on/off period T01 is not set to be excessively short. In the case where as described above, both the 1st alteration setting unit 1804*a* and the 2nd alteration setting unit 1806*a* are provided, the driving pulses for determining the monitoring period SETx is unified to the first drive command signal Dr1 or the second drive command signal Dr2 for the voltage boosting control unit to which the 2nd driving mode is applied; for that purpose, it is desirable that in the initial setting, the driving mode is set to a common driving mode based on the 2nd driving mode. However, in the case where the monitoring period SETx is set through the time counting clock signal 226*t* (refer to FIG. 3), it is only necessary to unify the monitoring period SETx to a period corresponding to the 2nd driving mode.

In the foregoing explanation, the vehicle engine control system according to each of Embodiments 1 through 3 and the variant embodiments thereof is the one with which part of the diverse combinations of the various constituent elements is proposed. One of the selectable constituent elements is whether the circuit-opening time setting timer is utilized for the energization cutoff timing of the voltage boosting opening/closing device or an attenuated current setting method is utilized therefor; furthermore, there exists an option whether the energization cutoff timing is set by hardware or by a microprocessor. Another one of the selectable constituent elements is whether the addition value of the exciting currents are monitored or the overlapping state of the pulse signals at a cutoff timing is monitored for detecting a synchronization timing; furthermore, there exists an option whether the energization cutoff timing is set by hardware or by a microprocessor. Another one of the selectable constituent elements is that there exists an option whether setting of the monitoring period SETx is implemented by a timer or through the number of occurrence instances of the drive command signal; furthermore, there exists an option whether the energization cutoff timing is set by hardware or by a microprocessor. Another one of the selectable constituent elements is that there exists an option whether synchronization state determination is performed through macro monitoring or through micro monitoring; furthermore, there exists an option whether the energization cutoff timing is set by hardware or by a microprocessor. On top of that, there exists another option, for example, whether the integration of the synchronization timing is performed by the integration capacitor or by a counter; in addition to the proposed embodiments, various embodiments are conceivable.

(2) Gists and Features of Embodiment 3 and Variant Embodiments of Each Embodiment As is clear from the foregoing explanation, in order to drive the respective fuel-injection electromagnetic valves 103 provided in the cylinders of a multi-cylinder engine, the vehicle engine control system 100C according to Embodiment 3 of the present invention includes the driving control circuit units 120X and 120Y for two or more electromagnetic coils 31 through 34 for driving respective corresponding electromagnetic valves, the first voltage boosting circuit unit 110C1 and the second voltage boosting circuit unit 110C2, and the calculation control circuit unit 130C formed mainly of the microprocessor CPU. The first and second voltage boosting circuit units 110C1 and 110C2 include the first voltage boosting control unit 210C1 and the second voltage boosting control unit 210C2, respectively, that operate independently from each other, a pair of induction devices 111*a* that are on/off-excited by the first voltage boosting control unit 210C1 and the second voltage boosting control unit 210C2, respectively, a pair of respective charging diodes 112*a* that are connected in series with the respective corresponding induction devices 111*a* in a pair, and one voltage boosting capacitor 112*b* or a plurality of voltage boosting capacitors 112*b* that are connected in parallel with each other; each of the voltage boosting capacitors 112*b* is charged by way of the corresponding charging diode 112*a* in a pair by an induction voltage caused through cutting off of the exciting current Ix for the corresponding induction device 111*a* in a pair, and is charged up to the predetermined boosted voltage Vh through a plurality of the on/off exciting actions.

The first voltage boosting control unit 210C1 and the second voltage boosting control unit 210C2 include a pair of respective voltage boosting opening/closing devices 111*b* that are connected in series with the respective corresponding induction devices 111*a* in a pair to be connected with the vehicle battery 101 and that perform on/off control of the respective corresponding induction devices 111*a* in a pair, a pair of respective current detection resistors 111*c* in which the respective exciting currents Ix flow, a pair of current comparison determination units 211*a* that cut off energization of one of or both of the pair of voltage boosting opening/closing devices 111*b* when after circuit-closing drive is applied to one of or both of the pair of voltage boosting opening/closing devices 111*b*, the exciting current Ix reaches a target setting current or larger, a pair of circuit-opening time limiting units that perform circuit-closing drive of one of or both of the pair of voltage boosting opening/closing devices 111*b* when after energization of one of or both of the pair of voltage boosting opening/closing devices 111*b* is cut off, a predetermined setting time or a predetermined current attenuation time elapses, and the respective voltage boosting comparison determination units 214*a* that prohibit circuit-closing drive of the respective corresponding voltage boosting opening/closing devices 111*b* in a pair when the respective voltages across the corresponding voltage boosting capacitors 112*b* become a predetermined threshold value voltage or higher. The circuit-opening time limiting unit is the circuit-opening time limiting means 216*bb*, which counts the setting time in the microprocessor CPU, or the attenuated current setting unit 211*d* that adopts, as the current attenuation time, the time in which the exciting current Ix is attenuated to a predetermined attenuated current value.

In addition, in accordance with the 1st setting current I1, which is the target setting current, and the 2nd setting current I2, which is a value larger than the 1st setting current I1, the 1st circuit-opening limit time t1, which is the setting time, and the 2nd circuit-opening limit time t2, which is a time longer than the 1st circuit-opening limit time t1, or the 1st attenuated current I01, which is the attenuated current value, and the 2nd attenuated current I02, anyone of the 1st driving mode for small-current high-frequency on/off operation based on the 1st setting current I1 and the 1st circuit-opening limit time t1 or the 1st attenuated current I01 and the 2nd driving mode for large-current low-frequency on/off operation based on the 2nd setting current I2 and the 2nd circuit-opening limit time t2 or the 2nd attenuated current I02 is applied to one of and the other one of the first voltage boosting control unit 210C1 and the second voltage boosting control unit 210C2; furthermore, the synchronization state detection unit 220C that detects and stores the state where the circuit-opening timings for the pair of voltage boosting opening/closing devices 111*b* are continuously close to each other and that generates the selection command signal SELx is provided in each of the first voltage boosting control unit 210C1 and the second voltage boosting control unit 210C2; the microprocessor CPU includes the initial setting unit 1400*b* that sets the driving modes of the first voltage boosting control unit 210C1 and the second voltage boosting control unit 210C2 to a common driving mode, which is any one of the 1st driving mode and the 2nd driving mode, until the time when the selection command signal SELx is generated and the alteration setting unit 1405*b* that sets the driving modes of the first voltage boosting control unit 210C1 and the second voltage boosting control unit 210C2 to respective different driving modes, which are any one of the 1st driving mode and the 2nd driving mode and the other one thereof, after the time when the selection command signal SELx is generated.

The calculation control circuit unit 130C includes the high-speed A/D converter HADC that receives the first current detection amplification voltage Vc11 and the second current detection amplification voltage Vc21, obtained by amplifying the respective voltages across the current detection resistors 111*c* in a pair, and the charging monitoring voltage Vf, proportional to the voltage across the voltage boosting capacitor 112*b*, and that performs digital conversion for each channel and then inputs the digitalized first current detection amplification voltage Vc11, the digitalized second current detection amplification voltage Vc21, and the digitalized charging monitoring voltage Vf to the microprocessor CPU, and the program memory PGM that includes the voltage boosting control program CNT and collaborates with the microprocessor CPU; the voltage boosting control program CNT includes the current comparison determination units 211*a*, the voltage boosting comparison determination units 214*a*, the circuit-opening time limiting means 216*bb* or the attenuated current setting unit 211*d*, and a control program that functions as the synchronization state detection unit 220C; the synchronization state detection unit 220C includes the synchronization timing detection unit 222Ca (222Cb) that generates the in-synchronization detection pulse PLS0 when before and after the circuit-opening timings for the voltage boosting opening/closing devices 111*b* in a pair, the circuit-opening timings for the voltage boosting opening/closing devices 111*b* in a pair are close to each other, the synchronization timing integration processing means 224*aa* that generates the selection command signal SELx, the selection command occurrence storage unit 228C that stores the occurrence of the selection command signal SELx, and the periodic reset processing unit 223C; the synchronization timing integration processing means 224*aa* is a synchronization instance counter that determines that the continuous synchronization state where the circuit-opening timings of the voltage boosting opening/closing devices 111*b* in a pair are continuously close to each other has occurred, when the counting value of the number of occurrence instances of the in-synchronization detection pulse PLS0 exceeds a predetermined threshold value of 2 to 3, and then generates the selection command signal SELx; the periodic reset processing unit 223C includes the clock counter 226*cc* that periodically resets the present number of occurrence instances of the synchronization timings counted by the synchronization timing integration processing unit 224*aa* and that prevents the selection command signal SELx from being generated when the occurrence frequency of the in-synchronization detection pulse PLS0 generated by the synchronization timing detection unit 222C is low.

As described above, with regard to claim 7 of the present invention, the first current detection amplification voltage, the second current detection amplification voltage, and the charging monitoring voltage of the voltage boosting capacitor are inputted to the microprocessor by way of the high-speed A/D converter; the synchronization state detection unit, the function of which is implemented by the microprocessor, monitors the occurrence frequency of the in-synchronization detection pulse generated by the synchronization timing detection unit, before and after the circuit-opening timings of the voltage boosting opening/closing devices in a pair, and the selection command occurrence storage unit generates and stores the selection command signal. Thus, because it is only necessary to determine whether or not the selection command signal is to be generated and stored in a time period over the two or more occurrence periods of the first drive command signal Dr1 or the second drive command signal Dr2, there is demonstrated a characteristic that the load on high-speed determination control is reduced. Moreover, because in the calculation control circuit unit, the respective functions of almost all part of the first and second voltage boosting circuit units and all part of the synchronization state detection unit are implemented by the control program of the microprocessor, there is demonstrated a characteristic that the load on the hardware for the voltage boosting control is reduced.

The synchronization timing detection unit 222Ca includes the first and second pulse generating units 227*aa* and 227*bb* that generate pulse signals having a predetermined time period when the states of the first drive command signal Dr1 and the second drive command signal Dr2 for applying circuit-closing drive to the respective voltage boosting opening/closing devices 111*b* in a pair become the circuit-opening command state, and the in-synchronization detection pulse generation unit 1604 that generates the in-synchronization detection pulse PLS0 when the predominant logic confirming determination unit 1603*b* confirms that both the pulse signals in a pair that are generated by the first and second pulse generating units are predominant logic; the time period of each of the pulse signals to be generated by the first and second pulse generating units 227*aa* and 227*bb* is the same as or longer than the 1st circuit-opening limit time t1 and is the same as or shorter than the 2nd circuit-opening limit time t2.

As described above, with regard to claim 8 of the present invention, the synchronization timing detection unit generates a pulse signal having a predetermined time period when each of the voltage boosting opening/closing devices in a pair is opened, and generates the in-synchronization detection pulse when both of the pulse signals in a pair are predominant. Therefore, there is demonstrated a characteristic that it is determined whether or not the respective circuit-opening timings of the voltage boosting opening/closing devices in a pair are close to each other, based on the length of the overlap between the pulse signals that each are generated immediately after the circuit-opening timing, and that based on whether or not this state continues, the synchronization state can be determined. Moreover, there is demonstrated a characteristic that in the case where the respective circuit-opening time limiting means generate the 1st circuit-opening limit time t1 and the 2nd circuit-opening limit time t2, the circuit-opening time limiting means can directly be utilized as the pulse generating circuits in a pair. Furthermore, because in the case where the length of the overlap between the respective pulse signals in a pair is too short, the predominant logic confirming determination unit prohibits the in-synchronization pulse from being generated, there is demonstrated a characteristic that the occurrence of the synchronization state can accurately be detected.

The synchronization timing detection unit 222Cb includes the addition processing unit 221*aa* that calculates the digital addition value of the first and second current detection amplification voltages Vc11 and Vc21 and the in-synchronization detection pulse generation unit 1704 that generates the in-synchronization detection pulse PLS0 when the exceedance determination/confirmation unit 1703 confirms that the result of the addition by the addition processing unit 221*aa* has exceeded a comparison determination threshold value. The comparison determination threshold value is a value that is the same as or larger than 70% of the result of the addition but smaller than the maximum value of the result of the addition. As described above, with regard to claim 9 of the present invention, the synchronization timing detection unit generates the in-synchronization detection pulse when the addition value of the exciting currents for a pair of induction devices exceeds the comparison determination threshold value. Therefore, there is demonstrated a characteristic that it is determined whether or not the respective circuit-opening timings of the voltage boosting opening/closing devices in a pair are close to each other, based on the level of the addition value of the peak values of the exciting currents in the state immediately before the circuit-opening timing, and that based on whether or not this state continues, the synchronization state can be determined. Furthermore, because in the case where the time in which the comparison determination threshold value is exceeded is too short, the exceedance determination/confirmation unit prohibits the in-synchronization pulse from being generated, there is demonstrated a characteristic that the occurrence of the synchronization state can accurately be detected.

The periodic reset processing unit 223C includes the clock counter 226*cc* that counts the number of occurrence instances of the first drive command signal Dr1 or the second drive command signal Dr2 for performing circuit-closing drive of corresponding one of the voltage boosting opening/closing devices 111*b* in a pair; the clock counter 226*cc* operates while utilizing the time, as the monitoring period SETx, that corresponds to a period that is five times as long as the occurrence period of the first drive command signal Dr1 or the second drive command signal Dr2 in the common driving mode, and periodically and forcibly resets the present number of occurrence instances of the in-synchronization detection pulse PLS0 to be counted by the synchronization timing integration processing means 224*aa*, each time the time to be monitored reaches the monitoring period SETx; when the forcible reset has been completely implemented, the clock counter 226*cc* resets its own present counting value and then recurrently performs the following counting operation at least until the selection command signal SELx is generated; when the number of occurrence instances of the in-synchronization detection pulse PLS0 is three or larger in the interval between a time of the immediately previous forcible reset and a time of the present forcible reset, the synchronization timing integration processing means 224*aa* generates the selection command signal SELx.

As described above, with regard to claim 10 of the present invention, every monitoring period SETx corresponding to a period that is five times as long as the period of the driving command signal for the voltage boosting opening/closing device, the periodic reset processing unit periodically resets the number of occurrence instances of the in-synchronization detection pulse PLS0 integrated by the synchronization timing integration processing means; when the number of occurrence instances of the in-synchronization detection pulse PLS0 is three or larger in the interval between a time of the immediately previous forcible reset and a time of the present forcible reset, the synchronization timing integration processing means generates the selection command signal SELx. Therefore, there is demonstrated a characteristic that because the number of occurrence instances of the in-synchronization detection pulse PLS0 is three or larger, which is the same as or larger than half the number of occurrence instances of the driving command signal, in the interval that is five times as longer as the period of the driving command signal for the voltage boosting opening/closing device in the 2nd driving mode, it can be determined that the state where the respective periods of the first drive command signal Dr1 and the second drive command signal Dr2 are close to each other and hence the addition value of the respective exciting currents for the induction devices in a pair becomes excessive is continuing.

The periodic reset processing unit 223C includes the clock counter 226*cc* that counts the number of occurrence instances of the first drive command signal Dr1 or the second drive command signal Dr2 for performing circuit-closing drive of corresponding one of the voltage boosting opening/closing devices 111*b* in a pair; the clock counter 226*cc* operates while utilizing the time, as the monitoring period SETx, that is a time period between a time when in the common driving mode, the in-synchronization detection pulse PLS0 is generated and a time when any one of the first drive command signal Dr1 and the second drive command signal Dr2 is newly generated once or twice, and periodically and forcibly resets the present number of occurrence instances of the in-synchronization detection pulse PLS0 to be counted by the synchronization timing integration processing means 224*aa*, each time the time to be monitored reaches the monitoring period SETx; when the forcible reset has been completely implemented, the clock counter 226*cc* resets its own present counting value; then, at least until the selection command signal SELx is generated, the clock counter 226*cc* recurrently performs the time counting operation even after the occurrence of the in-synchronization detection pulse PLS0, which is generated thereafter, is stored; when the number of occurrence instances of the in-synchronization detection pulse PLS0 is two or larger in the interval between a time of the immediately previous forcible reset and a time of the present forcible reset, the synchronization timing integration processing means 224*aa* generates the selection command signal SELx.

As described above, with regard to claim 11 of the present invention, after the present in-synchronization detection pulse PLS0 has been generated, every resetting period corresponding to one or two periods of the driving command signal for the voltage boosting opening/closing device, the periodic reset processing unit periodically resets the number of occurrence instances of the in-synchronization detection pulse PLS0, integrated by the synchronization timing integration processing means; when the number of occurrence instances of the in-synchronization detection pulse PLS0 is two or larger in the interval between a time of the immediately previous forcible reset and a time of the present forcible reset, the synchronization timing integration processing means generates the selection command signal SELx. Therefore, there is demonstrated a characteristic that because after the immediately previous in-synchronization detection pulse PLS0 has been generated, the following in-synchronization detection pulse PLS0 is generated before the two period of the first drive command signal Dr1 or the second drive command signal Dr2 elapses, it can be determined that the state where the respective periods of the first drive command signal Dr1 and the second drive command signal Dr2 are close to each other and hence the addition value of the respective exciting currents for the induction devices in a pair becomes excessive is continuing. As described in each of Embodiments 1 and 2, in the case where the synchronization timing integration processing unit including the integration capacitor is utilized, the width of the in-synchronization detection pulse PLS0 changes depending on the length of the overlap between the respective waveforms of the exciting currents; therefore, it is desirable that two narrow-width pulses are regarded as one wide-width pulse and the determination is performed twice every two periods or more frequently; in the case where such a synchronization instance counter as describe in Embodiment 3 is utilized, it is desirable that the determination is performed twice every one period or more frequently.

The microprocessor CPU includes the initial setting unit 1801*b* that sets the driving modes of the first voltage boosting control unit 210A1 (210AA1 through 210C1) and the second voltage boosting control unit 210A2 (210AA2 through 210C2) to a common driving mode, which is any one of the 1st driving mode and the 2nd driving mode, until the time when the selection command signal SELx is generated, the 1st alteration setting unit 1804*a* that sets the driving modes of the first voltage boosting control unit 210A1 (210AA1 through 210C1) and the second voltage boosting control unit 210A2 (210AA2 through 210C2) to respective different driving modes, which are any one of the 1st driving mode and the 2nd driving mode and the other one thereof, after the time when the selection command signal SELx is generated, the 2nd alteration setting unit 1806*a* that sets the driving modes of the first voltage boosting control unit 210A1 (210AA1 through 210C1) and the second voltage boosting control unit 210A2 (210AA2 through 210C2) to respective different driving modes, which are any one of the 1st driving mode and the 2nd driving mode and the other one thereof, after the time when the selection command signal SELx is generated again.

As described above, with regard to claim 14 of the present invention, for example, both the respective driving modes of the first voltage boosting control unit and the second voltage boosting control unit are set to the 2nd driving mode until the selection command signal is generated; when the selection command signal is generated, the driving modes of the first voltage boosting control unit and the second voltage boosting control unit are set to the 1st driving mode and the 2nd driving mode, respectively; when the selection command signal is generated again, the driving modes of the first voltage boosting control unit and the second voltage boosting control unit are set to the 2nd driving mode and the 1st driving mode, respectively. Accordingly, in the case where the difference between the 1st on/off period T01 of the voltage boosting opening/closing device in the 1st driving mode and the 2nd on/off period T02 (T02>T01) of the voltage boosting opening/closing device in the 2nd driving mode is small and in the case where the driving mode of the voltage boosting opening/closing device whose on/off period is shortened because the inductance of the induction device corresponding thereto is small is set to the 2nd driving mode and the driving mode of the voltage boosting opening/closing device whose on/off period is prolonged because the inductance of the induction device corresponding thereto is large is set to the 1st driving mode, the respective on/off periods become further closer to each other even when the driving modes are changed, and hence the selection command signal is generated again; as a result, the driving mode of the voltage boosting opening/closing device whose on/off period is shortened because the inductance of the induction device corresponding thereto is small becomes the 1st driving mode and the driving mode of the voltage boosting opening/closing device whose on/off period is prolonged because the inductance of the induction device corresponding thereto is large becomes the 2nd driving mode, and hence the difference between the respective on/off periods is enlarged; therefore, it is made possible to escape from the state where the selection command signal is generated. Accordingly, because it is not required to set an excessive difference between the 1st on/off period T01 and the 2nd on/off period T02 (T02>T01), there is demonstrated a characteristic that it can be prevented that high-frequency on/off operation overheats the voltage boosting opening/closing device and hence the temperature difference between the respective voltage boosting opening/closing devices in a pair becomes excessively large.

The synchronization state detection unit 220A, 220AA; 220B; 220C includes the synchronization timing detection unit 222A; 222B; 222Ca, 222Cb that generates the in-synchronization detection pulse PLS0 when the circuit-opening timings for the voltage boosting opening/closing devices 111*b* in a pair are close to each other, and generates the selection command signal SELx in response to the occurrence frequency of the in-synchronization detection pulse PLS0 in the predetermined monitoring period SETx; the monitoring period SETx is a time corresponding to the number of occurrence instances of the first drive command signal Dr1 or the second drive command signal Dr2 for the voltage boosting opening/closing device 111*b* to which the 2nd driving mode is applied or a time corresponding to a multiple of the 2nd on/off period T02, which is an average opening/closing period for the voltage boosting opening/closing device 111*b* to which the 2nd driving mode is applied; the respective driving modes are unified to the 2nd driving mode. As described above, with regard to claim 15 of the present invention, the 2nd driving mode is applied in a unification manner to the monitoring period SETx for measuring the occurrence frequency of the in-synchronization detection pulse. Accordingly, there is demonstrated a characteristic that the occurrence frequency of the in-synchronization detection pulse can stably be measured in accordance with a common driving mode set by the initial setting unit, different driving modes set by the 1st alteration setting unit, or different driving modes set by the 2nd alteration setting unit. In the case where there is utilized a timer with which the monitoring period SETx becomes a multiple of an average on/off period for the voltage boosting opening/closing device in the 2nd driving mode, there is demonstrated a characteristic that even when the driving modes are changed, it is not required to correct the monitoring period SETx.

Embodiment 4

(1) Detailed Description of Configuration

Figure 19:
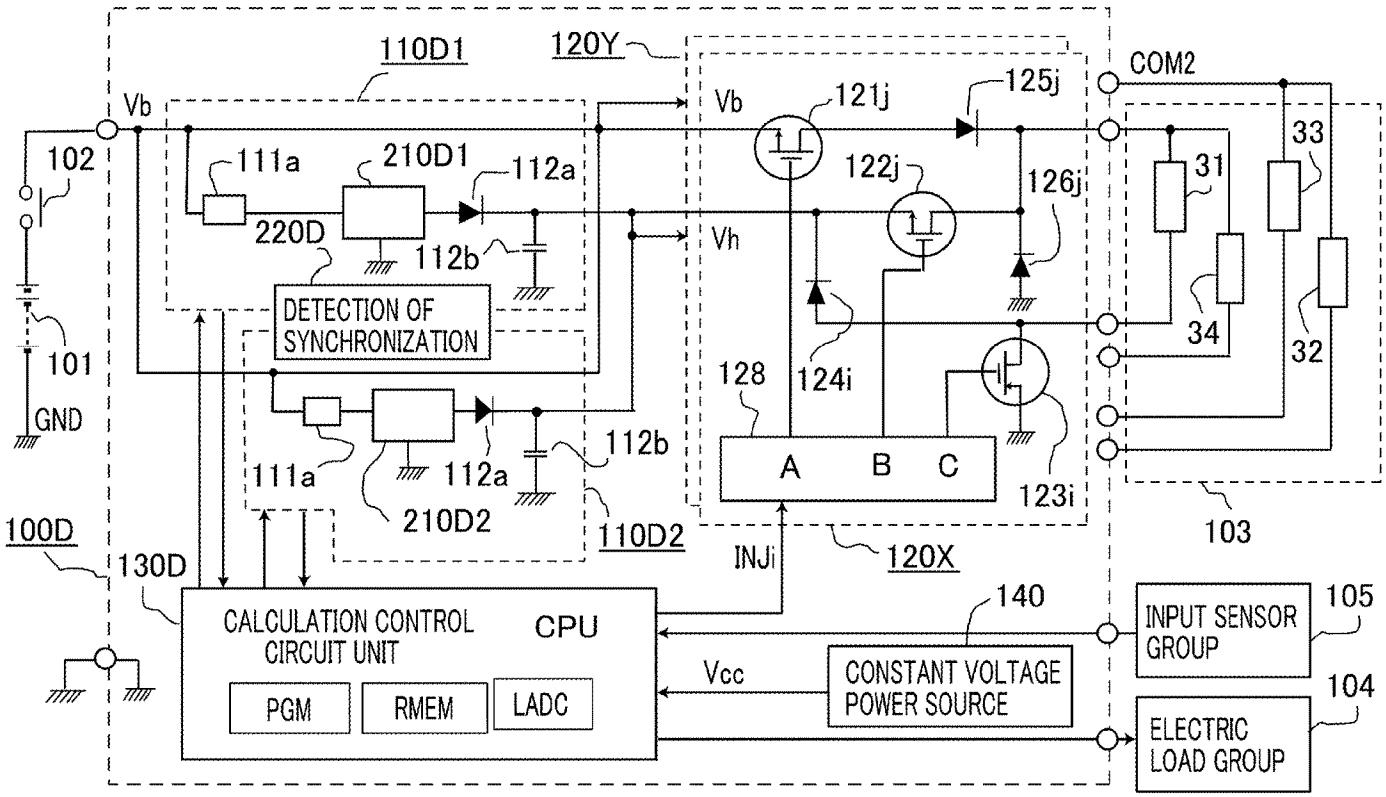
FIG. 19 is a block diagram representing the overall circuit of a vehicle engine control system according to Embodiment 4 of the present invention.

Hereinafter, with reference to FIG. 19, which is a block diagram representing the overall circuit of a vehicle engine control system according to Embodiment 4 of the present invention, FIG. 20, which is a detailed block diagram representing control of the voltage boosting circuit unit of the vehicle engine control system in FIG. 19, and FIG. 21, which is a detailed block diagram representing control of the synchronization state detection unit of the vehicle engine control system in FIG. 19, the configuration of the vehicle engine control system according to Embodiment 4, mainly the difference between the vehicle engine control system represented in FIGS. 1 through 3 and the vehicle engine control system represented in FIGS. 19 through 21, will be explained in detail. In each of the drawings, the same reference characters designate the same or equivalent constituent elements; the upper-case alphabetic characters denote the corresponding constituent elements that vary in accordance with the embodiment. In FIG. 19, a first voltage boosting circuit unit 110D1, a second voltage boosting circuit unit 110D2, a synchronization state detection unit 220D, the driving control circuit units 120X and 120Y, a calculation control circuit unit 130D, and the constant voltage power source 140 that are included in a vehicle engine control system 100D are configured in the same manner as in FIG. 1; the vehicle battery 101, the output contact 102 of the power supply relay, the fuel-injection electromagnetic valve 103 having the electromagnetic coils 31 through 34, the electric load group 104, and the input sensor group 105 are connected with the external portion thereof in the same manner as in FIG. 1. The main different point between the vehicle engine control system 100A and the vehicle engine control system 100D relates to first and second voltage boosting control units 210D1 and 210D2, provided in the first voltage boosting circuit unit 110D1 and the second voltage boosting circuit unit 110D2, respectively, and the synchronization state detection unit 220D that makes the first and second voltage boosting control units 210D1 and 210D2 collaborate with each other; the after-mentioned method for processing, to be implemented after the synchronization state detection unit 220D detects a synchronization state, is different.

In other words, in each of Embodiments 1 through 3, when a synchronization state is detected, the respective driving modes of the voltage boosting opening/closing devices 111*b* in a pair are changed; however, in Embodiment 4, the voltage boosting opening/closing devices 111*b* in a pair are constantly on/off-driven in a common driving mode for middle-current middle-frequency on/off operation based on a setting current I0 and an attenuated current I00, and when the addition current becomes excessively large, one of the voltage boosting opening/closing devices 111*b* is turned off at an early stage. In FIG. 20, the first voltage boosting circuit unit 110D1, the second voltage boosting circuit unit 110D2, and the synchronization state detection unit 220D replace the first voltage boosting circuit unit 110A1, the second voltage boosting circuit unit 110A2, and the synchronization state detection unit 220A, respectively, in FIG. 1; the main different points are that while in each of FIGS. 1 and 2, the circuit-opening time limiting timer 216*b* is utilized in order to determine the circuit-opening time of the voltage boosting opening/closing device 111*b*, a method of directly detecting the attenuated current is adopted in FIG. 20; the exciting current Ix for the induction device 111*a* at a time when the voltage boosting opening/closing device 111*b* is closed and the charging current Ic that flows from the induction device 111*a* to the voltage boosting capacitor 112*b* at a time when the voltage boosting opening/closing device 111*b* is opened flow in the current detection resistor 111*c*. The other constituent elements, i.e., the induction device 111*a*, the voltage boosting opening/closing device 111*b*, the charging diode 112*a*, the driving circuit unit for the voltage boosting capacitor 112*b*, and the input/output signal circuits before and after the voltage boosting comparison determination unit 214*a* are the same as those in FIG. 2.

The first current detection voltage Vc1 is applied to the positive terminal of a comparator forming the current comparison determination unit 211*a*, by way of the positive-side input resistor 211*b*; the divided voltage Vdiv, of the control voltage Vcc, that is obtained through the dividing resistors 212*a*, 212*c*, and 212*b* is applied to the negative terminal thereof, by way of the negative-side input resistor 211*c*. the connection point between the upper voltage dividing resistor 212*a* and the middle voltage dividing resistor 212*c* is connected with the vehicle body ground circuit GND by way of an early-stage-cutoff opening/closing device 213*c* and a post-stage parallel resistor 212*f*; a first early-stage circuit-opening signal FR1 (or a second early-stage circuit-opening signal FR2) to be generated by the synchronization state detection unit 220D is applied to the early-stage-cutoff opening/closing device 213*c* by way of the early-stage-cutoff resistor 213*d*. The positive feedback resistor 211*d* is connected between the output terminal and the positive-side input terminal of the comparator 211*a*; when the exciting current Ix for the induction device 111*a* reaches the setting current I0, the first current detection voltage Vc1 exceeds the divided voltage Vdiv obtained through the voltage dividing resistors 212*a* through 212*c* and hence the output logic of the comparator 211*a* once becomes "H" level. However, in the case where even when the exciting current Ix has not reached the setting current I0, the early-stage-cutoff opening/closing device 213*c* is closed, the divided voltage Vdiv is lowered by the post-stage parallel resistor 212*f* having a low resistance and hence the output logic of the comparator 211*a* becomes "H" at an early stage.

When the output logic of the comparator 211*a* once becomes "H" level, the operation state of the comparator 211*a* is maintained until the first current detection voltage Vc1 falls to a voltage, for example, corresponding to the 1st attenuated current I01; when the first current detection voltage Vc1 further falls, the output logic of the comparator 211*a* returns to "L" level. The detail thereof has been explained in FIG. 7; in FIG. 20, the equations (27c) and (28c) can be obtained by use of the equations (27a) and (28a) related to FIG. 7.

$$I0=Vcc/R0\times[Rbb/(Rac+Rbb)] \tag{27c}$$

$$I00=I0-(Vcc/R0)\times(Rb/Rd) \tag{28c}$$

where it is assumed that the resistance values R111*c*, R211*b*, and R211*d* of the current detection resistor 111*c*, the positive-side input resistor 211*b*, and the positive feedback resistor 211*d* are R0, Rb, and Rd, respectively, and that the resistance values R212*a* through R212*c* of the voltage dividing resistors 212*a* through 212*c* are Rac (=R212*a*+R212*c*) and Rbb, respectively. In the case where the early-stage-cutoff opening/closing device 213*c* is closed, the divided voltage Vdiv obtained through the voltage dividing resistors 212*a*, 212*c*, and 212*b* is lowered by the post-stage parallel resistor 212*f* to be the same as or lower than 70% of the original value.

Figure 21:
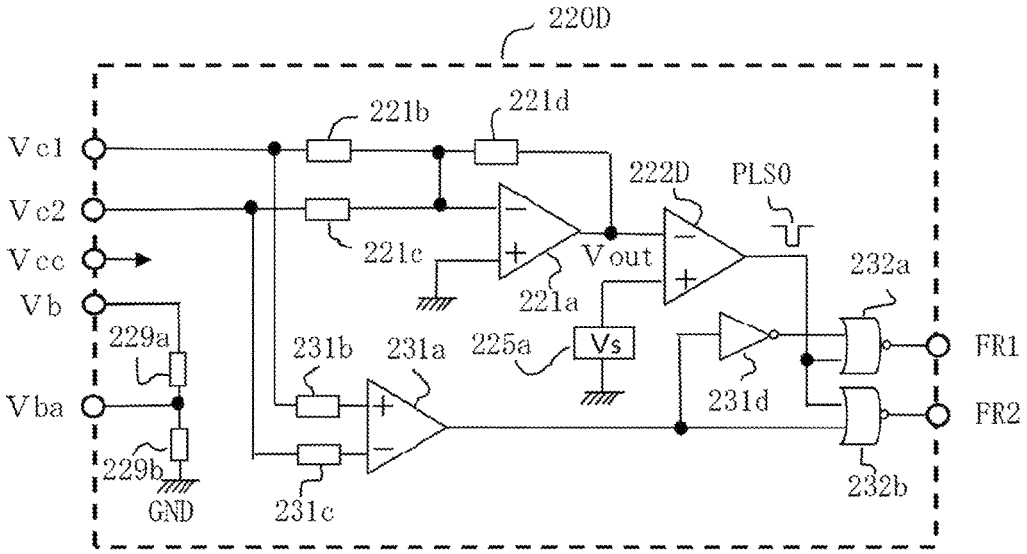
FIG. 21 is a detailed block diagram representing control by a synchronization state detection unit in the vehicle engine control system in FIG. 19.

In FIG. 21, the power-source voltage Vb and the control voltage Vcc are inputted to the synchronization state detection unit 220D; the first current detection voltage Vc1 generated by the first voltage boosting control unit 210D1 and the second current detection voltage Vc2 generated by the second voltage boosting control unit 210D2 are also inputted to the synchronization state detection unit 220D; the first early-stage circuit-opening signal FR1 and the second early-stage circuit-opening signal FR2 are directly transmitted to the first voltage boosting control unit 210D1 and the second voltage boosting control unit 210D2, respectively. The power-source voltage monitoring voltage Vba obtained by dividing the power-source voltage Vb by voltage dividing resistors 229*a* and 229*b* is transmitted to the microprocessor CPU by way of the multi-channel A/D converter LADC in the calculation control circuit unit 130D. The positive-side input terminal of the addition processing unit 221*a*, which is an operational amplifier, is connected with the vehicle body ground circuit; the first current detection voltage Vc1 is applied to the negative-side terminal thereof by way of the 1st input resistor 221*b*; the second current detection voltage Vc2 is applied to the negative-side terminal thereof by way of a 2nd input resistor 221*c*; the output voltage of the addition processing unit 221*a* is applied to the negative-side terminal thereof by way of the negative feedback resistor 221*d*. As a result, letting Rin denote the resistance value of each of the 1st input resistor 221*b* and the 2nd input resistor 221*c* and letting Rout denote the resistance value of the negative feedback resistor 221*d*, the addition output voltage Vout of the addition processing unit 221*a* is given by the equation (14).

$$Vout=G\times(Vc1+Vc2) \quad (14)$$

where the amplification factor G=Rout/Rin»1.

The addition output voltage Vout is inputted to the negative-side terminal of a comparator (222D) forming a synchronization timing detection unit 222D; the addition value determination threshold value voltage 225*a* is applied to the positive-side terminal thereof. The value of the addition value determination threshold value voltage 225*a* is smaller than the maximum value of the addition output voltage Vout and is set, for example, to a value that is the same as or larger than 70% thereof. Accordingly, when the addition output voltage Vout exceeds the threshold value voltage, the output logic of the comparator (222D) becomes "L"; then, the output logic "L" is outputted as the in-synchronization detection pulse PLS0 and is inputted to a first signal generation circuit 232*a* and a second signal generation circuit 232*b*, which are negative OR output circuits. In contrast, the first current detection voltage Vc1 is applied to the positive-side input terminal of a large/small comparison circuit 231*a* by way of an input resistor 231*b*, and the second current detection voltage Vc2 is applied to the negative-side input terminal thereof by way of an input resistor 231*c*; the output of the large/small comparison circuit 231*a* is directly inputted to the second signal generation circuit 232*b* and is inputted to the first signal generation circuit 232*a* by way of a logic inverting circuit 231*d*. As a result, it is when the addition value of the respective exciting currents Ix for the induction devices 111*a* in a pair is excessively large and hence the logic level of the in-synchronization detection pulse PLS0 is "L" and when the first current detection voltage Vc1 and the second current detection voltage Vc2 is in the relationship "Vc1≥Vc2 (or Vc1>Vc2)" that the logic level, of the first signal generation circuit 232*a*, that is the first early-stage circuit-opening signal FR1 becomes "H" and hence the voltage boosting opening/closing device 111*b* of the first voltage boosting circuit unit 110D1 is cut off at an early stage.

It is when the addition value of the respective exciting currents Ix for the induction devices 111*a* in a pair is excessively large and hence the logic level of the in-synchronization detection pulse PLS0 is "L" and when the first current detection voltage Vc1 and the second current detection voltage Vc2 is in the relationship "Vc2>Vc1 (or Vc2≥Vc1)" that the logic level, of the second signal generation circuit 232*b*, that is the second early-stage circuit-opening signal FR2 becomes "H" and hence the voltage boosting opening/closing device 111*b* of the second voltage boosting circuit unit 110D2 is cut off at an early stage. In the case where the first current detection voltage Vc1 and the second current detection voltage Vc2 are in the relationship "Vc1≈Vc2", it may be allowed that the logic level of either one of the first early-stage circuit-opening signal FR1 and the second early-stage circuit-opening signal FR2 is "H" or both the respective logic levels of the first early-stage circuit-opening signal FR1 and the second early-stage circuit-opening signal FR2 are "L". When the logic level of either one of the first early-stage circuit-opening signal FR1 and the second early-stage circuit-opening signal FR2 is "H", one of the early-stage-cutoff opening/closing devices 213*c* in FIG. 20 is closed; as a result, when the output logic of the comparator 211*a* becomes "H", the voltage boosting opening/closing device 111*b* is opened and hence the addition voltage in FIG. 21 decreases, thereby stopping the in-synchronization detection pulse PLS0 from being generated; therefore, the logic level of the first early-stage circuit-opening signal FR1 or the second early-stage circuit-opening signal FR2 quickly returns to "L". Accordingly, after the early-stage-cutoff opening/closing device 213*c* in FIG. 20 is opened and hence the exciting current is attenuated to the attenuated current I00 given by the equation (28c), the voltage boosting opening/closing device 111*b* is closed again.

(2) Detailed Description of Operation and Action

Figure 20:
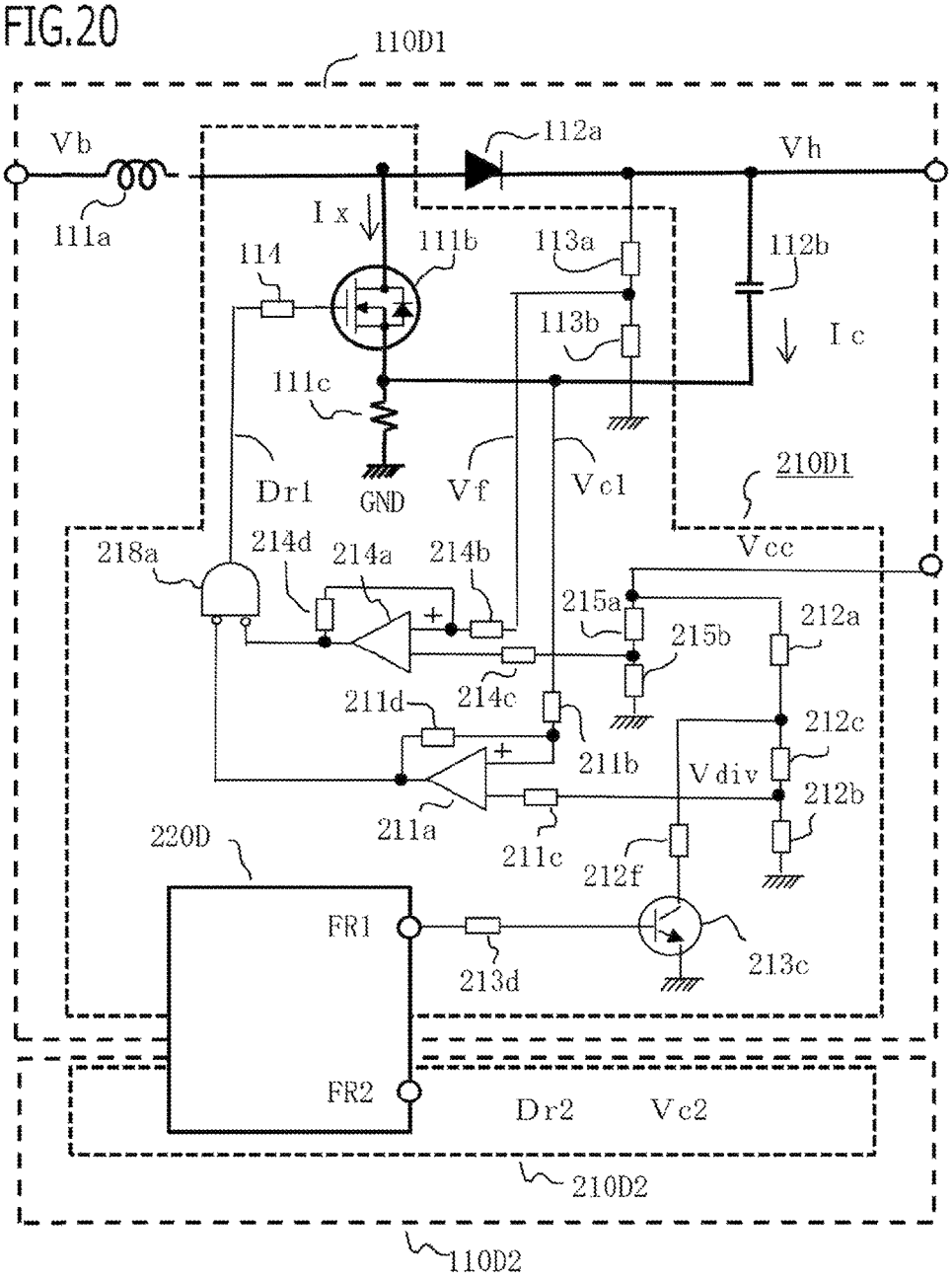
FIG. 20 is a detailed block diagram representing control of a voltage boosting circuit unit in the vehicle engine control system in FIG. 19.

Hereinafter, the action and operation of the vehicle engine control system 100D, configured as represented in FIGS. 19 through 21, according to Embodiment 4 will be explained in detail, based on FIG. 22(A), which is a current waveform chart of the first voltage boosting circuit unit, FIG. 22(B), which is a current waveform chart of the second voltage boosting circuit unit, and FIG. 22(C), which is a waveform chart of the first early-stage circuit-opening signal. At first, in FIG. 19, when the unillustrated power switch is closed, the output contact 102 of the power supply relay is closed, so that the power-source voltage Vb is applied to the vehicle engine control system 100D. As a result, the constant voltage power source 140 generates a stabilized control voltage Vcc, which is, for example, DC 5V, and then the microprocessor CPU starts its control operation. The microprocessor CPU generates a load-driving command signal for the electric load group 104, in response to the operation state of the input sensor group 105 and the contents of a control program stored in the non-volatile program memory PGM, and generates the fuel injection command signal INJi for the fuel-injection electromagnetic valve 103, which is a specific electric load in the electric load group 104, so as to drive the electromagnetic coils 31 through 34 by way of the driving control circuit units 120X and 120Y. Before that, the first and second voltage boosting circuit units 110D1 and 110D2 operate, so that the voltage boosting capacitor 112*b* is charged with a high voltage.

Figure 22:
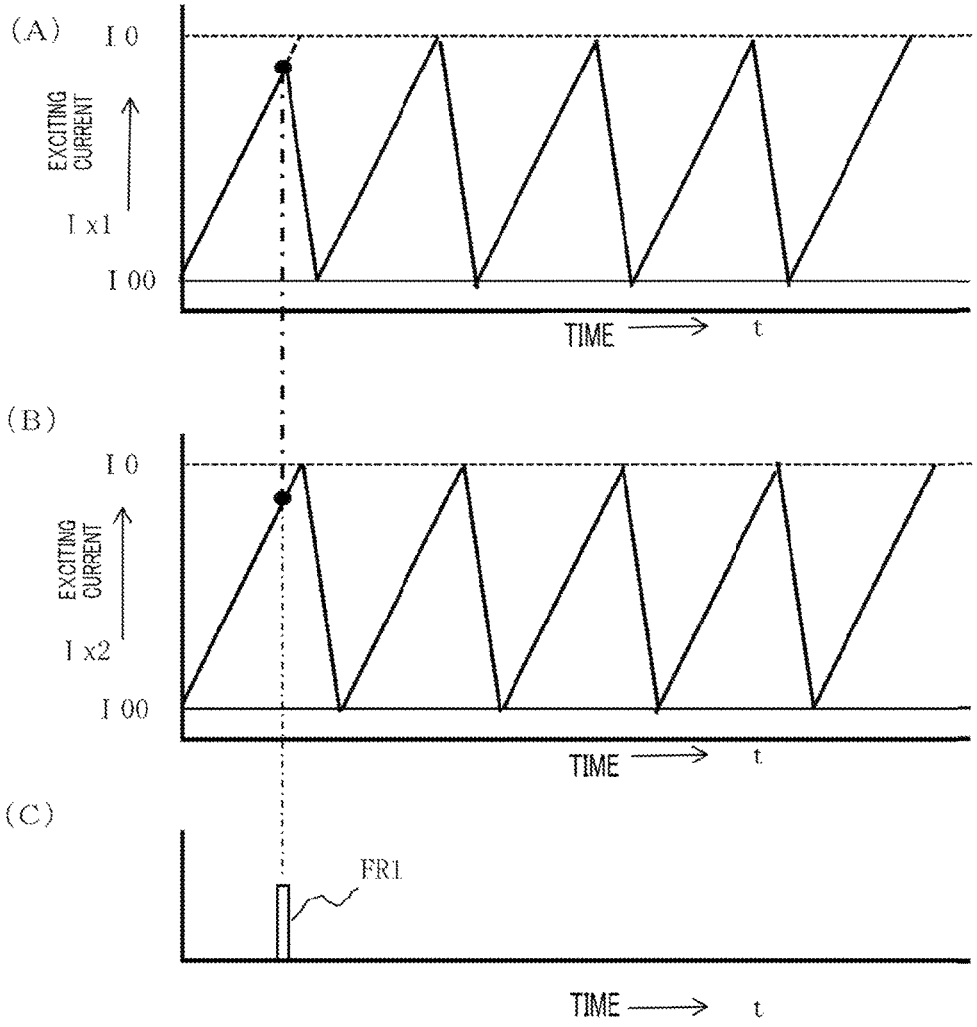
FIG. 22 is a set of current waveform charts including those of first and second voltage boosting circuit units and a first early-stage circuit-opening signal.

FIG. 22(A) represents the waveform of the exciting current Ix1 for the induction device 111*a* at a time when the divided voltage Vdiv in FIG. 20 is set to a value corresponding to the setting current I0, while the logic level of the first early-stage circuit-opening signal FR1 in the first voltage boosting circuit unit 110D1 is set to "L", when the attenuated current I00 is set based on the resistance ratio of the positive feedback resistor 211*d* to the positive-side input resistor 211*b* (the positive feedback resistor 211*d* and the positive-side input resistor 211*b* are included in an attenuated current setting circuit unit), and when the driving mode for middle-current middle-frequency on/off operation is selected. In this regard, however, in FIG. 22(C), the exciting current Ix1 is cut off at an early stage at the timing when the first early-stage circuit-opening signal FR1 is generated. FIG. 22(B) represents the waveform of the exciting current Ix2 for the induction device 111*a* at a time when the divided voltage Vdiv in FIG. 20 is set to a value corresponding to the setting current I0, while the logic level of the second early-stage circuit-opening signal FR2 in the second voltage boosting circuit unit 110D2 is set to "L", when the attenuated current I00 is set based on the resistance ratio of the positive feedback resistor 211*d* to the positive-side input resistor 211*b* (the positive feedback resistor 211*d* and the positive-side input resistor 211*b* are included in the attenuated current setting circuit unit), and when the driving mode for middle-current middle-frequency on/off operation is selected. FIG. 22(C) represents the waveform of the first early-stage circuit-opening signal FR1 that is generated because Vc1 is the same as or larger than Vc2 when the addition value of the first current detection voltage Vc1 and the second current detection voltage Vc2 that are in proportion to the respective values of the exciting current Ix1 and the exciting current Ix2, respectively, exceeds the addition value determination threshold value voltage 225*a* in FIG. 21.

As is clear from the foregoing explanation, in Embodiment 4, when the addition current becomes the same as or larger than a predetermined value, the voltage boosting opening/closing device 111*b* in which a larger exciting current Ix is flowing is turned off at an early stage so that the addition current does not become excessively large and escape from the synchronization state of the respective opening/closing timings of the voltage boosting opening/closing devices 111*b* in a pair is implemented. The current in the voltage boosting opening/closing device 111*b* that has been turned off at an early stage is quickly attenuated and then this particular voltage boosting opening/closing device 111*b* is closed again at an early stage, the small-current high-frequency on/off operation is temporarily performed; thus, the charging power is not affected. In the case where the exciting current is cut off at an early stage, the attenuated current at a time when the voltage boosting opening/closing device is closed again is made to be large in comparison with the case where standard cutoff is performed, so that it is made possible to make the charging power magnitudes coincide each other. Accordingly, in Embodiment 4, although specific constituent elements among diverse constituent elements in Embodiments 1 through 3 are utilized, no means for selecting the 1st driving mode or the 2nd driving mode is provided and hence the first and 2nd driving modes are alternately utilized.

(3) Gist and Feature of Embodiment 4

As is clear from the foregoing explanation, in order to drive the respective fuel-injection electromagnetic valves 103 provided in the cylinders of a multi-cylinder engine, the vehicle engine control system 100D according to Embodiment 4 of the present invention includes the driving control circuit units 120X and 120Y for two or more electromagnetic coils 31 through 34 for driving respective corresponding electromagnetic valves, the first voltage boosting circuit unit 110D1 and the second voltage boosting circuit unit 110D2, and the calculation control circuit unit 130D formed mainly of the microprocessor CPU. The first and second voltage boosting circuit units 110D1 and 110D2 include the first voltage boosting control unit 210D1 and the second voltage boosting control unit 210D2, respectively, that operate independently from each other, a pair of induction devices 111*a* that are on/off-excited by the first voltage boosting control unit 210D1 and the second voltage boosting control unit 210D2, respectively, a pair of respective charging diodes 112*a* that are connected in series with the respective corresponding induction devices 111*a* in a pair, and one voltage boosting capacitor 112*b* or a plurality of voltage boosting capacitors 112*b* that are connected in parallel with each other; each of the voltage boosting capacitors 112*b* is charged by way of the corresponding charging diode 112*a* in a pair by an induction voltage caused through cutting off of the exciting current Ix for the corresponding induction device 111*a* in a pair, and is charged up to the predetermined boosted voltage Vh through a plurality of the on/off exciting actions.

The first voltage boosting control unit 210D1 and the second voltage boosting control unit 210D2 include a pair of respective voltage boosting opening/closing devices 111*b* that are connected in series with the respective corresponding induction devices 111*a* in a pair to be connected with the vehicle battery 101 and that perform on/off control of the respective corresponding induction devices 111*a* in a pair, a pair of current detection resistors 111*c* in each of which the corresponding exciting current Ix and the charging current Ic for the voltage boosting capacitors 112*b* flow, a pair of current comparison determination units 211*a* that cut off energization of one of or both of the pair of voltage boosting opening/closing devices 111*b* when after circuit-closing drive is applied to one of or both of the pair of voltage boosting opening/closing devices 111*b*, the exciting current Ix becomes the same as or larger than a predetermined setting current I0, a pair of attenuated current setting unit 211*d* that performs circuit-closing drive of one of or both of the voltage boosting opening/closing devices 111*b* in a pair when after energization of one of or both of the voltage boosting opening/closing devices 111*b* in a pair are cut off, the exciting current Ix is attenuated to a predetermined attenuated current I00, and the respective voltage boosting comparison determination units 214*a* that prohibit circuit-closing drive of the respective corresponding voltage boosting opening/closing devices 111*b* in a pair when the respective voltages across the corresponding voltage boosting capacitors 112*b* become a predetermined threshold value voltage or higher. The first and second voltage boosting circuit units 210D1 and 210D2 further include the synchronization state detection unit 220D and the early-stage-cutoff opening/closing device 213*c* that opens at an early stage one of the voltage boosting opening/closing devices 111*b* in a pair, by use of the first early-stage circuit-opening signal FR1 or the second early-stage circuit-opening signal FR2 generated by the synchronization state detection unit 220D, before the exciting current Ix reaches the setting current I0.

The synchronization timing detection unit 222D includes the addition processing unit 221*a* that generates an addition amplification voltage obtained by amplifying the addition value of the first current detection voltage Vc1, which is the voltage across one of the current detection resistors 111*c* in a pair, and the second current detection voltage Vc2, which is the voltage across the other one of the current detection resistors 111*c*, the synchronization timing detection unit 222D that detects the synchronization timing when the respective waveforms of the exciting currents Ix for the corresponding induction devices 111*a* in a pair synchronize with each other, when the addition amplification voltage of the addition processing unit 221*a* exceeds the addition value determination threshold value voltage 225*a*, and then generates the in-synchronization detection pulse PLS0, the first signal generation circuit 232*a* that compares the first current detection voltage Vc1 and the second current detection voltage Vc2 and that generates the first early-stage circuit-opening signal FR1 when the in-synchronization detection pulse PLS0 has been generated and the result of the foregoing comparison is that Vc1 is larger than Vc2, and the second signal generation circuit 232*b* that generates the second early-stage circuit-opening signal FR2 when the in-synchronization detection pulse PLS0 has been generated and the result of the foregoing comparison is that Vc1 is smaller than Vc2. The addition value determination threshold value voltage 225*a* is a value that is the same as or larger than 70% but smaller than the maximum value of the addition amplification voltage.

Each of the current detection resistors 111*c* in a pair is connected at an upstream position of each of the induction devices 111*a* in a pair or the charging diodes 112*a* in a pair, or at a downstream position of each of the voltage boosting opening/closing devices 111*b* in a pair and each of the voltage boosting capacitors 112*b* provided one pair; in the case where each of the current detection resistors 111*c* in a pair is connected at a downstream position of the corresponding one of the voltage boosting opening/closing devices 111*b* in a pair, the voltage boosting capacitors 112*b* form a pair and each of the voltage boosting capacitors 112*b* in a pair is connected at an upstream position of the corresponding one of the current detection resistors 111*c* in a pair;

the exciting current Ix, which flows in each of the induction devices 111*a* in a pair when the corresponding one of the voltage boosting opening/closing devices 111*b* in a pair is closed, and the charging current Ic, which flows from each of the induction devices 111*a* in a pair to the corresponding one of the voltage boosting capacitors 112*b* in a pair when the corresponding one of the voltage boosting opening/closing devices 111*b* in a pair is opened, flow into the corresponding one of the current detection resistors 111*c* in a pair; by way of the positive-side input resistor 211*b*, the current detection voltage Vc1 (Vc2) determined by the product of the resistance value of the current detection resistor 111*c* and the exciting current Ix or the charging current Ic is inputted to the positive-side input terminal of each of the comparators in a pair, which forms the corresponding one of the current comparison determination units 211*a* in a pair; the comparison setting voltage Vdiv that is in proportion to the setting current I0, which is the peak value of the exciting current Ix, is inputted to the negative-side input terminal of each of the comparators in a pair, and the output voltage of each of the comparators in a pair is connected with the positive-side input terminal of the particular comparator by way of the positive feedback resistor 211*d*; when any one of the voltage boosting opening/closing devices 111*b* in a pair is closed and hence the current detection voltage Vc1 (Vc2) of the induction device 111*a*, to which energization drive is applied by the particular one of the voltage boosting opening/closing devices 111*b*, becomes the same as or higher than the comparison setting voltage Vdiv, the particular one of the voltage boosting opening/closing devices 111*b* is opened; as a result, when the charging current Ic is attenuated to the predetermined attenuated current I00 or smaller, the particular one of the voltage boosting opening/closing devices 111*b* is closed again; the value of the predetermined attenuated current I00 is adjusted in accordance with the rate of the resistance value Rb of the positive-side input resistor 211*b* to the resistance value Rd of the positive feedback resistor 211*d*; the positive feedback resistor 211*d* is included in the attenuated current setting unit.

As described above, with regard to claim 17 of the present invention, when the current detection voltage Vc1 (Vc2) in proportion to the value of the exciting current Ix that flows in the induction device or the value of the charging current Ic for the voltage boosting capacitor becomes the same as or higher than the comparison setting voltage Vdiv in proportion to the target setting current, the current comparison determination unit that performs on/off control of the voltage boosting opening/closing device opens the voltage boosting opening/closing device; then, when the charging current Ic is attenuated to a predetermined attenuated current or smaller, the current comparison determination unit again closes the voltage boosting opening/closing device; the value of the predetermined attenuated current is set by the attenuated current setting unit including a positive feedback resistor provided in the current comparison determination unit. Therefore, there is demonstrated a characteristic that the value of the attenuated current at a time when the voltage boosting opening/closing device is closed again can accurately be set and that on/off control of the induction device can be performed without depending on the control operation of the microprocessor CPU.

Various modifications and alterations of this invention will be apparent to those skilled in the art without departing from the scope and spirit of this invention, and it should be understood that this is not limited to the illustrative embodiments set forth herein.

What is claimed is:

1. A vehicle engine control system comprising driving control circuits for a plurality of electromagnetic coils for driving fuel-injection electromagnetic valves provided in respective cylinders of a multi-cylinder engine, first and second voltage boosting circuits, and a calculation control circuit formed mainly of a microprocessor, in order to drive the fuel-injection electromagnetic valves, wherein the first and second voltage boosting circuits include a first voltage boosting controller and a second voltage boosting controller, respectively, that operate independently from each other, a pair of induction devices that are on/off-excited by the first voltage boosting controller and the second voltage boosting controller, respectively, a pair of charging diodes that are connected in series with the respective corresponding induction devices in a pair, and a plurality of voltage boosting capacitors that are connected in parallel with each other, each of the voltage boosting capacitors being charged by way of the corresponding charging diodes in a pair with an induction voltage caused through cutting off of an exciting current lx for the corresponding one of the induction devices in a pair and being charged up to a predetermined boosted voltage Vh through a plurality of the on/off exciting actions, wherein the first voltage boosting controller and the second voltage boosting controller include a pair of voltage boosting opening/closing devices that are connected in series with the respective corresponding induction devices in a pair to be connected with a vehicle battery and that perform on/off control of the exciting currents lx for the respective corresponding induction devices in a pair, a pair of current detection resistors in each of which the exciting current lx flows, a pair of current comparison determinators that cut off energization of one of or both of the voltage boosting opening/closing devices in a pair when after circuit-closing drive is applied to one of or both of the voltage boosting opening/closing devices in a pair, the exciting current lx becomes the same as or larger than a target setting current, a pair of circuit-opening time limiting devices that perform circuit-closing drive of one of or both of the voltage boosting opening/closing devices in a pair when after energization of one of or both of the voltage boosting opening/closing devices in a pair is cut off, a predetermined setting time or a predetermined current attenuation time elapses, and voltage boosting comparison determinators that prohibit circuit-closing drive of the respective corresponding voltage boosting opening/closing devices in a pair when the respective voltages across the corresponding voltage boosting capacitors become a predetermined threshold value voltage or higher, wherein the circuit-opening time limiting device is a circuit-opening time limiting timer, which is a time counting circuit that counts the predetermined setting time transmitted from the microprocessor, a circuit-opening time limiter that counts the predetermined setting time in the microprocessor, or an attenuated current setting device that adopts, as the predetermined current attenuation time, a time in which the exciting current Ix is attenuated to a predetermined attenuated current value, wherein in accordance with a 1st setting current I1, which is the target setting current, and a 2nd setting current I2, which is a value larger than the 1st setting current I1, a 1st circuit-opening limit time t1, which is the predetermined setting time, and a 2nd circuit-opening limit time t2, which is a time that is longer than the 1st circuit-opening limit time t1, or a 1st attenuated current I01 and a 2nd attenuated current I02, each of which is the predetermined attenuated current value, any one of a 1st driving mode for small-current high-frequency on/off operation based on the 1st setting current I1, and the 1st circuit-opening limit time t1 or the 1st attenuated current I01, and a 2nd driving mode for large-current low-frequency on/off operation based on the 2nd setting current I2, and the 2nd circuit-opening limit time t2 or the 2nd attenuated current I02 is applied to one of and the other one of the first voltage boosting controller and the second voltage boosting controller, wherein a synchronization state detector that detects and stores a state where respective circuit-opening timings of the voltage boosting opening/closing devices in a pair are continuously close to each other and generates a selection command signal SELx is further provided in each of the first voltage boosting controller and the second voltage boosting controller, and wherein the microprocessor includes an initial setting device that sets the driving modes of the first voltage boosting controller and the second voltage boosting controller to a common driving mode, which is any one of the 1st driving mode and the 2nd driving mode, until the time when the selection command signal SELx is generated and an alteration setting device that sets the driving modes of the first voltage boosting controller and the second voltage boosting controller to respective different driving modes, which are any one of the 1st driving mode and the 2nd driving mode and the other one thereof, after the time when the selection command signal SELx is generated.

2. The vehicle engine control system according to claim 1, wherein in the case where after one of the voltage boosting opening/closing devices is opened at the 1st setting current I1, said one of the voltage boosting opening/closing devices is closed again at a timing when the 1st circuit-opening limit time t1 elapses, the exciting current Ix for one of the induction devices becomes the 1st attenuated current I01, wherein in the case where after the other one of the voltage boosting opening/closing devices is opened at the 2nd setting current I2, said other one of the voltage boosting opening/closing devices is closed again at the timing when the 2nd circuit-opening limit time t2 elapses, the exciting current Ix for the other one of the induction devices becomes the 2nd attenuated current I02, and wherein under the condition that the relationship the 2nd setting current I2 is larger than the 1st setting current I1 and the relationship the 1st attenuated current I01 is larger than the 2nd attenuated current I02 are established, an addition value (I1 +I01) of the 1st setting current I1 and the 1st attenuated current I01 and an addition value (I2 +I02) of the 2nd setting current I2 and the 2nd attenuated current I02 are close to and approximate to each other.

3. The vehicle engine control system according to claim 1, wherein the synchronization state detector includes an addition processor that generates an addition amplification voltage obtained by amplifying the addition value of a first current detection voltage Vc1, which is the voltage across one of the current detection resistors in a pair, and a second current detection voltage Vc2, which is the voltage across the other one of the current detection resistors, a synchronization timing detector that detects a synchronization timing when the respective waveforms of the exciting currents Ix for the corresponding induction devices in a pair synchronize with each other, when the addition amplification voltage of the addition processor exceeds an addition value determination threshold value voltage, and then generates an in-synchronization detection pulse PLS0, a synchronization timing integration processor that determines that the synchronization timing has continuously occurred, when the number of occurrence instances of the in-synchronization detection pulse PLS0 exceeds a predetermined value determined by an integration value determination threshold voltage, that generates the selection command signal SELx, and that stores said selection command signal SELx in a selection command occurrence storage, and a periodic reset processor that periodically resets the number of occurrence instances of the in-synchronization detection pulse PLS0 integrated by the synchronization timing integration processor and that prevents the number of occurrence instances of the in-synchronization detection pulse PLS0 from exceeding the integration value determination threshold voltage, when the number of occurrence instances of the in-synchronization detection pulse PLS0 generated by the synchronization timing detector is low, wherein the synchronization timing integration processor includes an integration capacitor to be charged through an integration resistor when the synchronization timing detector generates the in-synchronization detection pulse PLS0, and determines that the synchronization timing has continuously occurred, when the voltage across the integration capacitor exceeds the integration value determination threshold voltage, wherein the periodic reset processor periodically discharges the integration capacitor in a forcible manner, wherein the addition value determination threshold value voltage is a value that is the same as or larger than 70% but smaller than the maximum value of the addition amplification voltage, and wherein the integration value determination threshold voltage corresponds to a charging voltage at a time when in the interval from the immediate previous forcible discharging by the periodic reset processor to the following forcible discharging, a plurality of maximum-duration charges are applied to the integration capacitor.

4. The vehicle engine control system according to claim 3, wherein a power-source voltage Vb of the vehicle battery is applied to the integration capacitor by way of the integration resistor and a driving transistor that responds to the in-synchronization detection pulse PLS0 generated by the synchronization timing detector.

5. The vehicle engine control system according to claim 1, wherein the synchronization state detector includes a synchronization timing detector provided with a pair of pulse generating circuits that each generate a pulse signal having a predetermined time period, when the respective states of the first drive command signal Dr1 and the second drive command signal Dr2 for driving the corresponding voltage boosting opening/closing devices in a pair become a circuit-opening command state and with a logic combining circuit that generates the in-synchronization detection pulse PLS0 when both the pulse signals in a pair that are generated by the pair of pulse generating circuits are predominant logic, a synchronization timing integration processor that determines that the synchronization timing where the circuit-opening timings of the voltage boosting opening/closing devices in a pair synchronize with each other has continuously occurred, when the number of occurrence instances of the in-synchronization detection pulse PLS0 exceeds a predetermined value determined by an integration value determination threshold voltage, that generates the selection command signal SELx, and that stores said selection command signal SELx in a selection command occurrence storage, and a periodic reset processor that periodically resets the number of occurrence instances of the in-synchronization detection pulse PLS0 integrated by the synchronization timing integration processor and that prevents the number of occurrence instances of the in-synchronization detection pulse PLS0 from exceeding the integration value determination threshold voltage, when the occurrence frequency of the in-synchronization detection pulse PLS0 generated by the synchronization timing detector is low, wherein the synchronization timing integration processor includes an integration capacitor to be charged through an integration resistor when the synchronization timing detector generates the in-synchronization detection pulse PLS0, and determines that the synchronization timing has continuously occurred, when the voltage across the integration capacitor exceeds the integration value determination threshold voltage, wherein the periodic reset processor periodically discharges the integration capacitor in a forcible manner, wherein the time period of each of the pulse signals to be generated by the pulse generating circuits in a pair is the same as or longer than the 1st circuit-opening limit time t1 but the same as or shorter than the 2nd circuit-opening limit time t2, and wherein the integration value determination threshold voltage corresponds to a charging voltage at a time when in the interval from the immediate previous forcible discharging by the periodic reset processor to the following forcible discharging, a plurality of maximum-duration charges are applied to the integration capacitor.

6. The vehicle engine control system according to claim 5, wherein a stabilized control voltage Vcc obtained through a constant voltage power source from the power-source voltage Vb of the vehicle battery is applied to the integration capacitor by way of the integration resistor and a driving transistor that responds to the in-synchronization detection pulse PLS0 generated by the synchronization timing detector.

7. The vehicle engine control system according to claim 1, wherein the calculation control circuit includes a high-speed A/D converter that receives a first current detection amplification voltage Vc11 and a second current detection amplification voltage Vc21, obtained by amplifying the respective voltages across the current detection resistors in a pair, and a charging monitoring voltage Vf, proportional to the voltage across the voltage boosting capacitor, and that performs digital conversion for each channel and then inputs the digitalized first current detection amplification voltage Vc11, the digitalized second current detection amplification voltage Vc21, and the digitalized charging monitoring voltage Vf to the microprocessor, and a program memory that includes a voltage boosting control program and collaborates with the microprocessor, wherein the voltage boosting control program includes the current comparison determinators, the voltage boosting comparison determinators, the circuit-opening time limiter or the attenuated current setting device, and a control program that functions as the synchronization state detector, wherein the synchronization state detector includes a synchronization timing detector that generates the in-synchronization detection pulse PLS0 when before and after the circuit-opening timings of the voltage boosting opening/closing devices in a pair, the circuit-opening timings of the voltage boosting opening/closing devices in a pair are close to each other, a synchronization timing integration processor that generates the selection command signal SELx, a selection command occurrence storage that stores occurrence of the selection command signal SELx, and a periodic reset processor, wherein the synchronization timing integration processor is a synchronization instance counter that determines that the continuous synchronization state where the circuit-opening timings of the voltage boosting opening/closing devices in a pair are continuously close to each other has occurred, when the counting value of the number of occurrence instances of the in-synchronization detection pulse PLS0 exceeds a predetermined threshold value of 2 to 3, and then generates the selection command signal SELx, and wherein the periodic reset processor includes a clock counter that periodically resets the present number of occurrence instances of the in-synchronization detection pulse PLS0 counted by the synchronization timing integration processor and that prevents the selection command signal SELx from being generated when the occurrence frequency of the in-synchronization detection pulse PLS0 generated by the synchronization timing detector is low.

8. The vehicle engine control system according to claim 7, wherein the synchronization timing detector includes first and second pulse generators that each generate a pulse signal having a predetermined time period, when the respective states of a first drive command signal Dr1 and a second drive command signal Dr2 for applying circuit-closing drive to the corresponding voltage boosting opening/closing devices in a pair become a circuit-opening command state, and an in-synchronization detection pulse generator that generates the in-synchronization detection pulse PLS0 when a predominant logic confirming determinator confirms that both the pulse signals in a pair that are generated by the first and second pulse generators are predominant logic, and wherein the time period of each of the pulse signals to be generated by the first and second pulse generators is the same as or longer than the 1st circuit-opening limit time t1 but the same as or shorter than the 2nd circuit-opening limit time t2.

9. The vehicle engine control system according to claim 7, wherein the synchronization timing detector includes an addition processor that calculates a digital addition value of the first and second current detection amplification voltages Vc11 and Vc21 and an in-synchronization detection pulse generator that generates the in-synchronization detection pulse PLS0 when an exceedance determination/confirmation device confirms that the result of addition by the addition processor has exceeded a comparison determination threshold value, and wherein the comparison determination threshold value is a value that is the same as or larger than 70% of the maximum value of the result of the addition but smaller than the maximum value of the result of the addition.

10. The vehicle engine control system according to claim 3, wherein the periodic reset processor includes a clock counter that counts a time counting clock signal or the number of occurrence instances of a first drive command signal Dr1 or a second drive command signal Dr2 for performing circuit-closing drive of corresponding one of the voltage boosting opening/closing devices in a pair, wherein the clock counter operates while utilizing the time, as a monitoring period SETx, that corresponds to a period that is five times as long as the occurrence period of the first drive command signal Dr1 or the second drive command signal Dr2 in the common driving mode, and periodically and forcibly resets the number of occurrence instances of the in-synchronization detection pulse PLS0 to be integrated by the synchronization timing integration processor or the present number of occurrence instances of the in-synchronization detection pulse PLS0 to be counted by the synchronization timing integration processor, each time the monitoring period SETx is reached, wherein when the forcible reset has been completely implemented, the clock counter resets its own present counting value and then recurrently performs the following counting operation at least until the selection command signal SELx is generated, and wherein when the number of occurrence instances of the in-synchronization detection pulse PLS0 is three or larger in the interval between a time of the immediately previous forcible reset and a time of the present forcible reset, the synchronization timing integration processor generates the selection command signal SELx.

11. The vehicle engine control system according to claim 3, wherein the periodic reset processor includes a clock counter that counts a time counting clock signal or the number of occurrence instances of a first drive command signal Dr1 or a second drive command signal Dr2 for performing circuit-closing drive of corresponding one of the voltage boosting opening/closing devices in a pair, wherein the clock counter operates while utilizing the time, as a monitoring period SETx, that is a time period between a time when in the common driving mode, the in-synchronization detection pulse PLS0 is generated and a time when any one of the first drive command signal Dr1 and the second drive command signal Dr2 is newly generated once or twice, and periodically and forcibly resets the number of occurrence instances of the in-synchronization detection pulse PLS0 to be integrated by the synchronization timing integration processor or periodically and forcibly resets the present number of occurrence instances of the in-synchronization detection pulse PLS0 to be counted by the synchronization timing integration processor, each time the monitoring period SETx is reached, wherein when the forcible reset has been completely implemented, the clock counter resets its own present counting value, and then recurrently performs time counting operation even after the occurrence of the in-synchronization detection pulse PLS0, which is generated thereafter, is stored, at least until the selection command signal SELx is generated, and wherein when the number of occurrence instances of the in-synchronization detection pulse PLS0 is two or larger in the interval between a time of the immediately previous forcible reset and a time of the present forcible reset, the synchronization timing integration processor generates the selection command signal SELx.

12. The vehicle engine control system according to claim 10, wherein the clock counter counts the time counting clock signal so as to monitor the number of occurrence instances of the first drive command signal Dr1 or the second drive command signal Dr2, wherein the calculation control circuit includes a program memory that collaborates with the microprocessor, and the program memory includes a control program, which functions as a voltage corrector for the monitoring period SETx, and wherein the value of the monitoring period SETx is corrected by the voltage corrector so as to become a value that is in inverse proportion to the value of a power-source voltage monitoring voltage Vba, which is a divided voltage of the power-source voltage Vb of the vehicle battery.

13. The vehicle engine control system according to claim 10, wherein each of the first voltage boosting circuit and the second voltage boosting circuit, or the calculation control circuit has the circuit-opening time limiting timers or the circuit-opening time limiter, as the pair of circuit-opening time limiting devices, and wherein the values of the 1st circuit-opening limit time t1 and the 2nd circuit-opening limit time t2 to be set by the pair of circuit-opening time limiting devices are corrected by a voltage corrector so as to become values in inverse proportion to the value of the power-source voltage monitoring voltage Vba, which is a divided voltage of the power-source voltage Vb of the vehicle battery.

14. The internal combustion engine controller according to claim 1, wherein the microprocessor includes the initial setting device that sets the driving modes of the first voltage boosting controller and the second voltage boosting controller to a common driving mode, which is any one of the 1st driving mode and the 2nd driving mode, until the selection command signal SELx is generated, a 1st alteration setting device that sets the driving modes of the first voltage boosting controller and the second voltage boosting controller to respective different driving modes, which are any one of the 1st driving mode and the 2nd driving mode and the other one thereof, after the selection command signal SELx is generated, and a 2nd alteration setting device that sets the driving modes of the first voltage boosting controller and the second voltage boosting controller to respective different driving modes, which are any one of the 1st driving mode and the 2nd driving mode and the other one thereof, after the selection command signal SELx is generated again.

15. The vehicle engine control system according to claim 14, wherein the synchronization state detector includes the synchronization timing detector that generates the in-synchronization detection pulse PLS0 when the circuit-opening timings of the voltage boosting opening/closing devices in a pair are close to each other, and generates the selection command signal SELx in response to the occurrence frequency of the in-synchronization detection pulse PLS0 in a predetermined monitoring period SETx, wherein the monitoring period SETx is a time corresponding to the number of occurrence instances of the first drive command signal Dr1 or the second drive command signal Dr2 for the voltage boosting opening/closing device to which the 2nd driving mode is applied, or a time corresponding to a multiple of a 2nd on/off period T02, which is an average opening/closing period for the voltage boosting opening/closing device to which the 2nd driving mode is applied, and wherein the common driving modes are unified to the 2nd driving mode.

* * * * *